US007212225B2

(12) United States Patent
Sumi et al.

(10) Patent No.: US 7,212,225 B2
(45) Date of Patent: May 1, 2007

(54) ENHANCED RESOLUTION IMAGE RECORDING METHOD AND ENHANCED RESOLUTION IMAGE RECORDING APPARATUS

(75) Inventors: Katsuto Sumi, Kanagawa (JP); Daisuke Nakaya, Kanagawa (JP); Takeshi Fujii, Kanagawa (JP); Hiroshi Sunagawa, Kanagawa (JP); Koji Wada, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 149 days.

(21) Appl. No.: 10/244,469

(22) Filed: Sep. 17, 2002

(65) Prior Publication Data

US 2003/0053598 A1 Mar. 20, 2003

(30) Foreign Application Priority Data

| | | |
|---|---|---|
| Sep. 17, 2001 | (JP) | 2001-281171 |
| Oct. 4, 2001 | (JP) | 2001-308958 |
| Oct. 24, 2001 | (JP) | 2001-325940 |
| Nov. 7, 2001 | (JP) | 2001-342080 |
| Mar. 11, 2002 | (JP) | 2002-064987 |

(51) Int. Cl.
*B41J 2/47* (2006.01)

(52) U.S. Cl. ..... 347/239; 347/255

(58) Field of Classification Search ..... 347/239, 347/234–235, 248–250, 129–131, 237–240, 347/251–255, 247; 349/2; 369/112.24; 382/176; 355/53–55, 122–124
See application file for complete search history.

(56) References Cited

U.S. PATENT DOCUMENTS

| | | | | |
|---|---|---|---|---|
| 5,049,901 A | | 9/1991 | Gelbart | 347/239 |
| 5,109,290 A | * | 4/1992 | Imai | 349/2 |
| 5,132,723 A | | 7/1992 | Gelbart | 355/40 |
| 5,668,588 A | * | 9/1997 | Morizumi et al. | 347/242 |
| 5,717,451 A | | 2/1998 | Katano et al. | 347/242 |
| 5,742,703 A | * | 4/1998 | Lin et al. | 382/176 |
| 5,995,475 A | * | 11/1999 | Gelbart | 369/112.24 |

(Continued)

FOREIGN PATENT DOCUMENTS

EP 0 823 810 A2 2/1998

(Continued)

OTHER PUBLICATIONS

Notification of Reasons for Refusal for Patent Application No. JP 2001-342080, dispatched Aug. 30, 2005, Japan Patent Office, Translation of select portions.

*Primary Examiner*—Hai Pham
(74) *Attorney, Agent, or Firm*—Sughrue Mion, PLLC

(57) ABSTRACT

The image recording method and apparatus are used to record an image formed by a group of light source elements disposed in a two-dimensional manner corresponding to recording pixels on a recording medium. In the image recording method and apparatus, an image recording position on the recording medium by the group of light source elements is moved in a direction that contains a component in at least one of two-dimensional disposing directions of the group of light source elements during the recording while modulating, in response to the movement, each recording pixel of the group of light source elements in accordance with an image to be recorded to thereby record the image on the recording medium. The image recording position is moved in accordance with a set magnification for changing the resolution par recording pixel of the group of light source elements. Further, the image recording position is moved by giving a relative speed difference between the relative movement of the group of light source elements and the recording medium and the tracking of the relative movement made by the image recording position by the group of light source elements.

48 Claims, 29 Drawing Sheets

U.S. PATENT DOCUMENTS

| | | | | |
|---|---|---|---|---|
| 6,124,876 | A * | 9/2000 | Sunagawa | 347/239 |
| 6,172,787 | B1 | 1/2001 | Naiki | 359/204 |
| 6,188,426 | B1 | 2/2001 | Nakamura | |
| 6,208,369 | B1 | 3/2001 | Oren et al. | 347/244 |
| 6,246,463 | B1 | 6/2001 | Hamada et al. | 355/41 |
| 6,326,992 | B1 * | 12/2001 | Inoue et al. | 347/241 |
| 2002/0044265 | A1 | 4/2002 | Sumi | |

FOREIGN PATENT DOCUMENTS

| | | | |
|---|---|---|---|
| EP | 0 893 780 | A2 | 1/1999 |
| EP | 0 903 929 | A1 | 3/1999 |
| EP | 0 992 350 | A1 | 4/2000 |
| EP | 1 199 880 | A2 | 4/2002 |
| EP | 1 206 115 | A2 | 5/2002 |
| JP | 9-318892 | A | 12/1997 |
| JP | 10-155091 | A | 6/1998 |
| JP | 2003-57837 | A | 2/2003 |
| WO | WO 00/69631 | A1 | 11/2000 |

* cited by examiner

FIG. 29

| ROTATION ANGLE | DOVE PRISM | IMAGE ROTATOR PRISM | PECHAN PRISM |
|---|---|---|---|
| 0° | | | |
| 90° | | | |
| 180° | | | |
| 270° | | | |

ENHANCED RESOLUTION IMAGE RECORDING METHOD AND ENHANCED RESOLUTION IMAGE RECORDING APPARATUS

BACKGROUND OF THE INVENTION

The present invention relates to the technical field of an image recording method and an image recording apparatus that use two-dimensionally arranged light sources such as a combination of a two-dimensional spatial light modulator and a light source.

In more detail, the present invention relates to an image recording method and an image recording apparatus that make it possible to change resolution without using a zoom lens or a plurality of focusing optical systems during image recording that uses two-dimensionally arranged light sources.

Also, the present invention relates to an image recording method and an image recording apparatus that make it possible to correct aberration in an optical system and various kinds of errors in the optical system without using a zoom lens or a plurality of focusing optical systems during image recording that uses two-dimensionally arranged light sources.

Further, the present invention relates to an image recording method and an image recording apparatus that make it possible to suitably correct shading during image recording that uses two-dimensionally arranged light sources. Therefore, when applied to the printing field or the like, for instance, the image recording method and the recording apparatus make it possible to create a printing plate having an accurate dot area ratio.

Mainly used in a digital image exposure system utilized in various types of printers and the like is a so-called laser beam scan exposure (raster scan) for two-dimensionally exposing a recording medium with a laser beam modulated in accordance with an image to be recorded by deflecting the laser beam in a main scanning direction while relatively moving the recording medium and an optical system in an auxiliary scanning direction perpendicular to the main scanning direction.

In contrast to this, in recent years, there have been proposed various kinds of digital image recording apparatuses that use spatial light modulators (SLMs) having two-dimensional pixel arrangement, such as a liquid crystal display (hereinafter referred to as the "LCD"), a micromirror array (hereinafter referred to as the "MMA") that is called a digital micromirror device™ (DMD™), and the like that are used as display means in displays, monitors, and the like.

In such image recording apparatuses, image recording is basically performed by exposing a recording medium through the projection/focusing of an image formed by a spatial light modulator on the recording medium.

As an example of image recording using the MMA, FIGS. 30A to 30C show the outline of image recording disclosed in U.S. Pat. No. 5,049,901 B, EP 0992350A1 A, and the like.

As is publicly known, an MMA 100 is a two-dimensional spatial light modulator constructed by two-dimensionally disposing a plurality of micromirrors (hereinafter referred to as the "mirrors") 102 that are capable of being modulated (activated/deactivated) through independent rocking. Also, this MMA 100 performs image recording by focusing light emitted from an unillustrated light source and reflected by an activated mirror 102 (in an image recording state) on a recording medium Pt using a focusing optical system 104.

In the example shown in FIGS. 30A to 30C, the recording medium Pt is conveyed in a scanning direction (direction shown by the arrow in FIGS. 30A to 30C) that coincides with one of pixel array directions (directions in which the mirrors 102*a* to 102*c* are disposed in FIGS. 30A to 30C) of the MMA 100.

In FIG. 30A, among the mirrors of the MMA 100, the mirror 102*a* is activated and other mirrors 102 are deactivated. Therefore, only light reflected by the mirror 102*a* is focused on the recording medium Pt and an image is recorded at this position (shaded position).

When the recording medium Pt is conveyed and the position, at which the image has been recorded by the mirror 102*a*, moves, the mirror 102*a* is deactivated and only the mirror 102*b* is activated in accordance with this movement, as shown in FIG. 30B. By doing so, the image is recorded at the same position on the recording medium Pt. When the recording medium Pt is further conveyed, the mirror 102*b* is deactivated and only the mirror 102*c* is activated, as shown in FIG. 30C. By doing so, the image is recorded at the same position.

That is, with this image recording method, the image displayed by the MMA 100 is moved (shifted) in the scanning direction by switching an image display by the MMA 100 in accordance with the conveyance of the recording medium Pt. By doing so, the image is made to track and remain stationary on the conveyed recording medium Pt. As a result, two-dimensional image recording is performed through multiplex exposure by the plurality of mirrors 102.

Note that in an image recording apparatus that forms an image using an optical system like this constructed from a light source and a spatial light modulator or using light sources arranged in a two-dimensional manner (these light sources will be hereinafter collectively referred to as the "two-dimensionally arranged light sources") and projects/focuses this image on a recording medium, the resolution of an image to be recorded is determined by the resolution (pixel pitch) of the two-dimensionally arranged light sources and the magnification of a focusing optical system.

Therefore, in order to perform image recording at a plurality of resolutions that are not in multiple relation to each other (at 2540 dpi, 2438 dpi, and 2400 dpi, for instance), it is required to prepare a zoom lens or focusing lenses whose number is determined in accordance with the resolution of an image to be recorded. As a result, the apparatus construction becomes complicated and this construction is disadvantageous from the viewpoint of cost and space.

Also, in the case where the resolution of the two-dimensionally arranged light sources or the magnification of the optical system deviates from a design value, there occurs a problem that the resolution of an image to be recorded becomes different from a design value and it is impossible to correct this error in the resolution.

The error in resolution like this also occurs in a like manner even in the case where there exists an error in the speed of the main scanning or the auxiliary scanning, in the case where there occurs an error in the size of a recording medium or a machine part due to an environmental fluctuation concerning the temperature, humidity, or the like, in the case where there exists an error in the diameter of a drum if there is used a drum scanner, and in other similar cases.

Also, an image of the two-dimensionally arranged light sources projected on a recording medium is distorted due to the distortion aberration (of barrel type, pincushion type, or the like) possessed by an optical system. Therefore, there occurs an error in the position of each pixel, which results in the occurrence of stripe-shaped unevenness in an image, blur in an edge portion, and the like. As a result, there is degraded image quality. Further, there is a case where an image is distorted because a recording medium is held on a round surface and such image distortion is a problem that also occurs in a like manner in the case where there is recognized irregularity in the disposal of the two-dimensionally arranged light sources.

Also, in the image recording apparatus described above that forms an image using the two-dimensionally arranged light sources and projects/focuses this image on a recording medium, there is a case where there occurs an error in the focusing position of each pixel, an error in the size of each pixel, an error in the light quantity of each pixel, and the like on a focusing surface due to various factors (these errors will be hereinafter collectively referred to as the "shading").

For instance, as is publicly known, the accuracy of a focusing optical system tends to be reduced in a direction from an optical axis to a peripheral portion. As a result, the focusing position of each pixel is shifted in accordance with the position of the pixel, which causes a microscopic error in the size of an image and a local fluctuation in an image area ratio. Also, the size error of each pixel focused on the recording medium Pt is increased toward the peripheral portion (in usual cases, the pixel size is increased). As a result, the microscopic image size error occurs in a like manner, which causes a local fluctuation of the image area ratio in a like manner. For instance, a local fluctuation of the image area ratio like this becomes the locality of a dot area ratio (local fluctuation of the dot area ratio) in the case of a printing use.

Further, the light quantity on the recording medium Pt also tends to be reduced in the direction from the optical axis to the peripheral portion, which causes the unevenness of an exposing amount (=unevenness of a density) and the like.

It is possible to correct the shading like this by locally changing the exposing amount.

However, in the case of image recording that uses the two-dimensionally arranged light sources, it is required to control the exposing amount for each pixel in order to correct the shading, but it is substantially impossible to adjust the light quantity for each pixel. Therefore, the exposing amount control for the shading correction is necessarily performed through pulse modulation, so that it is required to perform very high-speed modulation. This means that the realization of the shading correction is difficult.

Also, the shading correction through exposing amount control is basically a correction where the light quantities of all pixels are corrected to be identical with the smallest light quantity of the pixels. This results in a situation where the exposing light is necessarily wasted and each light source is required to have higher output performance. As a result, an increase in cost is inevitable.

SUMMARY OF THE INVENTION

The first object of the present invention is to solve the aforementioned conventional problems and to provide an image recording method and an image recording apparatus that uses the image recording method, where during image recording that uses two-dimensionally arranged light sources (such as an optical system obtained by combining a light source and a two-dimensional spatial light modulator like a micromirror array (MMA), an optical system that forms an image using dot-shaped light sources disposed in a two-dimensional manner, or the like), the image recording method makes it possible to record an image at an arbitrary resolution irrespective of the resolution of the two-dimensionally arranged light sources and the magnification of a focusing optical system and also makes it possible to significantly reduce image quality degradation caused by the aberration error possessed by the optical system or the like.

The second object of the present invention is to solve the aforementioned conventional problems and to provide an image recording method and an image recording apparatus, where during image recording that uses the two-dimensionally arranged light sources described above, the image recording method and image recording apparatus make it possible to obtain a high-quality image that does not contain image quality degradation caused by the aberration of an optical system, an error, or the like.

The third object of the present invention is to solve the aforementioned conventional problems and to provide an image recording method and an image recording apparatus, where during image recording that uses the two-dimensionally arranged light sources described above, the image recording method and image recording apparatus make it possible to perform the recording of a high-quality image where shading that will cause a local fluctuation of an image area ratio or the like is appropriately corrected without performing the control of an exposing amount and the like through pulse modulation.

In order to attain the first object described above, the first aspect of the present invention provides an image recording method for recording an image formed by a group of light source elements disposed in a two-dimensional manner on a recording medium, comprising moving an image recording position on the recording medium by the group of light source elements in a direction that contains a component in at least one of two-dimensional disposing directions of the group of light source elements during the recording in accordance with a set magnification for changing resolution per recording pixel of the group of light source elements and modulating, in response to the movement, each recording pixel of the group of light source elements in accordance with an image to be recorded to record the image on the recording medium.

In addition, the first aspect of the present invention provides an image recording apparatus comprising two-dimensionally arranged light sources including a group of light source elements corresponding to recording pixels arranged in a two-dimensional manner, a moving means for moving an image recording position on a recording medium by the group of light source elements in a direction that contains a component in at least one of recording pixel array directions of the group of light source elements during the recording in accordance with a set magnification for changing resolution per recording pixel of the group of light source elements of the two-dimensionally arranged light sources, and a modulating means for modulating each recording pixel of the group of light source elements in accordance with an image to be recorded in response to the movement of the image recording position by the moving means.

Preferably, in the first aspect of the present invention, the moving means moves the image recording position in a direction that contains components in both of the recording pixel array directions of the group of light source elements of the two-dimensionally arranged light sources. Further preferably, the moving means moves the image recording position in units of the recording pixels of the group of light source elements of the two-dimensionally arranged light sources, and the image recording position is moved by b pixels if the image recording position is moved in an A direction and is moved by a pixels if the image recording position is moved in a B direction where one of the recording pixel array directions of the group of light source elements is the A direction, the other of the recording pixel array directions is the B direction, a resolution changing magnification in the A direction is a, and a resolution changing magnification in the B direction is b. And, preferably, the modulating means performs modulation a×b times through equal time-division during the moving of the image recording position by the moving means and performs the movement of the image recording position such that it is moved by b pixels if the image recording position is moved in the A direction and is moved by a pixels if the image recording position is moved in the B direction. Preferably, a moving pixel number in the A direction and a moving pixel number in the B direction are alternatively set to one and an integer equal to or larger than two or are set to integers that are equal to or larger than one and are prime to each other.

It is preferable that the image recording apparatus further comprises a main scanning means for relatively moving the two-dimensionally arranged light sources and the recording medium in a main scanning direction that coincides with one of the recording pixel array directions of the group of light source elements of the two-dimensionally arranged light sources, an auxiliary scanning means for relatively moving the two-dimensionally arranged light sources and the recording medium in an auxiliary scanning direction perpendicular to the main scanning direction, and a tracking means for allowing the image recording position by the two-dimensionally arranged light sources to track the relative movement of the two-dimensionally arranged light sources and the recording medium by the main scanning means, wherein an image is recorded by disposing images by the two-dimensionally arranged light sources in the main scanning direction and the auxiliary scanning direction. Preferably, the main scanning direction and the auxiliary scanning direction coincide with the A direction and the B direction, respectively.

Further, in order to attain the first object described above, the second aspect of the present invention provides an image recording apparatus comprising two-dimensionally arranged light sources including a group of light source elements corresponding to recording pixels arranged in a two-dimensional manner, a main scanning means for relatively moving the two-dimensionally arranged light sources and a recording medium in a main scanning direction that coincides with one of recording pixel array directions in the group of light source elements of the two-dimensionally arranged light sources, an auxiliary scanning means for relatively moving the two-dimensionally arranged light sources and the recording medium in an auxiliary scanning direction perpendicular to the main scanning direction, a tracking means for allowing an image recording position by the group of light source elements of the two-dimensionally arranged light sources to track the relative movement of the two-dimensionally arranged light sources and the recording medium, a moving means for moving the image recording position by the two-dimensionally arranged light sources in a direction that contains a component in at least one of the main scanning direction and the auxiliary scanning direction by giving a relative speed difference between the tracking by the tracking means and the relative movement of the two-dimensionally arranged light sources and the recording medium, and a modulating means for modulating each recording pixel of the group of light source elements of the two-dimensionally arranged light sources in accordance with an image to be recorded in response to the movement of the image recording position by the moving means.

In the second aspect of the present invention, preferably, the moving means moves the image recording position in a direction that contains components in both of the recording pixel array directions of the group of light source elements of the two-dimensionally arranged light sources. Preferably, the tracking means and the moving means are a light deflector that deflects projection light of the two-dimensionally arranged light sources at an angle with respect to the main scanning direction, and the modulating means doubles as the tracking means by moving image display by the two-dimensionally arranged light sources in the main scanning direction. And, further preferably, provided that a relative moving speed by the main scanning means is Vy, a relative moving speed by the auxiliary scanning means is Vx, a time taken to move the image recording position by the moving means is T, an angle between the moving direction of the image recording position by the moving means and the main scanning direction is θ, a moving distance of the image recording position by the moving means in the main scanning direction is ΔY, and a moving distance of the image recording position by the moving means in the auxiliary scanning direction is ΔX, the following equation is satisfied, $$\tan\theta=(VxT\pm\Delta X)/(VyT\pm\Delta Y).$$

In order to attain the first object described above, the third aspect of the present invention provides an image recording method for recording an image formed by a group of light source elements disposed in a two-dimensional manner on the recording medium, comprising moving an image recording position by the group of light source elements on a recording medium in a direction that contains a component in at least one of two-dimensional disposed directions of the group of light source elements during the recording, and modulating, in response to this movement, each recording pixel of the group of light source elements in accordance with an image to be recorded to record the image on the recording medium.

And, the third aspect of the present invention provides an image recording apparatus comprising two-dimensionally arranged light sources including a group of light source elements corresponding to recording pixels arranged in a two-dimensional manner, a moving means for moving an image recording position by the group of light source elements of the two-dimensionally arranged light sources on a recording medium in a direction that contains a component in at least one of recording pixel array directions of the group of light source elements of the two-dimensionally arranged light sources during recording, and a modulating means for, in response to the movement of the image recording position by the moving means, modulating each recording pixel of the group of light source elements of the two-dimensionally arranged light sources in accordance with an image to be recorded.

In the third aspect of the present invention, preferably, the moving means moves the image recording position in a direction that contains components in both of the recording pixel array directions of the group of light source elements of the two-dimensionally arranged light sources. Preferably, provided that one of the recording pixel array directions of the group of light source elements of the two-dimensionally arranged light sources is an A direction, the other of the recording pixel array directions is a B direction, a recording pixel pitch in the A direction is Ap, a recording pixel pitch in the B direction is Bp, a moving amount of the image recording position by the moving means in the A direction is As, a moving amount of the image recording position by the moving means in the B direction is Bs, As/Ap=m, and Bs/Bp=n, m and n are each an integer equal to or larger than one. Further, preferably, m and n are alternatively set to one and an integer equal to or larger than two, or are set to integers that are equal to or larger than one and are prime to each other, and the modulating means performs the modulation a number of times, which is square of greater one of m and n, through equal time-division during the movement of the image recording position by the moving means. Preferably, when Ap and Bp differ from each other and t that is an integer is obtained under a condition of Bp/m=q and Ap/q=t when m>n and is obtained under a condition of Ap/n=q and Bp/q=t when m<n, during the movement of the image recording position by the moving means, the modulating means performs the modulation m*t times through the equal time-division when m>n and performs the modulation n*t times through the equal time-division when m<n.

It is preferable that the image recording apparatus further comprises a means for performing main scanning where the two-dimensionally arranged light sources and the recording medium are relatively moved in a direction, a means for performing auxiliary scanning where the two-dimensionally arranged light sources and the recording medium are relatively moved in an auxiliary scanning direction perpendicular to the main scanning direction, and a tracking means for allowing the image recording position by the two-dimensionally arranged light sources approximately to track the main scanning and the auxiliary scanning, wherein an image is recorded by disposing images by the two-dimensionally arranged light sources in the main scanning direction and the auxiliary scanning direction, and the image recording position is moved by a relative speed difference between the approximate tracking by the tracking means and at least one of the main scanning and the auxiliary scanning. Preferably, the main scanning direction and the auxiliary scanning direction coincide with the A direction and the B direction.

In order to attain the second object described above, the fourth aspect of the present invention provides an image recording method for recording an image formed by a group of light source elements disposed in a two-dimensional manner on the recording medium, comprising moving an image recording position by the group of light source elements on a recording medium in a direction that contains a component in at least one of two-dimensional disposed directions of the group of light source elements during the recording, and modulating, in response to this movement, each recording pixel of the group of light source elements in accordance with an image to be recorded by taking, into consideration, a difference between an actual position of an image of the group of light source elements of the two-dimensionally arranged light sources on the recording medium and an ideal position of the two-dimensionally arranged light sources on the recording medium to record the image on the recording medium.

In addition, the fourth aspect of the present invention provides an image recording apparatus comprising two-dimensionally arranged light sources including a group of light source elements corresponding to recording pixels arranged in a two-dimensional manner, a moving means for moving an image recording position by the group of light source elements of the two-dimensionally arranged light sources on a recording medium in a direction that contains a component in at least one of recording pixel array directions of the group of light source elements of the two-dimensionally arranged light sources during recording, and a modulating means for, in response to the movement of the image recording position by the moving means, modulating each recording pixel of the group of light source elements of the two-dimensionally arranged light sources in accordance with an image to be recorded by taking, into consideration, a difference between an actual position of an image of the group of light source elements of the two-dimensionally arranged light sources on the recording medium and an ideal position of the group of light source elements of the two-dimensionally arranged light sources on the recording medium.

In the fourth aspect of the present invention, preferably, the modulating means performs the modulation using a function that shows a difference between a preset actual position of the image of the group of light source elements of the two-dimensionally arranged light sources on the recording medium and the ideal position of the group of light source elements of the two-dimensionally arranged light sources on the recording medium. Preferably, the function changes with time. And, preferably, the modulating means performs the modulation by one of (i) mapping the image by the group of light source elements of the two-dimensionally arranged light sources on the recording medium and (ii) mapping a pattern, which should be recorded on the recording medium, on the group of light source elements of the two-dimensionally arranged light sources.

In order to attain the third object described above, the fifth aspect of the present invention provides an image recording method for recording an image formed by a group of light source elements disposed in a two-dimensional manner on a recording medium, comprising moving an image recording position by the group of light source elements on the recording medium in a direction that contains a component in at least one of two-dimensional disposing directions of the group of light source elements during the recording, and modulating, in response to this movement, each recording pixel of the group of light source elements in accordance with an image to be recorded based on a threshold value set based on a pixel position to record the image on the recording medium.

The fifth aspect of the present invention provides an image recording apparatus comprising two-dimensionally arranged light sources including a group of light source elements corresponding to recording pixels arranged in a two-dimensional manner, a moving means for, during the recording, moving an image recording position on a recording medium by the group of light source elements of the two-dimensionally arranged light sources in a direction that contains a component in at least one of recording pixel array directions of the group of light source elements of the two-dimensionally arranged light sources; and a modulating means for, in response to the movement of the image recording position by the moving means, modulating each recording pixel of the group of light source elements of the two-dimensionally arranged light sources in accordance with an image to be recorded based on a threshold value set based on a pixel position.

In the fifth aspect of the present invention, preferably, the moving means moves the image recording position in a direction that contains components in both of the recording pixel array directions of the group of light source elements of the two-dimensionally arranged light sources. And it is preferable that the image recording apparatus further comprises a main scanning means for relatively moving the two-dimensionally arranged light sources and the recording medium in a main scanning direction that coincides with one of the recording pixel array directions in the group of light source elements of the two-dimensionally arranged light sources, an auxiliary scanning means for relatively moving the two-dimensionally arranged light sources and the recording medium in an auxiliary scanning direction perpendicular to the main scanning direction, and a tracking means for allowing the image recording position by the two-dimensionally arranged light sources to track the relative movement of the two-dimensionally arranged light sources and the recording medium by the main scanning means, wherein an image is recorded by disposing images by the two-dimensionally arranged light sources in the main scanning direction and the auxiliary scanning direction.

BRIEF DESCRIPTION OF THE DRAWINGS

In the accompanying drawings:

FIG. 29 shows examples of a method of moving projection light during the image recording of the present invention.

DETAILED DESCRIPTION OF THE PREFERRED EMBODIMENTS

An image recording method and an image recording apparatus according to the present invention will be described in detail below based on preferred embodiments shown in the accompanying drawings.

First, the construction and operation that are common to image recording methods and image recording apparatuses in accordance with first to fifth embodiments of the present invention will be described with reference to FIGS. 1 to 10.

Figure 1:
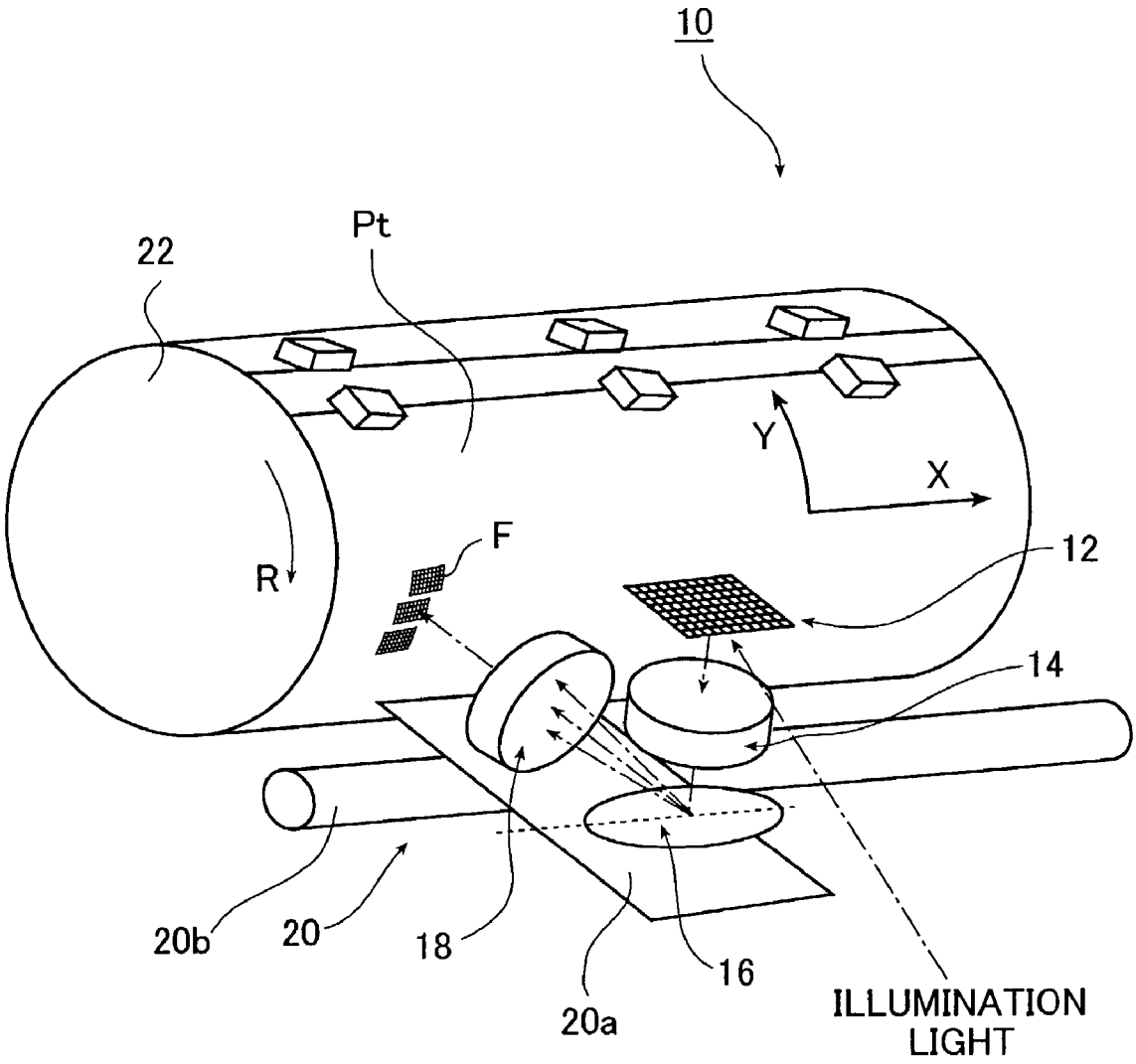
FIG. 1 is a perspective view showing an outline of an example of an image recording apparatus of the present invention.

FIG. 1 is a perspective view showing an outline of an example of an image recording apparatus of the present invention that carries out an image recording method of the present invention.

An image recording apparatus (hereinafter referred to as the "recording apparatus") 10 shown in FIG. 1 uses two-dimensionally arranged light sources, in which two-dimensional spatial light modulator is combined with a light source for illuminating the two-dimensional spatial light modulator, as two-dimensionally arranged light sources having recording pixels (a group of light source elements) arranged in a two-dimensional manner. The image recording apparatus 10 records an image by two-dimensionally exposing a recording medium Pt by disposing projection light from the two-dimensionally arranged light sources (micromirror array (MMA) 12 in the illustrated example) on the recording medium Pt using the two-dimensionally arranged light sources and a so-called external drum (outer drum).

It should be noted here that in the present invention, the two-dimensionally arranged light sources refer to a group of light source elements (also called a group of light sources) that correspond to respective recording pixels and are disposed in a two-dimensional manner.

The recording apparatus 10 like this basically comprises a light source (not shown) that emits illumination light, a micromirror array (hereinafter referred to as the "MMA") 12 (such as a digital micromirror device™ (DMD™) manufactured by Texas Instruments Inc.) that is a two-dimensional spatial light modulator, a collimator lens 14, a light deflector 16, a focusing lens 18, an auxiliary scanning drive system 20, an external drum (hereinafter referred to as the "drum") 22, and a control means (not shown) for controlling these construction elements.

Also, the recording medium Pt is wound around the external surface of the drum 22 and is held/fixed by a known means.

As the light source, it is possible to use various kinds of light sources that emit light corresponding to the spectral sensitivity characteristic of the recording medium Pt to be used so long as they are able to emit light (illumination light) having a sufficient light quantity.

For example, it is possible to use a ultra-high pressure mercury lamp, a metal halide lamp, and the like as the light source in the case where an ordinary PS plate (conventional PS plate) that is capable of being exposed by ultraviolet rays is used as the recording medium Pt. It is also possible to use an infrared broad area LD (laser diode) or the like in the case where a heat mode recording medium that is sensitive to infrared light (heat) is used as the recording medium Pt. In addition to the above, it is possible to use a halogen lamp, a xenon lamp, and the like in accordance with the type of the recording medium Pt.

Also, in the case of image recording that does not perform area modulation through pulse modulation but performs density expression through direct area modulation based on the number of recording pixels (the number of activated mirrors of the MMA 12) like in the case of image recording in a printing use, by using a light source that emits light having a light quantity with which it is possible to neglect the reduction of the light quantity in the periphery due to shading, it becomes possible to save the necessity to perform correction through image processing in order to cope with the light quantity reduction.

As is publicly known, the MMA 12 is a two-dimensional spatial light modulator constructed by two-dimensionally disposing rectangular micromirrors that are capable of turning (rocking) by a predetermined angle about a predetermined rotation axis provided on a surface opposite to a reflection surface. By turning (rocking) these micromirrors electrostatically, that is, using an electrostatic force or the like, light is modulated for respective micromirrors (=pixels) to be turned on/off for exposure. As a specific example, it is possible to use DMD™ (digital micromirror device™) commercially available from Texas Instruments Inc. For instance, in the recording apparatus 10 in the illustrated example, there is used the MMA 12 whose pixel pitch is 17 μm and which has 1024×1280 pixels.

Also, each construction element is arranged so that the rotation direction (direction shown by the arrow R in FIG. 1) of the drum 22 to be described later optically coincides with one of pixel row directions of the MMA 12 and the axis of the drum 22 optically coincides with the other of the pixel row directions. In the following description, the pixel row direction (direction shown by the arrow Y in FIG. 1) of the MMA 12 that is a direction opposite to the rotation of the drum 22 is referred to as the "main scanning direction" and the rightward direction in FIG. 1 (direction shown by the arrow X in FIG. 1) that is the axial direction of the drum 22 is referred to as the "auxiliary scanning direction".

It should be noted here that in the present invention, the two-dimensionally arranged light sources are those that can generate, through the two-dimensional arrangement, projection images each constituting the minimum recording unit and capable of individual modulation. In the illustrated example, as described above, by combining the MMA 12 that is a two-dimensional spatial light modulator with a light source, there is constructed the two-dimensionally arranged light sources. Here, in the present invention, as the two-dimensional spatial light modulator constituting the two-dimensionally arranged light sources, it is possible to use, for instance, a liquid crystal shutter array constructed by disposing liquid crystal shutters in a two-dimensional manner, PLZT type, EO type, AO type, GLV type, or the like, aside from the MMA 12 such as the DMD™.

Also, in the present invention, the two-dimensionally arranged light sources are not limited to the combination of a light source with a spatial light modulator. For instance, as the two-dimensionally arranged light sources, there may be used an array-shaped light source constructed by two-dimensionally disposing dot-shaped light sources like LEDs, a self-light-emitting-type display like a CRT, a backlight-type LCD (liquid crystal display), or the like.

However, the most preferable two-dimensionally arranged light sources are the combination of the MMA 12 with a light source in terms of the modulation speed, the efficiency of use of light, and the like.

The collimator lens 14 converts light bearing an image reflected by the MMA 12 into parallel light and has the parallel light strike the light deflector 16.

The light deflector 16 is tracking means for having projection light from the MMA 12 on the recording medium Pt subjected to the main scanning track an incident position (image recording position) of the projection light from the MMA 12 onto the recording medium Pt, as schematically shown in FIG. 1. To do so, the light deflector 16 deflects light entered through the collimator lens 14 in a direction that substantially coincides with the rotation direction of the drum 22.

That is, the light deflector 16 basically deflects the projection light from the MMA 12 that bears an image in the drum rotation direction in synchronization with the rotation of the drum 22. As a result, the light deflector 16 has this projection light track a position on the recording medium Pt that is being rotated, and has the projection light remain stationary (substantially stationary when the shifting of a frame F to be described later is taken into consideration) at a constant position on the recording medium Pt for a predetermined recording time period (exposing time period).

In the following description, the projection light from the MMA 12 on the recording medium Pt is referred to as the "frame F". Also, the recording of one image by the frame F made to remain stationary on the recording medium Pt through the deflection by the light deflector 16 is referred to as the "recording of one frame". Accordingly, one frame becomes a size of one image area on the recording medium Pt by the MMA 12 (area that is capable of being exposed by the MMA 12 at a time).

Here, in the present invention, during the image recording (exposing) of one frame, the image recording position on the recording medium Pt is moved in a direction that contains at least one of the pixel array directions of the two-dimensionally arranged light sources.

In the recording apparatus 10, the optical system is constructed so that the pixel array directions of the MMA 12 optically coincide with the main scanning direction and the auxiliary scanning direction. Therefore, as a preferable example, during the image recording of one frame that is performed while having the frame remain stationary on the recording medium Pt, the frame F (incident position of the projection light from the MMA 12) is moved in a direction that contains components in both of the main scanning direction and the auxiliary scanning direction (these components will be hereinafter referred to as the "both of the main and auxiliary components"). Note that in another example of the present invention, during this image recording of one frame, by generating a relative speed difference between (i) the main scanning and the auxiliary scanning and (ii) the tracking by the frame F, the frame F is moved in the direction containing both of the main and auxiliary components. This movement of the frame F during the recording of the frame is hereinafter referred to as the "shifting of the frame F".

In the recording apparatus 10 in the illustrated example, as a more preferable example, the optical deflector 16 that is the tracking means doubles as a moving means for shifting the frame F. Therefore, the deflection direction of the light deflector 16 has a slight angle with reference to the rotation direction (main scanning direction). (Also, in another example of the present invention, with this construction, there is maintained a relative speed difference between (i) the main scanning and the auxiliary scanning and (ii) the tracking by the frame F by itself.) How the light deflector 16 like this operates will be described in detail later.

As the light deflector 16, it is possible to use various kinds of light deflectors such as a galvanometer mirror, a polygon mirror, a piezo system, and a light deflector that shifts a lens in the rotation direction of the drum 22. In the recording apparatus 10 in the illustrated example, a galvanometer mirror (hereinafter referred to as the "galvano-mirror") is used as a suitable example.

The focusing lens 18 focuses the projection light from the MMA 12, which has been deflected by the light deflector 16, at a predetermined position on the recording medium Pt wound around the drum 22.

The drum 22 is a cylinder that is held/fixed with a known method under a state where the recording medium Pt is wound around its outer surface and is rotated about an axis in a direction shown by the arrow R in FIG. 1 that is opposite to the main scanning direction. With this construction, the MMA 12 (two-dimensionally arranged light sources) and the recording medium Pt relatively move in the main scanning direction (that is, there is performed the main scanning).

It should be noted here that in the present invention, there is imposed no specific limitation on the recording medium Pt to be used. That is, it does not matter whether the recording medium Pt is made of a photosensitive material or a thermal material. Also, it does not matter whether the recording medium Pt has a film shape or a plate shape.

The optical system includes the light source, the MMA 12, the collimator lens 14, the light deflector 16, and the focusing lens 18 that are integrated together as a unit, and is moved by an auxiliary scanning drive system 20 at a constant speed in the auxiliary scanning direction (direction shown by the arrow X in FIG. 1). With this construction, the MMA 12 and the recording medium Pt are relatively moved in the auxiliary scanning direction (that is, there is performed the auxiliary scanning).

The auxiliary scanning drive system 20 is a known system that is applied to a so-called drum scanner or the like. For instance, this auxiliary scanning drive system 20 is constructed of an unillustrated drive source, a moving base 20*a* on which the optical system that is made as a unit is mounted, and a moving axis 20*b* on which this moving base 20*a* moves and which extends in the auxiliary scanning direction.

It should be noted here that in the present invention, means for performing the main scanning and the auxiliary scanning while holding the recording medium Pt is not limited to the (external) drum 22 in the illustrated example. That is, there arises no problem even if the means is a flat bed or an internal drum that holds the recording medium Pt using its internal surface.

Figure 2:
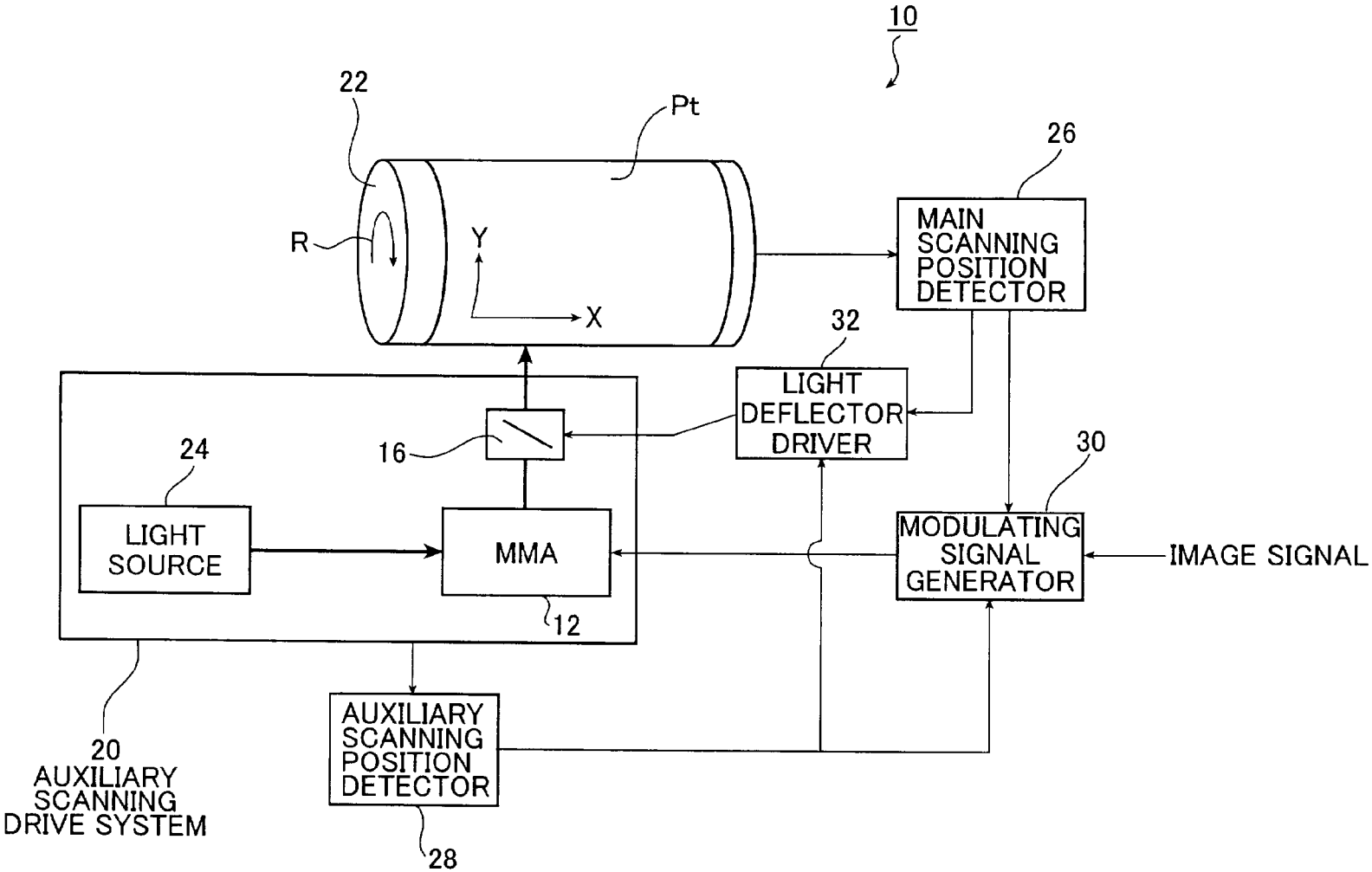
FIG. 2 is a block diagram showing image recording timing control by the image recording apparatus shown in FIG. 1.

FIG. 2 is a block diagram showing recording timing control by the recording apparatus 10.

As shown in FIG. 2, the construction elements of the optical system, such as the light source 24, the MMA 12, the light deflector 16, and the like (the collimator lens 14 and the focusing lens 18 are omitted in FIG. 2), are integrally constructed and are continuously moved at a constant speed in the auxiliary scanning direction X by the auxiliary scanning drive system 20 at least during image recording.

As described above, during image recording, the drum 22 holding the recording medium Pt is rotated and the light deflector 16 deflects the frame F (projection light by the MMA 12) in a direction that substantially coincides with the main scanning direction in synchronization with the rotation of the drum 22. As a result, the frame F is made to remain stationary on the recording medium Pt for a predetermined recording time period and there is performed the recording of one frame. Also, during the image recording, a unit of the optical system is carried in the auxiliary scanning direction by the auxiliary scanning drive system 20.

In order to perform timing control, a main scanning position detector 26 is provided for the drum 22 and the auxiliary scanning drive system 20 is provided with an auxiliary scanning position detector 28 for detecting an auxiliary scanning position. As the main scanning position detector 26, it is possible to use a rotary encoder that detects a rotation position of the drum 22, for instance.

To the MMA 12, there is connected a modulating signal generator 30 that supplies image data of one frame (specifying the activation/deactivation of each micromirror). Image signal is inputted into the modulating signal generator 30 and image signal to be sent to the MMA 12 is switched based on detection signals from the main scanning position detector 26 and the auxiliary scanning position detector 28.

Also, to the light deflector 16, there is connected a light deflector driver 32. This light deflector driver 32 drives the light deflector 16 based on detection signals from the main scanning position detector 26 and the auxiliary scanning position detector 28, thereby having the light deflector 16 deflect the projection light by the MMA 12 in synchronism with the relative movement of the recording medium Pt.

In the recording apparatus 10 like this, image recording is performed by, in an image recording area of the recording medium Pt, two-dimensionally disposing each image of one frame recorded by having the frame image track and remain stationary on the recording medium Pt using the light deflector 16 in the manner described above.

Here, the image recording may be performed in the manner described below. Frame images by the MMA 12 for one row are formed in the main scanning direction (Y direction) by having the drum 22 make one rotation under a state where the auxiliary scanning is stopped. Following this, the MMA 12 (optical system) is moved in the auxiliary scanning direction by an amount corresponding to the size of one frame in the auxiliary scanning direction (X direction) using the auxiliary scanning drive system 20. Then, image recording for one row in the main scanning direction is performed again. By disposing frames F on the entire surface of the recording medium Pt, an image may be recorded (the auxiliary scanning speed is zero in this case).

However, in the illustrated example, in order to shorten a time period taken to record one image or to reduce a load placed on the auxiliary scanning drive system 20, as a preferable example, image recording for the entire surface is performed while continuously performing the auxiliary scanning. That is, the image recording is performed by spirally disposing frames F on the recording medium Pt wound around the drum 22, as described above.

That is, in the recording apparatus 10 in the illustrated example, the auxiliary scanning speed by the auxiliary scanning drive system 20 is set in accordance with the rotation speed (main scanning speed) of the drum 22 so that a frame F that should be recorded comes adjacent to a previously recorded frame F in the auxiliary scanning direction at a point in time when the drum 22 finishes its one rotation.

Figure 3:
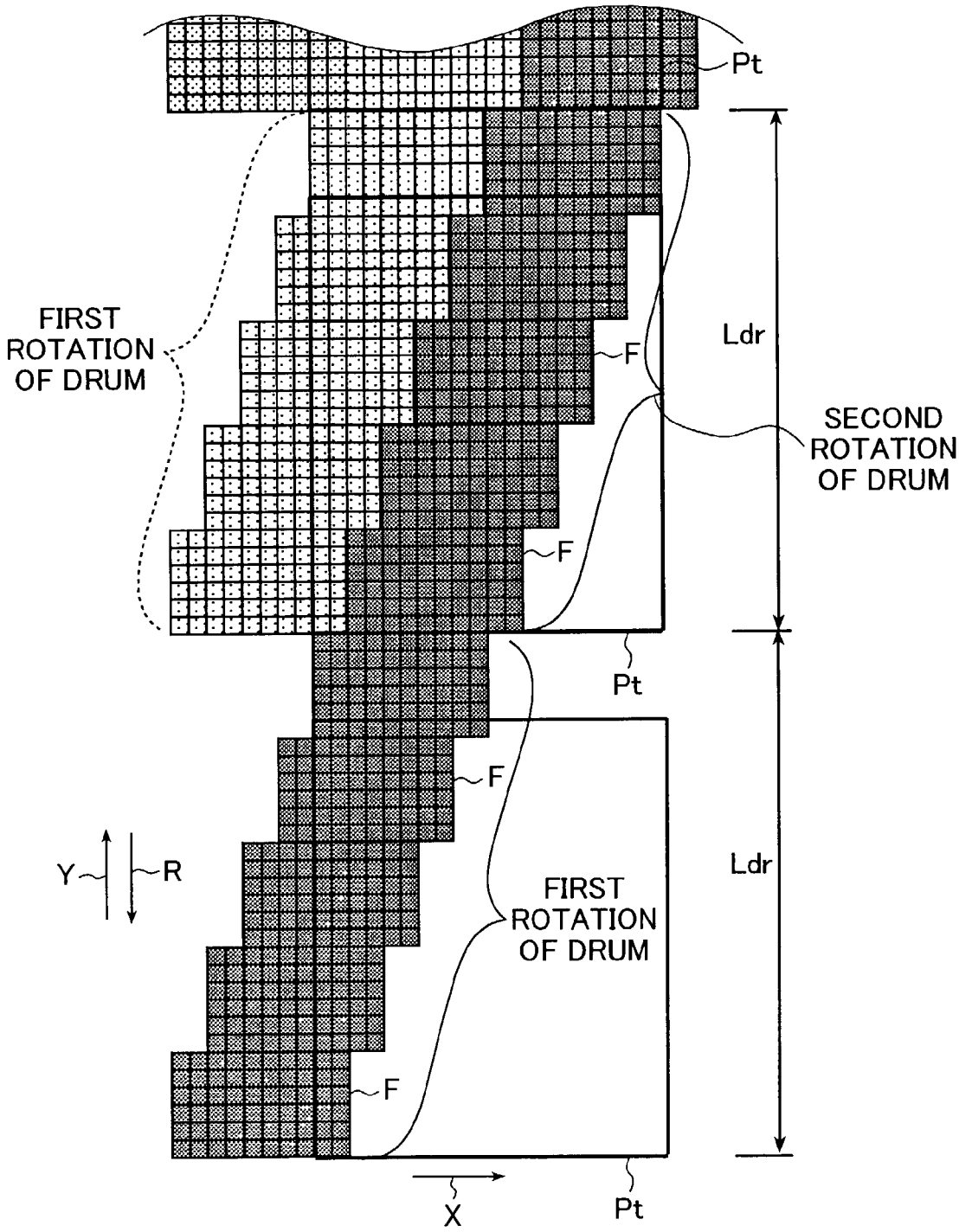
FIG. 3 is a conceptual diagram for illustrating image recording by the image recording apparatus shown in FIG. 1.

As a result, image recording is spirally performed on the recording medium Pt wound around the drum 22 and the frames F are disposed in a step-like manner in the main scanning direction, as shown by the conceptual diagram in FIG. 3 in which the recording medium Pt is spread. Thus, image recording is performed for the entire surface of the recording medium Pt. Note that in FIG. 3, the lower portion shows the recording performed while the drum 22 is making the first rotation and the upper portion shows the recording performed while the drum 22 is making the second rotation. Also, the reference symbol "Ldr" denotes the perimeter of the drum 22. This recording method is described in detail in commonly assigned US 2002-0044265-A1 A (EP 1199880 A2 A).

Here, in the recording apparatus 10 in the illustrated example, as described above, the recording of one frame is performed by having the frame F remain stationary on the recording medium Pt trough the deflection of the projection light of the MMA 12 in the main scanning direction using the light deflector 16 in synchronization with the rotation of the drum 22.

If image recording is performed while successively performing the auxiliary scanning, however, although it is possible to have the frame F remain stationary in the main scanning direction through the deflection by the light deflector 16, the position of the frame F on the recording medium Pt moves in the auxiliary scanning direction and there occurs image blur.

In view of this problem, in the recording apparatus 10, it is preferable that the frame F is made to more suitably remain stationary on the recording medium Pt during the recording of one frame by tilting the deflection direction in the auxiliary scanning direction (direction shown by the arrow X) with reference to the main scanning direction (direction shown by the arrow Y) in accordance with the shifting of the position of the frame F due to the auxiliary scanning.

In this case, it is preferable that the angle of this deflection direction with reference to the main scanning direction (direction shown by the arrow Y) is set so that when the recording of one frame is completed, a frame F to be recorded next is moved in the auxiliary scanning direction by an amount corresponding to an integral multiple of the pixel pitch (pixel pitch on the recording medium Pt) in the auxiliary scanning direction.

It is particularly preferable that when the integral multiple of the pixel pitch is referred to as Ny, the number of pixels of one frame in the main scanning direction is referred to as Nimg−y, the pixel pitch of one frame in the main scanning direction is referred to as Pimg−y, and the pixel pitch of one frame in the auxiliary scanning direction is referred to as Pimg−x, the angle ψ in the deflection direction with reference to the main scanning direction satisfies the following equation.

$$\tan \psi = (Ny \times Pimg\text{-}x)/(Nimg\text{-}y \times Pimg\text{-}y)$$

This image recording method is described in detail in commonly assigned U.S. patent application Ser. No. 10/122,184.

As described above, in the recording apparatus 10, the frame F (projection light of the MMA 12) is made to track the movement of the recording medium Pt and the image recording of one frame is basically performed under a state where the frame F is made to remain stationary on the recording medium Pt for a predetermined recording (exposure) time period.

Here, the recording apparatus 10 in the illustrated example relates to the present invention. As conceptually shown in FIG. 4, the image recording position (that is, the position of the frame F) on the recording medium Pt is shifted (moved) in a direction (direction shown by the arrow V) including both the main and auxiliary components during the recording of one frame, and when a pixel (mirror) of the MMA 12 is placed at a position on the recording medium Pt at which image recording should be performed, the display image by the MMA 12 is modulated so that this pixel is activated in accordance with an image to be recorded by one frame. In other words, in the illustrated example, a relative speed difference is maintained in the movement of the frame F (tracking of the recording medium Pt) in the main scanning and the auxiliary scanning by the recording medium Pt and the optical system for having the frame F remain stationary, that is, between (i) the main scanning and the auxiliary scanning by the optical system and the recording medium Pt and (ii) the movement or tracking by the frame F (tracking of the recording medium Pt) for having the frame F remain stationary. In addition, each pixel of the MMA 12 is modulated in accordance with an image to be recorded.

The present invention uses a construction like this, so that it is possible to change resolution or the like during the image recording that uses two-dimensionally arranged light sources.

Also, in the present invention, during the image recording that uses two-dimensionally arranged light sources, an image is recorded by performing the shifting of the frame F in the manner described above and the activation/deactivation of each pixel is determined using a threshold value set in accordance with the position. As a result, it becomes possible to correct the shading described above and to record an image in which the local fluctuations of an image area ratio are significantly reduced. Accordingly, in the case of a printing use, for instance, it becomes possible to perform the production of a high-quality printing plate or the like in which the locality of a dot area ratio or the like is extremely small.

Also, needless to say, as described above, by performing the image recording where such shifting of the frame F is performed, it becomes possible to change resolution, which has been uniquely determined by the magnification of an optical system in the case of image recording that uses two-dimensionally arranged light sources, as appropriate and to perform image recording at arbitrary resolution.

The operation of the recording apparatus 10 and an example of an image recording method according to the present invention will be described below with reference to FIGS. 5A to 5C, 6A to 6C, and 7D to 7F.

Figure 5A:
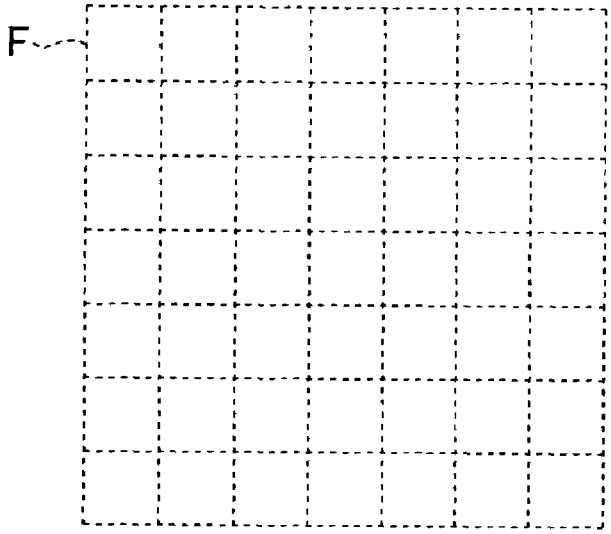
FIG. 5A is a conceptual diagram for illustrating projection light by a micromirror array (MMA)
Figure 5B:
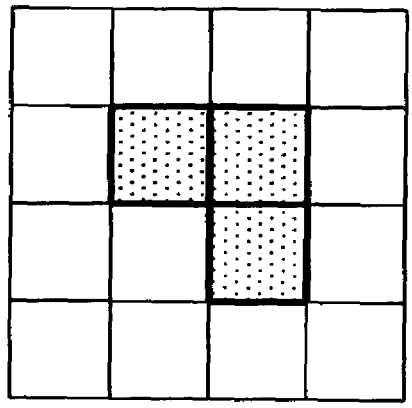
FIG. 5B is a conceptual diagram for illustrating an image to be recorded.
Figure 5C:
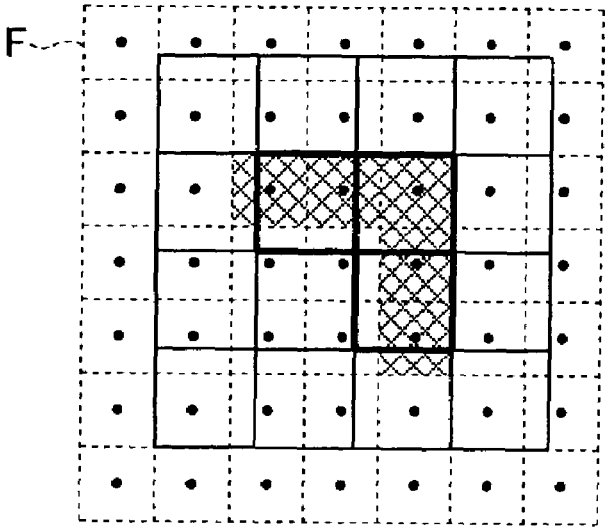
FIG. 5C is a conceptual diagram for illustrating image recording by the present invention.

FIG. 5A conceptually shows a part of the frame F by the MMA 12 on the recording medium Pt, while FIG. 5B conceptually shows an example of resolution of an image to be recorded on the recording medium Pt. In both of these drawings, one square represents one pixel. That is, one pixel (resolution of the MMA 12) of the frame F on the recording medium Pt differs from one pixel (resolution of recording) of a target image. Therefore, the one pixel of the frame F is smaller than the one pixel of the target image and the relation shown in FIG. 5C exists between each pixel of the frame F on the recording medium Pt and an image to be recorded.

In this example, image recording is basically performed by activating each pixel (mirror) of the MMA 12 whose center is contained in the image to be recorded. That is, if the image to be recorded is the image surrounded by a thick line in FIGS. 5B and 5C, for instance, there is activated each cross-hatched pixel of the MMA 12 whose center specified by a dot is contained in an image recording area.

Here, the pixel, whose center is contained in the image recording area, is changed by the shifting of the frame F in a direction including both the main and auxiliary components during the recording of one frame described above. Therefore, in the present invention, by changing (that is, by modulating) the image displayed by the MMA 12 in accordance with the pixel changing, image recording is performed in a manner that is similar to scan exposure.

An example of the recording of the image framed by the thick line in FIG. 5B by a part of the frame F by the MMA 12 (projection light of the MMA 12) shown in FIG. 5A will be described below with reference to FIGS. 6A to 6C, 7D to 7F, and 8G to 8I.

Figure 4:
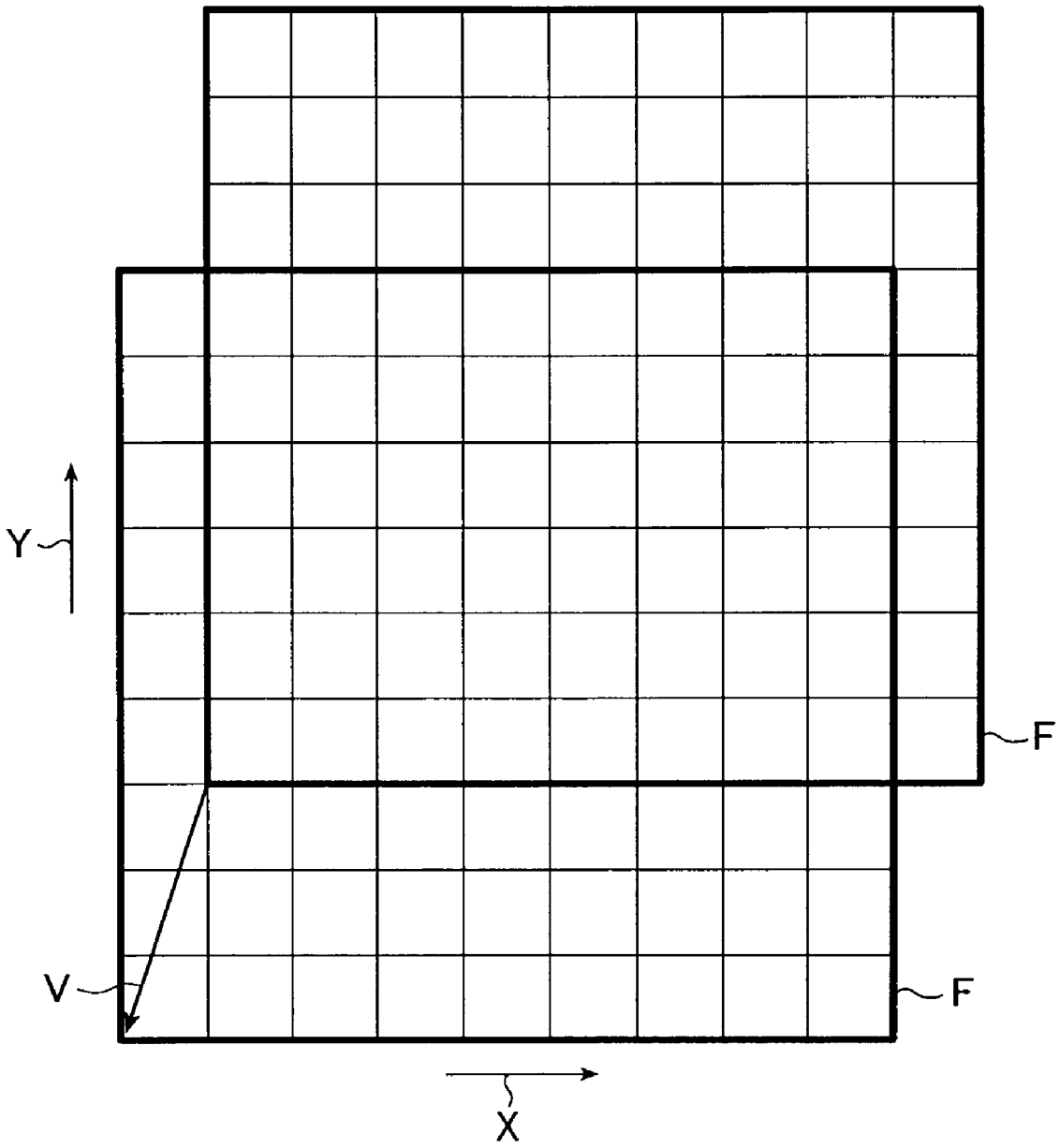
FIG. 4 is a conceptual diagram for illustrating image recording by the present invention.

In this exemplary case, as shown in FIG. 4, the frame F is shifted by an amount corresponding to three pixels in the main scanning direction (direction shown by the arrow Y) and by an amount corresponding to one pixel in the auxiliary scanning direction (direction shown by the arrow X) during the recording of one frame. That is, image recording is performed by shifting the frame F at a ratio of main scanning direction:auxiliary scanning direction=3:1. Note that in this exemplary case, the actual moving direction of the frame F is opposite to the main scanning direction and the auxiliary scanning direction, although the present invention is not limited to this.

Also, during the recording of one frame, the display image of the MMA 12 is changed nine times, that is, modulated nine times through equal time-division of a recording time period (exposure time period).

Figure 6A:
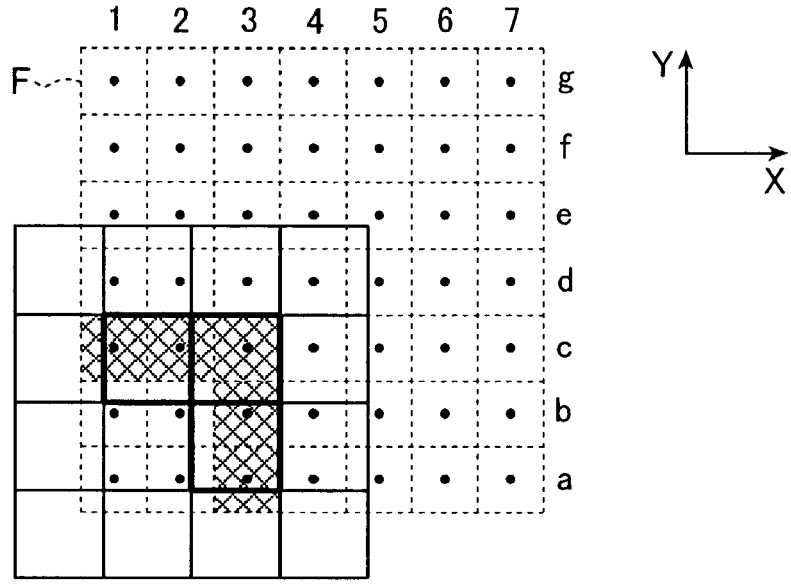
FIGS. 6A to 6C are each a conceptual diagram for illustrating the image recording by the present invention.

As an example, the recording of one frame is started under a state shown in FIG. 6A. Under this state, the recording image area framed by a thick line contains the centers of pixels a-3, b-3, c-1, c-2, and c-3 of the MMA 12, so that image recording is performed by activating these pixels as indicated by cross-hatching.

As described above, the recording medium Pt held by the drum 22 is rotated in a direction opposite to the main scanning direction. Also, the frame F is basically made to track and remain stationary on the recording medium Pt and is shifted in a direction including both the main and auxiliary components at the aforementioned ratio of main scanning direction:auxiliary scanning direction=3:1 through the deflection in the same direction by the light deflector 16.

Figure 6B:
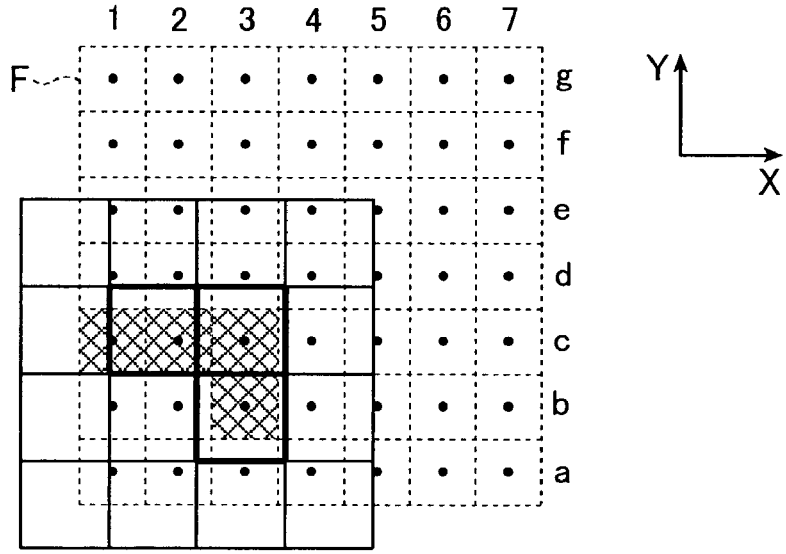

When 1/9 of the recording time period for one frame has passed, that is, when the frame F is shifted by an amount corresponding to 3/9 pixels in the main scanning direction (direction shown by the arrow Y) and by an amount corresponding to 1/9 pixels in the auxiliary scanning direction (direction shown by the arrow X) (this shifting of the frame F will hereinafter simply referred to as the "the shifting of the frame F by a predetermined amount"), the MMA 12 is modulated and the image (projection image) is switched as shown in FIG. 6B. That is, the center of the pixel a-3 contained in the recording image area under the recording start state comes out of the recording image area. As a result, the state shown in FIG. 6A is changed and only this pixel is deactivated.

Figure 6C:
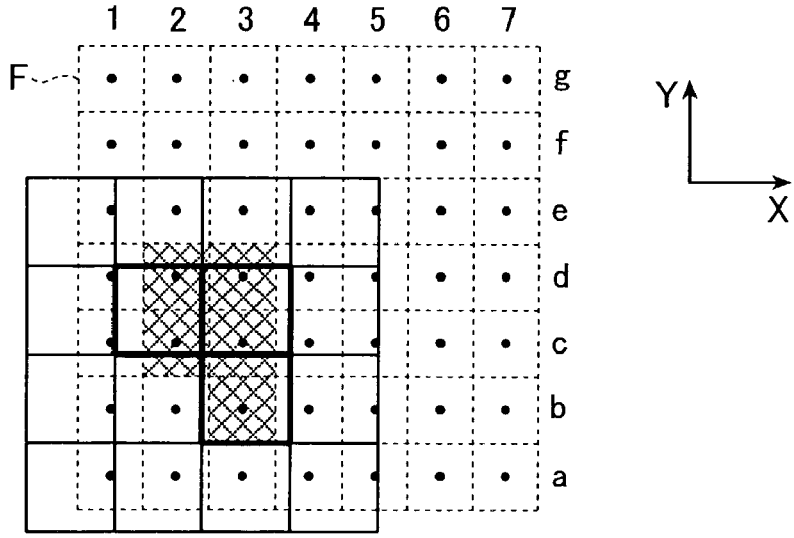

When the frame F is further shifted by the predetermined amount, the MMA 12 is modulated in the manner shown in FIG. 6C. As a result, the pixel c-1, whose center comes out of the recording image area, is deactivated and the pixels d-2 and d-3, whose centers newly enter into the recording image area, are activated.

Figure 7D:
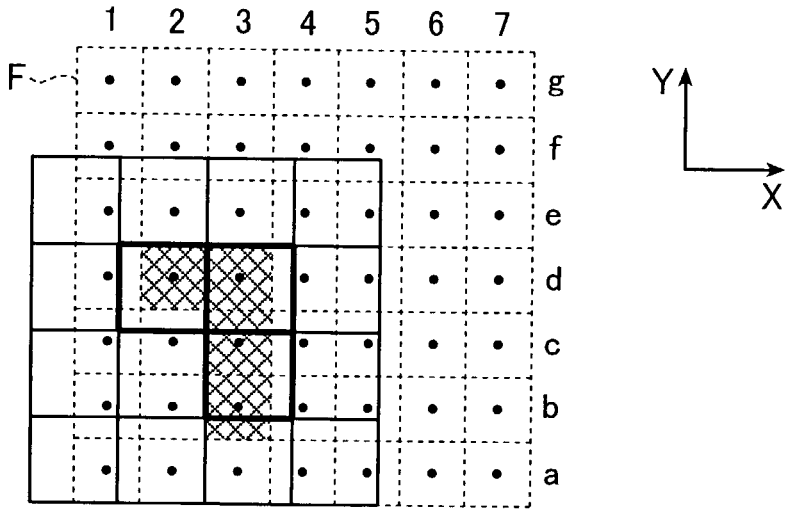
FIGS. 7D to 7F are each a conceptual diagram for illustrating the image recording by the present invention.
Figure 7E:
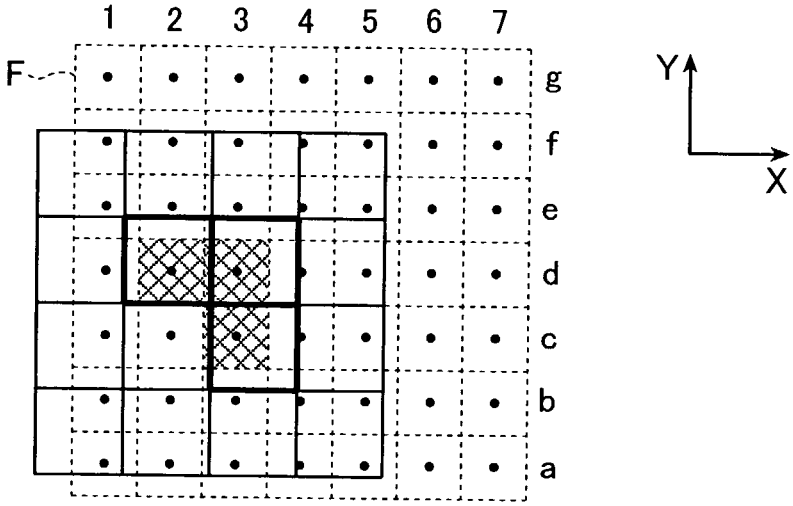
Figure 7F:
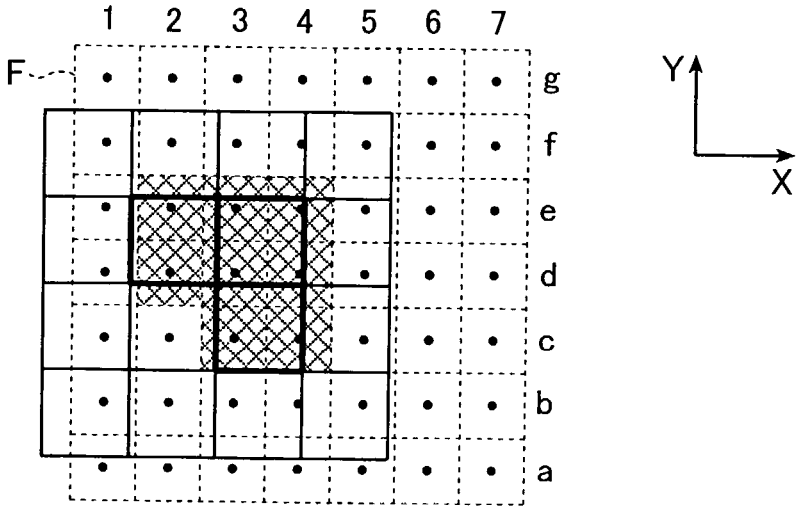

When the frame F is further shifted by the predetermined amount, the MMA 12 is modulated as shown in FIG. 7D and there is deactivated the pixel c-2 whose center comes out of the recording image area.

Hereinafter, in a like manner, as shown in FIGS. 7E to 8I, each time the frame F is shifted by the predetermined amount, the MMA 12 is modulated and image recording is performed by deactivating each pixel, whose center comes out of the recording image area, and activating each pixel whose center enters into the recording image area.

Figure 8G:
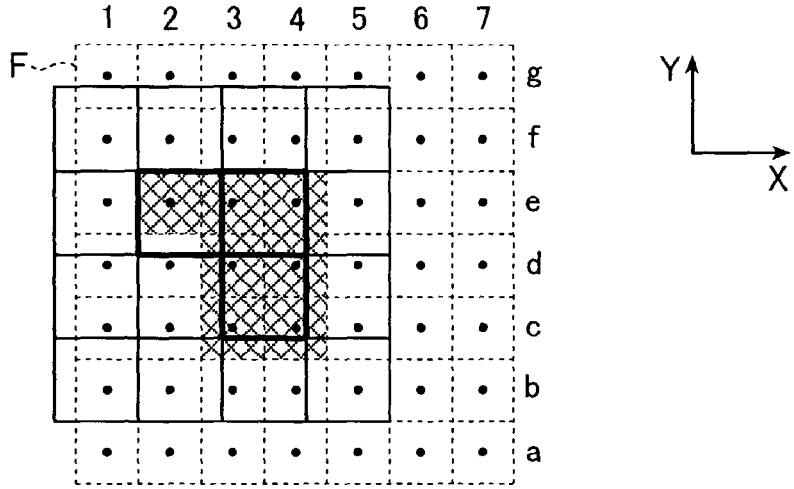
FIGS. 8G to 8I are each a conceptual diagram for illustrating the image recording by the present invention.
Figure 8H:
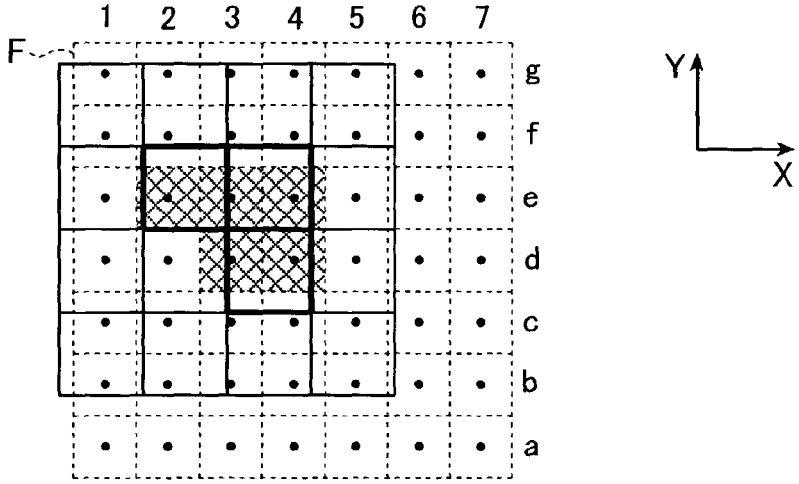
Figure 8I:
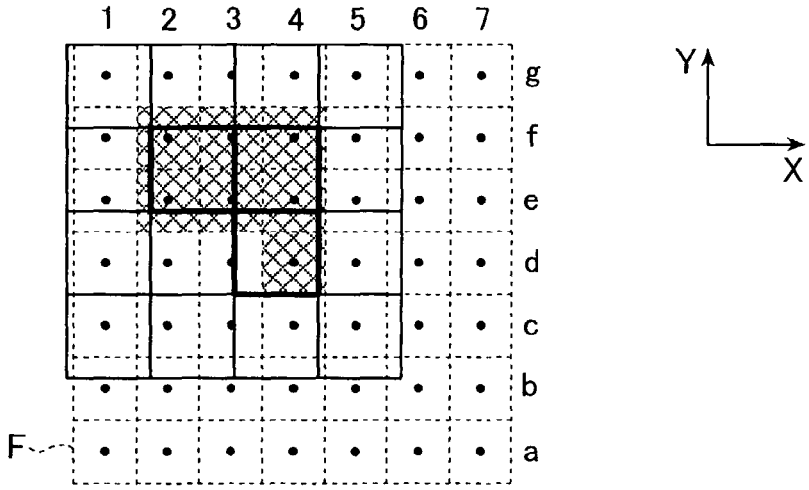
Figure 9:
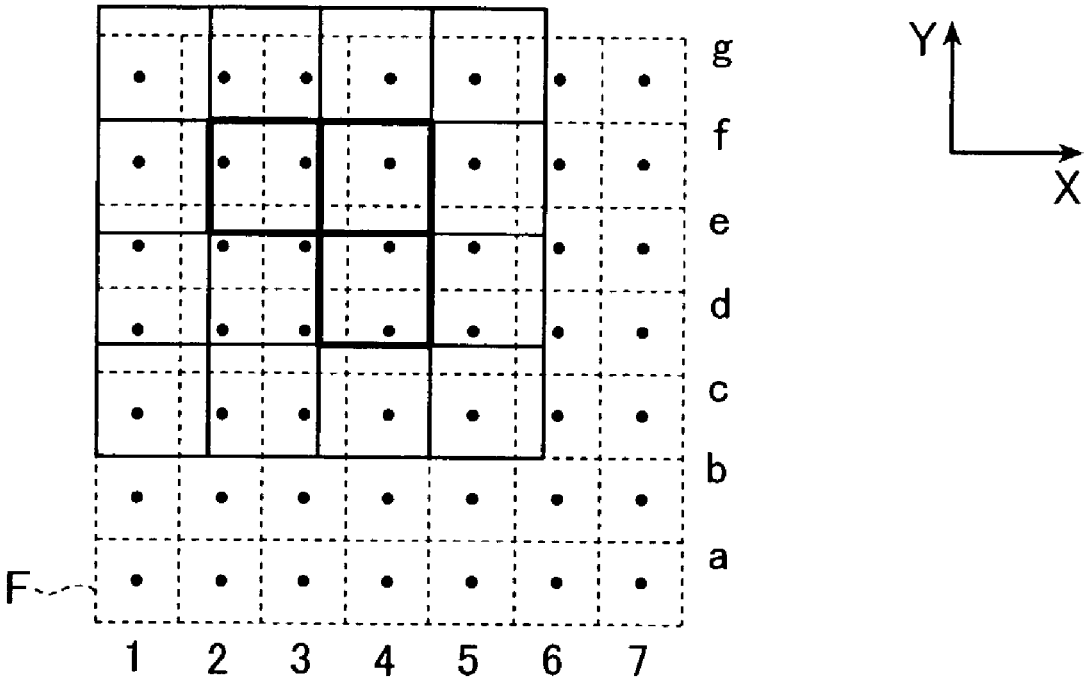
FIG. 9 is a conceptual diagram for illustrating the image recording by the present invention.

Finally, when the frame F is shifted by the predetermined amount and the state shown in FIG. 8I is changed to the state shown in FIG. 9, the frame F is shifted by three pixels in the main scanning direction and by one pixel in the auxiliary scanning direction. That is, the recording of one frame is finished. As a result, all pixels are deactivated. Then, in accordance with the movement of the recording medium Pt (rotation of the drum 22) and the state of the light deflector 16, image recording of the next one frame is started so that the next one frame comes adjacent to the previously recorded frame in the main scanning direction.

That is, during the recording of one frame in FIGS. 6A to 9, recording is performed so that the cross-hatched areas are superimposed on each other in FIGS. 6A to 8I. That is, image recording is performed as conceptually shown in FIG. 10.

Figure 10:
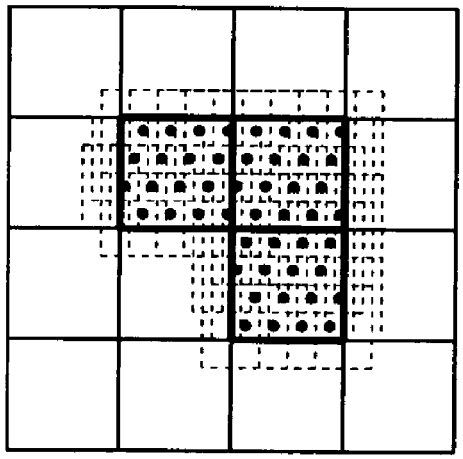
FIG. 10 conceptually shows an image obtained by the image recording performed in FIGS. 6A to 6C, 7D to 7F, 8G to 8I, and 9.

More specifically, as shown in FIG. 10, with the image recording method of the present invention, image recording of a target image to be recorded is also performed for an area where its ideal resolution is exceeded to some extent. However, the recording is concentrated in the image recording area that is a target and the recording (exposure) amount in the projected portion is small, so that there occurs no problem concerning image quality.

Individual features of the image recording methods and the image recording apparatuses according to the first, second, and third embodiments of the present invention will be described below.

Incidentally, during conventional image recording that uses two-dimensionally arranged light sources, the resolution that can be expressed is limited to an integral multiple of one pixel of the two-dimensionally arranged light sources (one pixel of the MMA 12 from which light is projected in the illustrated example). In order to express resolution that is not an integral multiple, it is required to prepare a zoom lens or a plurality of focusing optical systems having different magnifications, as described above.

In contrast to this, as is apparent from the above description, in accordance with the first to third embodiments of the present invention, during image recording that uses two-dimensionally arranged light sources that utilize the MMA 12 and the like, the frame F (projection light from the two-dimensionally arranged light sources) is shifted (moved) in a direction including both the main and auxiliary components and the two-dimensionally arranged light sources are modulated in accordance with an image to be recorded. As a result, it becomes possible to perform image recording that is similar to so-called scan exposure, by using the two-dimensionally arranged light sources.

Consequently, in accordance with the first to third embodiments of the present invention, irrespective of the resolution of the two-dimensionally arranged light sources, each pixel of the two-dimensionally arranged light sources is modulated in accordance with a target image and resolution. As a result, without using a zoom lens or a plurality of kinds of focusing systems, it becomes possible to perform image recording at a plurality of arbitrary resolutions (at three resolutions of 2540 dpi, 2438 dpi, and 2400 dpi, for instance) other than multiples of the two-dimensionally arranged light sources. Also, it becomes possible to adjust resolution, so that even in the case where there exists an error in the focusing optical system or the two-dimensionally arranged light sources, it becomes possible to record an image having predetermined resolution through suitable correction and also to cope with the changing of the size of the recording medium Pt or the like due to a temperature change without difficulty.

In addition, in accordance with the first to third embodiments of the present invention for carrying out scan exposure like this, it becomes possible to significantly reduce the adverse effect of distortion of projection light due to distortion aberration possessed by the focusing optical system and to record a high-quality image free from image quality degradation caused by this distortion.

An example of a method of modulating the MMA 12 (two-dimensionally arranged light sources) during image recording like this performed while shifting the frame F will be described below with reference to FIG. 11. Also, FIG. 12 shows an example of a control block diagram for carrying out this modulation method.

Figure 11:
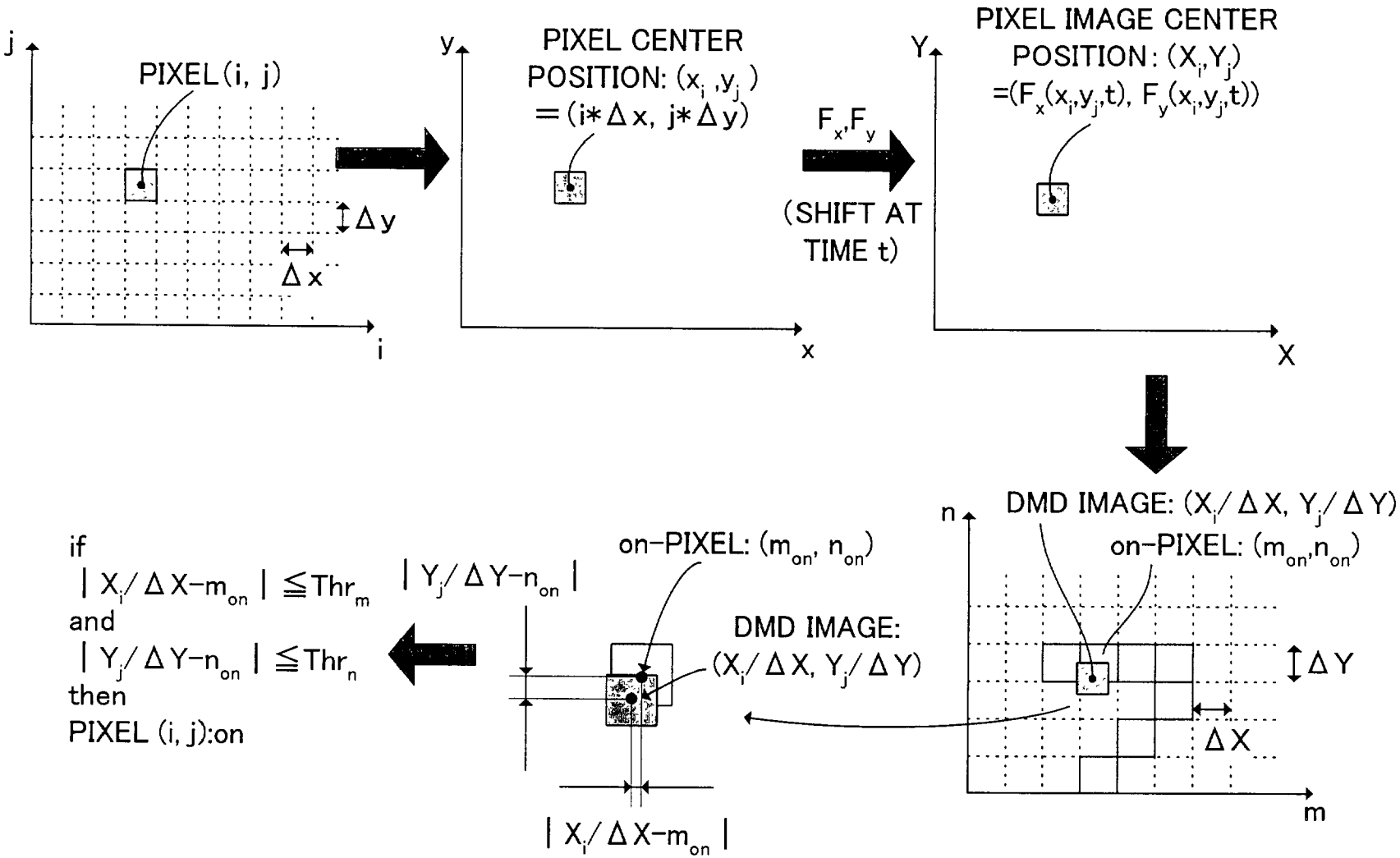
FIG. 11 is a conceptual diagram for illustrating an example of the image recording by the present invention.
Figure 12:
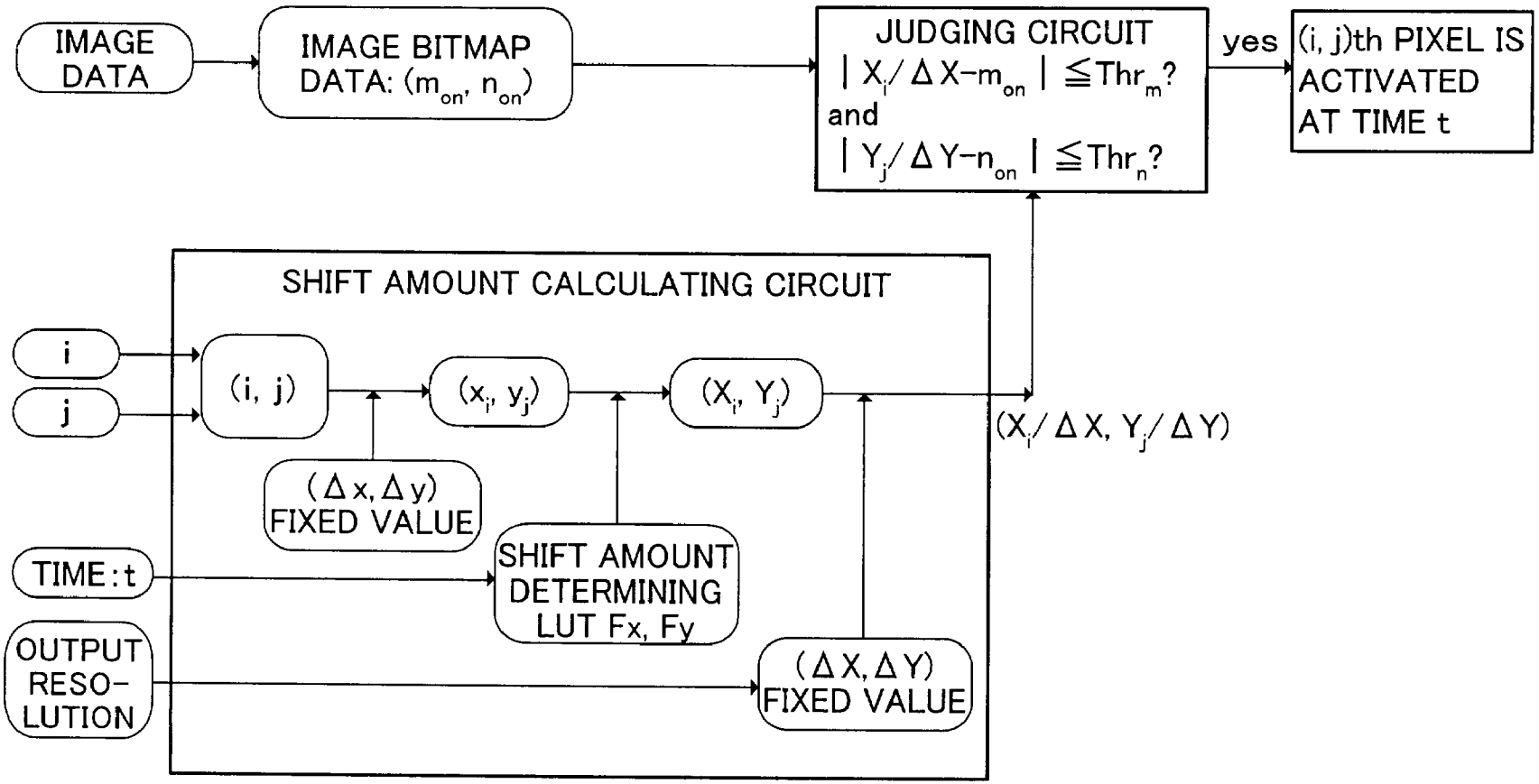
FIG. 12 shows an example of a control block diagram for carrying out the image recording method shown in FIG. 11.

As shown in the upper-left portion in FIG. 11, a pixel that is the ith pixel in one of the pixel array directions of the MMA 12 and is the jth pixel in the other direction thereof is referred to as the "pixel (i, j)". Note that in the illustrated example, "i" corresponds to the auxiliary scanning direction (X direction) and "j" corresponds to the main scanning direction (Y direction). Also, the pixel pitch of this MMA 12 in the main scanning direction is referred to as $\Delta y$ and the pixel pitch thereof in the auxiliary scanning direction is referred to as $\Delta x$.

Accordingly, it is possible to obtain the center position ($x_i$, $y_j$) of this pixel (i, j) from ($i*\Delta x$, $j*\Delta y$).

Here, a function expressing a shift amount in the auxiliary scanning direction is referred to as Fx and a function expressing a shift amount in the main scanning direction is referred to as Fy. In this case, the location of the center position ($x_i$, $y_j$) of the aforementioned pixel (i, j) of the MMA 12 on the projection image at a time "t" during the recording of one frame can be expressed as "($Fx(x_i, y_j, t)$, $Fy(x_i, y_j, t)$)". In the following description, this position will be referred to as the (pixel) image center position ($x_i$, $y_j$).

In the block diagram shown in FIG. 12, the image center position ($X_i$, $Y_j$) is obtained using a shift amount determining LUT (lookup table) corresponding to these functions Fx and Fy.

It should be noted here that these functions Fx and Fy (determining LUT) may be set in consideration of the distortion aberration in the focusing lens 18 and the like as well as the shift amount. By doing so, during the image recording that uses two-dimensionally arranged light sources, it becomes possible to correct the aberration in the lens and to perform resolution conversion through the shifting of the frame.

On the other hand, the pixel pitch in the main scanning direction and the pixel pitch in the auxiliary scanning direction at the output resolution of an image to be recorded are respectively referred to as $\Delta Y$ and $\Delta X$.

As described above, the center position ($x_i$, $y_j$) of the pixel (i, j) of the MMA 12 becomes an image center position ($X_i$, $Y_j$) on the projection image. Accordingly, by dividing the image center position by the pixel pitches, it becomes possible to know at which pixel on a bitmap of an image to be recorded the image center position is positioned. In the case where (round[($X_i/\Delta X$)], round[($Y_j/\Delta Y$)]) corresponds to an on-pixel ($m_{on}$, $n_{on}$) on the image bitmap of an image to be recorded, it is possible to perform the image recording in the example illustrated in FIGS. 6A to 9 by modulating the MMA 12 so that the pixel (i, j) is activated. Note that in the equation described above, "round" means the rounding-off of a number. Note that in the case where a number is converted into an integer by dropping off the decimal fractions of the number, it is sufficient to obtain (int[($X_i/\Delta X$)+0.5], int[($Y_j/\Delta Y$)+0.5]). Also, in this exemplary case, on the image bitmap, "m" corresponds to the auxiliary scanning direction and "n" corresponds to the main scanning direction.

Here, during the image recording performed by the recording apparatus 10 using the two-dimensionally arranged light sources, there occurs shading due to a variation in the projection image size of each pixel, a variation in light intensity, a position error, and the like. In the case of a printed material, for instance, the shading becomes a variation in reproduced dot % (positional locality of the area ratio), which becomes a problem concerning image quality. Therefore, it is required to perform correction of this shading.

In usual cases, the correction of shading is carried out through the correction of light intensity of each pixel. However, with the recording method of the present invention that performs recording by shifting the frame F, it becomes possible to correct the shading through direct correction of an area ratio instead of the intensity correction.

The absolute value of the difference between (i) a position ($X_i/\Delta X$, $Y_j/\Delta Y$) (hereinafter referred to as the "MMA image") obtained by dividing the aforementioned image center position by the pixel pitches and (ii) the on-pixel ($m_{on}$, $n_{on}$) on the image bitmap in a corresponding direction indicates a deviation of the center position of the MMA image from the center position of the on-pixel.

Accordingly, this absolute value is compared with threshold values Thr (positive numbers) set as appropriate so as to respectively correspond to the main scanning and the auxiliary scanning. In the case where the absolute values in both of the main scanning direction and the auxiliary scanning direction are equal to or lower than the threshold values Thr, modulation is controlled so that the pixel (i, j) of the MMA 12 is turned on. By doing so, it becomes possible to control the area ratio of an image to be recorded. That is, in the case where the following conditions are both satisfied, it becomes possible to control the area ratio of an image to be recorded, by controlling modulation so that the pixel (i, j) of the MMA 12 is turned on.

$$|(X_i/\Delta X)-m_{on}|\leqq \mathrm{Thr}_m$$

$$|(Y_j/\Delta Y)-n_{on}|\leqq \mathrm{Thr}_n$$

The threshold values may be determined as appropriate in accordance with the shading possessed by the optical system.

For instance, in the case of $\mathrm{Thr}_m=\mathrm{Thr}_n=0.5$, there is performed standard image recording where the aforementioned correction is not performed. That is, in the case where the MMA image ($X_i/\Delta X$, $Y_j/\Delta Y$) exists within the on-pixel ($m_{on}$, $n_{on}$) of the image bitmap, the pixel (i, j) of the MMA 12 is turned on.

On the other hand, in the case of $\mathrm{Thr}_m=\mathrm{Thr}_n=0.6$, even if the MMA image comes out of the on-pixel of the image bitmap by an amount corresponding to 0.1 pixel, the pixel is turned on. As a result, the area ratio is increased.

Conversely, in the case of $\mathrm{Thr}_m=\mathrm{Thr}_n=0.4$, if the MMA image does not exist within an area that is smaller than the on-pixel of the image bitmap by an amount corresponding to 0.1 pixel, the pixel is not turned on. As a result, the area ratio is reduced.

Further, in the case where $\mathrm{Thr}_m$ and $\mathrm{Thr}_n$ are set at different values, it is possible to control the area ratio with reference to the main scanning direction and the auxiliary scanning direction (vertical and horizontal directions of an image).

In the first embodiment of the present invention, such a shift direction and a shift amount of the frame F during the recording of one frame are basically determined as appropriate in accordance with the magnification for changing the resolution per pixel of the MMA 12 that is the target. Note that in the recording apparatus 10, it does not matter whether the shift direction and the shift amount are fixed, are variable, or can be set as appropriate.

It is preferable that when the shifting of the frame F is performed in units of pixels (pixel pitch) of the MMA 12 (two-dimensionally arranged light sources), one of pixel array directions of the MMA 12 is set as the A direction, the other of the pixel array directions is set as the B direction, the magnification (division number) for changing the resolution in the A direction corresponding to a target magnification for changing the resolution is referred to as "a", and the magnification (division number) for changing the resolution in the B direction is referred to as "b", the frame F is shifted by "b" pixels in the A direction and by "a" pixels in the B direction during the recording of one frame and modulation is performed "a×b" times through equal time-division.

It is further preferable that the shift pixel numbers in the A direction and the B direction are set at 1 for one of the directions and set as an integer equal to or larger than 2 for the other direction, or are both set as integers that are equal to or larger than 1 and are prime to each other.

Figure 13A:
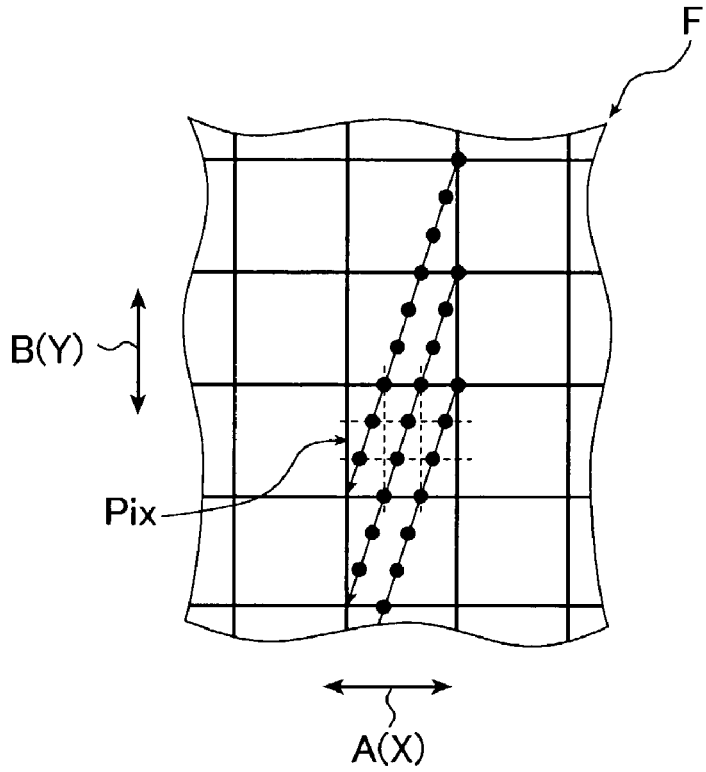
FIGS. 13A and 13B each conceptually show the image recording in FIGS. 6A to 6C, 7D to 7F, 8G to 8I, and 9.

FIG. 13A conceptually shows the movement of each pixel (mirror) of the MMA 12 on the recording medium Pt during the image recording in the first embodiment of the present invention shown in FIGS. 6 to 9 described above.

It should be noted here that in the recording apparatus 10 in the illustrated example, as a preferable embodiment, the two-dimensional pixel array directions of the MMA 12 coincide with the main scanning direction (direction shown by the arrow Y) and the auxiliary scanning direction (direction shown by the arrow X). However, in the present invention, there is imposed no specific limitation as to which of the A direction and the B direction should be which of the main scanning direction and the auxiliary scanning direction. Note that in the present invention, it is not required that the A direction and the B direction coincide with the main scanning direction and the auxiliary scanning direction.

In the following description, for ease of explanation, the auxiliary scanning direction coincides with the A direction, the main scanning direction coincides with the B direction, and the first modulation operation is performed when there is started the shifting (when the recording of each frame F is started).

As described above, in this example, during the recording of one frame, the frame F is shifted at a ratio of A direction:B direction=one pixel:three pixels and modulation is performed nine times through equal time-division. As a result, each pixel of the MMA 12 is moved as indicated by the arrows and modulation is performed at each position specified by a dot.

Here, directing attention to a pixel position Pix of one pixel indicated by an arrow (position of one pixel on the projection image of the MMA 12 when the shifting for the recording of one frame is started), when viewed in the B direction, three pixels enter in the A direction from an end portion with reference to the B direction at regular intervals and advance to an end portion on the opposite side during the image recording of one frame. Then, each pixel is modulated three times at regular intervals, that is, under a state where their phases in the B direction (positions in the B direction) are aligned.

That is, in this example, the A direction is divided in three (resolution is tripled) by three pixels and the B direction is divided in three (resolution is tripled) by the modulation of respective pixels whose phases are aligned. As a result, as indicated by the dotted lines, there is obtained a state where the pixel position Pix is divided in 3×3=9. The image recording for nine pixels is performed by performing modulation for each pixel. Accordingly, there is obtained a result that image recording is performed at resolution that is nine times as high as the resolution of the MMA 12.

Accordingly, by preventing a situation where the courses of respective pixels overlap each other, this division number of one pixel (=magnification for changing the resolution per pixel) and the state of the division (division number in each of the A direction and the B direction) are set as appropriate in accordance with target resolution of an image or the like. By doing so, during the image recording that uses two-dimensionally arranged light sources, it becomes possible to suitably perform image recording where there is performed the resolution conversion shown in FIGS. 5A to 10.

Here, according to the investigation made by the inventors of the present invention, during the image recoding in the first embodiment of the present invention in which recording is performed while shifting the frame F, in the case where there exists a direction like the B direction in FIG. 13A whose shift pixel number coincides with the division number in the other direction (A direction), when viewed in this direction (hereinafter referred to as the "B direction" in conformance with FIG. 13A for ease of explanation), pixels whose number is equal to the shift pixel number in the B direction, advance at the aforementioned pixel position Pix in the A direction at regular intervals. That is, during this operation, the division number "a" in the A direction that is the other direction coincides with the shift pixel number in the B direction.

Also, as described above, the division number "b" in the B direction becomes the number of times of modulation performed at the pixel position Pix. Accordingly, when the number of times of modulation during the recording of one frame is divided by the shift pixel number in the B direction, the division result becomes the division number "b" in the B direction. Conversely, it is possible to determine the number of times of modulation during the recording of one frame from the division number "b" in the B direction and the shift pixel number. Here, as described above, during this operation, the shift pixel number in the B direction is equal to the division number "a" in the A direction.

That is, the division numbers "a" and "b" at the pixel position Pix are determined in accordance with target resolution, the shift pixel number in one direction is made to coincide with the division number in the other direction, and modulation is performed a×b times (multiplication of the division number "a" in the A direction by the division number "b" in the B direction). As a result, it becomes possible to divide the pixel position Pix into a target number and to realize the changing to target resolution.

Further, by setting the shift pixel numbers in the A direction and the B direction at 1 in one direction and as an integer equal to or larger than 2 in the other direction, or by setting the shift pixel numbers as integers that are equal to or larger than 1 and are prime to each other, it becomes possible to perform the shifting of the frame F while preventing a situation where the courses of respective pixels overlap each other.

Accordingly, by utilizing this, it becomes possible to arbitrarily divide one pixel and to perform the changing to target resolution per pixel.

More detailed description is given below with reference to FIGS. 14A to 14C.

Figure 14A:
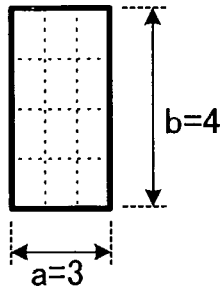
FIG. 14A is a conceptual diagram of one pixel for illustrating the image recording of the present invention.
Figure 14B:
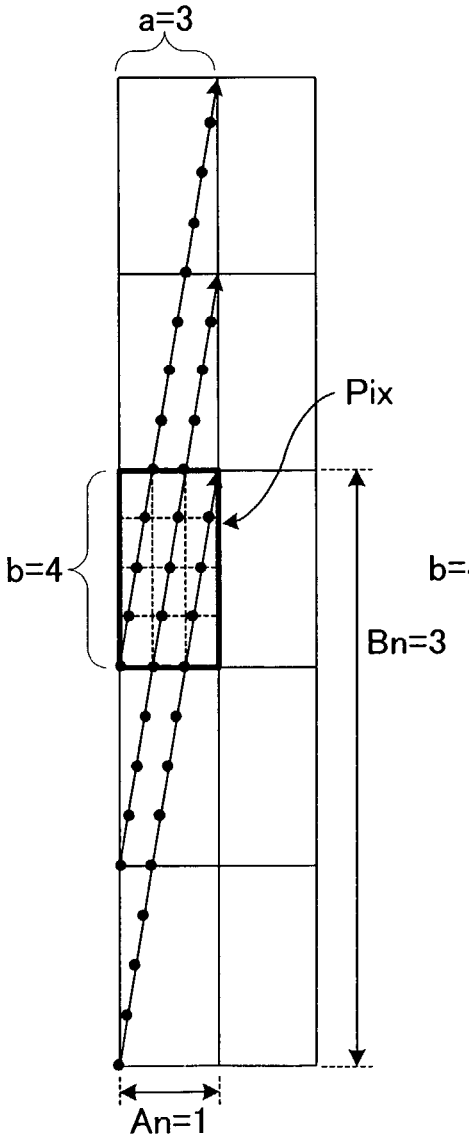
FIGS. 14B and 14C are each a conceptual diagram for illustrating an example of the image recording in the present invention.
Figure 14C:
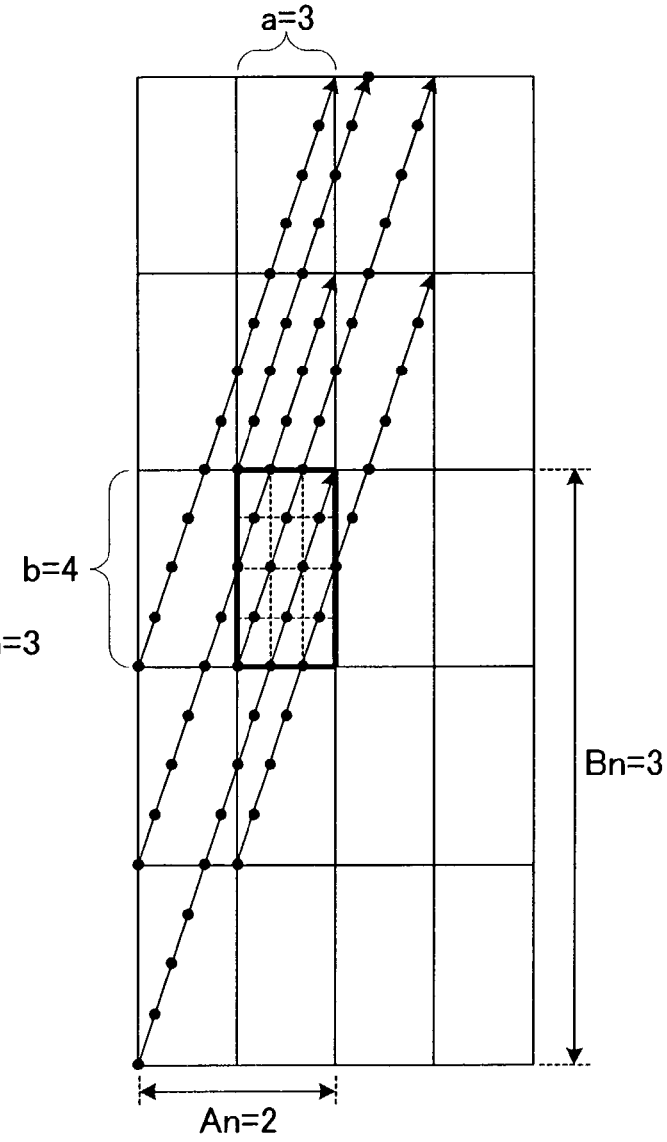

It should be noted here that in FIGS. 14A to 14C, the shift direction is the upward direction that is opposite to the direction in the example described above. However, as is apparent from an observation made by inverting it upside down or the like, there exists no difference in operation and effect between these cases. Also, in FIGS. 14A to 14C, the shift direction is the rightward direction, although as is apparent from an observation made by reversing the front and underside of the drawing, there is obtained completely the same operation and effect even if the shift direction is the rightward direction.

Further, the pixel pitch in the A direction differs from the pixel pitch in the B direction (pixels are anisotropic) in FIGS. 14A to 14C. However, there is obtained completely the same operation and effect even if the pixels are isotropic like in the case described above.

In the example shown in FIGS. 14A to 14C, in the MMA 12 (two-dimensionally arranged light sources) having the pixels (projection image) shown in FIG. 14A, one pixel is divided into three pixels (a=3) in the A direction and is divided into four pixels (b=4) in the B direction (thus divided into 12 pixels in total), that is, image recording is performed at resolution that is 12 times as high as the resolution of the MMA 12 (the resolution in the A direction is tripled and the resolution in the B direction is enhanced four-fold).

Accordingly, during the recording of one frame, if the shifting of the frame F is performed by setting the shift pixel number (An) in the A direction at four pixels and by setting the shift pixel number (Bn) in the B direction at three pixels and modulation is performed by setting the number of times of modulation (Mn) at a×b=3×4=12 through equal time-division, it becomes possible to realize the target division in A direction×B direction=3×4=12.

In the example shown in FIG. 14B, the shift pixel number Bn in the B direction is set at three pixels, which number is the same as the division number "a" in the A direction and the shift pixel number An in the A direction is set at one pixel.

When attention is given to the pixel position Pix, in the B direction whose shift pixel number coincides with the division number (a=3) in the A direction, three pixels advance in the A direction at regular intervals, so that the pixel position Pix is divided in three in the A direction.

On the other hand, in order to divide the pixel position Pix in four in the B direction, modulation need only be performed four times for one pixel. Therefore, in this example where the shift pixel number Bn in the B direction is three, the number of times of modulation Mn becomes 4×Bn=4×3=12. Here, as described above, the shift pixel number Bn in the B direction is equal to the division number "a" in the A direction (Bn=a). Accordingly, the number of times of modulation Mn need only be set at a number obtained by multiplying the division number in the A direction for one pixel by the division number in the B direction for one pixel (Mn=b×Bn=a×b).

By doing so, it becomes possible to realize the division of the pixel position Pix in 12 (A direction×B direction=3×4), as indicated by the dotted lines.

FIG. 14C shows an example where the shift pixel number Bn in the B direction is set at three that is the same as the division number "a" in the A direction, like in the example described above. However, the shift pixel number An in the A direction is set at two pixels.

The shift pixel number in the B direction coincides with the division number in the A direction (Bn=3=a) like in the example described above, and the number of times of modulation performed during the recoding of one frame is a×b=12.

Here, when attention is given to the pixel position Pix, the pixel on the right side in FIG. 14C, out of three pixels advancing in the B direction, comes out of the recording position Pix midway through the shifting. However, another pixel enters into the pixel position Pix from the same position on the left side in the B direction and is modulated under a state where its phase is aligned with those of other pixels. Accordingly, in this example, three pixels spaced at regular intervals in the A direction advance in the B direction at all times and there is obtained the same effect as in the case where there is performed division in three in the A direction. Consequently, the pixel position Pix is divided in A direction×B direction=3×4=12.

Figure 15A:
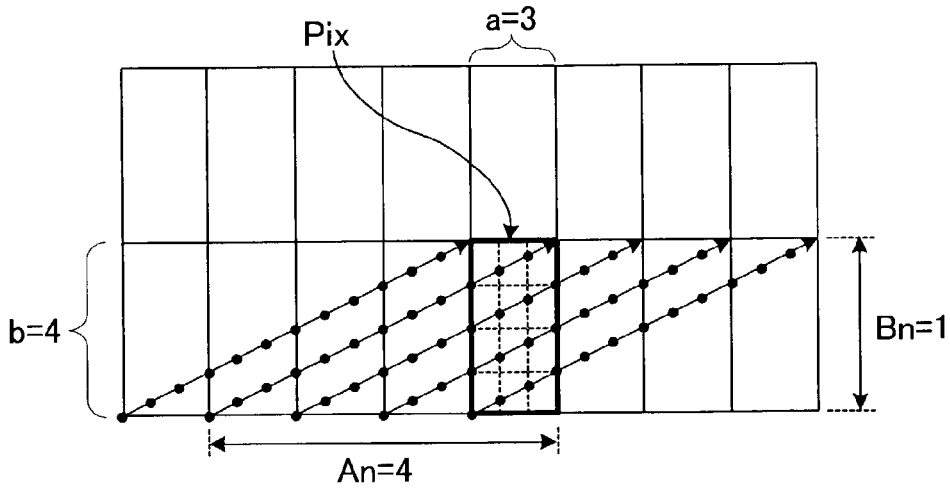
FIGS. 15A and 15B are each a conceptual diagram for illustrating another example of the image recording in the present invention.

In the example shown in FIG. 15A, the shift pixel number An in the A direction is set at four that is the same as the division number b in the B direction and the shift pixel number Bn in the B direction is set at one. Also, the number of times of modulation is set at 12 in a like manner.

In this example, the shift pixel number An in the A direction and the division number b in the B direction are both set at four and are the same, so that the pixel position Pix is divided in four in the B direction by pixels advancing in the A direction. Also, modulation of four pixels whose phases are aligned in the A direction is performed three times, so that the pixel position Pix is divided in three in the A direction. As a result, like in each example described above, the pixel position Pix is divided in A direction×B direction=3×4=12.

Figure 15B:
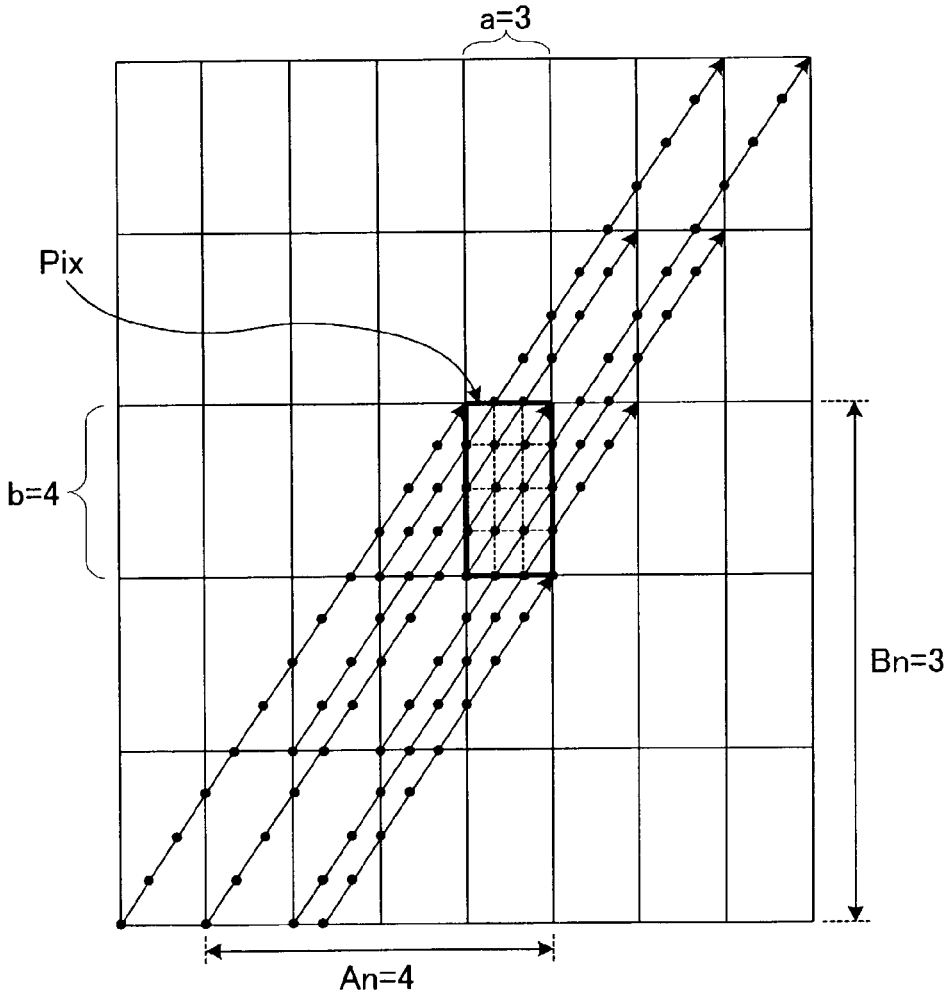

In the example shown in FIG. 15B, in a like manner, the shift pixel number An in the A direction is set at four that is the same as the division number b in the B direction and the shift pixel number Bn in the B direction is set at three that is the same as the division number a in the A direction. Also, the number of times of modulation is 12 in a like manner.

In this example, the shift pixel number in each of the A direction and the B direction coincides with the division number in the other direction, so that when viewed in the A direction, the pixel position Pix is divided in four in the B direction by pixels advancing in the A direction. Also, in this example, each pixel advancing in the A direction comes out of the recording position Pix midway through the shifting. However, another pixel enters thereinto in a synchronous manner as in the example shown in FIG. 14C described above. Therefore, four pixels spaced at regular intervals advance in the A direction at all times and there is obtained the same effect as in the case where the recording position Pix is divided in four in the B direction.

Also, modulation of four pixels whose phases are aligned in the A direction is performed three times, so that the pixel position is divided in three in the A direction. As a result, like in each example described above, the pixel position Pix is divided in A direction×B direction=3×4=12.

Figure 16:
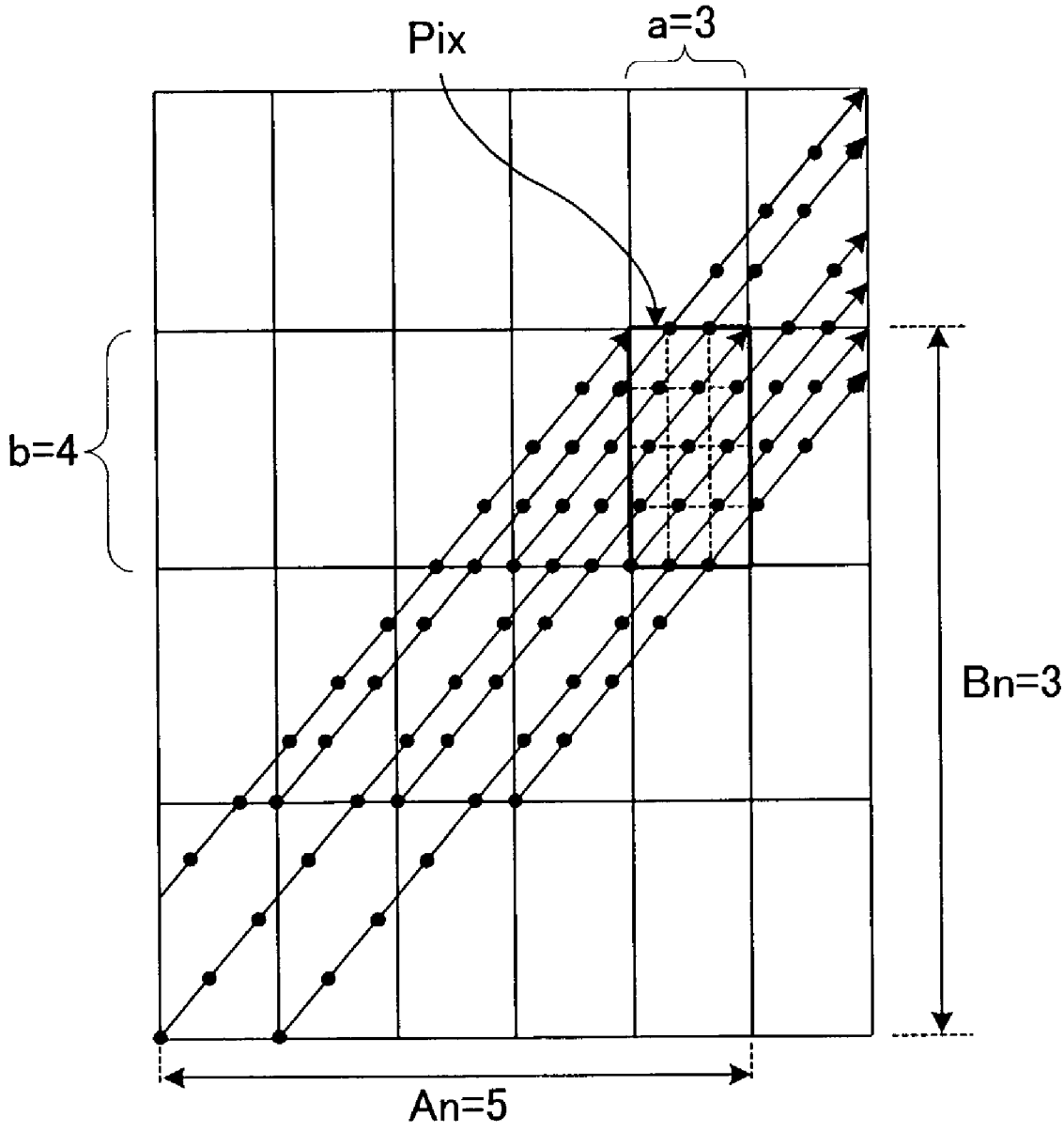
FIG. 16 is a conceptual diagram for illustrating still another example of the image recording in the present invention.

In the example shown in FIG. 16, the shift pixel number Bn in the B direction and the division number a in the A direction are set at the same number that is three and the shift pixel number An in the A direction is set at five. Also, the number of times of modulation is set at 12 in a like manner.

In this example, the shift pixel number Bn in the B direction is three and coincides with the division number a in the A direction, so that the pixel position Pix is divided in three in the A direction by pixels advancing in the B direction in a like manner. Also, in this example, each pixel advancing in the B direction comes out of the recording position Pix midway through the shifting but another pixel enters thereinto in a synchronous manner like in the example shown in FIG. 14C described above. Therefore, three pixels spaced at regular intervals in the A direction advance in the B direction at all times and there is obtained the same effect as in the case where the recording position Pix is divided in three in the A direction.

Also, modulation is performed four times for each of three pixels whose phases are aligned in the B direction, so that the pixel position is divided in four in the B direction. As a result, like in each example described above, the pixel position Pix is divided in A direction×B direction=3×4=12.

Here, in the first embodiment of the present invention, like in the example shown in FIG. 15B, the shift pixel number An in the A direction is set so as to be equal to the division number b in the B direction and the shift pixel number Bn in the B direction is set so as to be equal to the division number a in the A direction. By doing so, it becomes possible to form a square by aligning the modulation positions in one pixel, that is, the phases for modulation of each pixel in the A direction and the B direction during the recording of one frame. As a result, it becomes possible to change (improve) resolution in both the A direction and the B direction in a uniform manner. In many cases, this is advantageous from the viewpoint of image quality.

Figure 17A:
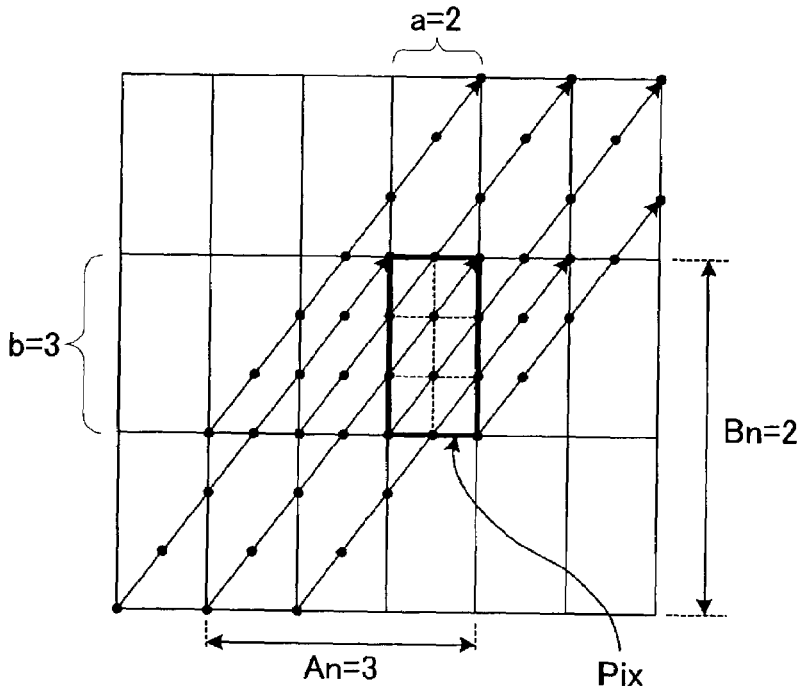
FIGS. 17A and 17B are each a conceptual diagram for illustrating another example of the image recording in the present invention.
Figure 17B:
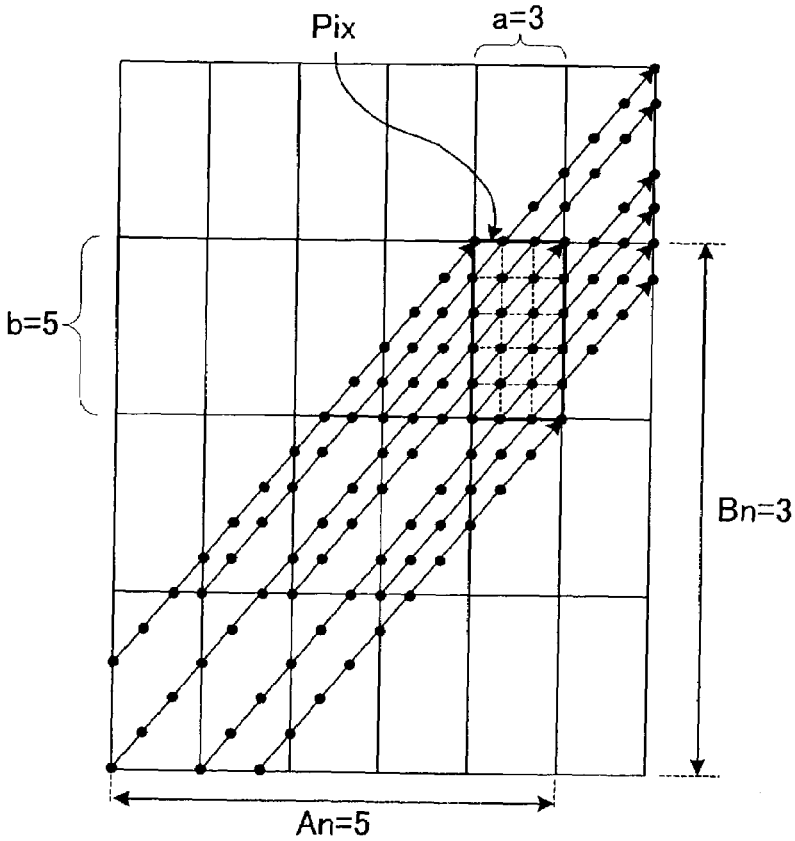

Other examples are shown in FIGS. 17A and 17B.

FIG. 17A shows an example where one pixel is divided in two (a=2) in the A direction and is divided in three (b=3) in the B direction. That is, in this example, one pixel is divided in six in total. The shift pixel number An in the A direction is set at three that is the same as the division number b in the B direction and the shift pixel number Bn in the B direction is set at two that is the same as the division number a in the A direction. Further, the number of times of modulation Mn is set at 2×3=6.

When attention is given to the pixel position Pix, like in the case described above, when viewed in the A direction, the pixel position Pix is divided in three in the B direction by pixels advancing in the A direction and is divided in two in the A direction by performing modulation, during which phases are aligned, two times. As a result, the pixel position Pix is divided in A direction×B direction=2×3=6.

Also, the shift pixel number An in the A direction and the division number b in the B direction are both three and are equal to each other and the shift pixel number Bn in the B direction and the division number a in the A direction are both two and are equal to each other, so that the phases of modulation in the A direction and the B direction are aligned in a square form.

Further, in the example shown in FIG. 17B, one pixel is divided in three (a=3) in the A direction and is divided in five (b=5) in the B direction. That is, one pixel is divided in 15 in total. The shift pixel number An in the A direction is set at five that is the same as the division number in the B direction and the shift pixel number Bn in the B direction is set at three that is the same as the division number in the A direction. Therefore, the number of times of modulation Mn is set at 3×5=15.

Like in the example described above, when viewed in the A direction, the pixel position Pix is divided in five in the B direction by pixels advancing in the A direction and is divided in three in the A direction by performing modulation, during which phases are aligned, three times. As a result, the pixel position Pix is divided in A direction×B direction=3×5=15.

Also, the shift pixel number An in the A direction and the division number b in the B direction are both five and are equal to each other and the shift pixel number Bn in the B direction and the division number a in the A direction are both three and are equal to each other, so that the phases of modulation in the A direction and the B direction are aligned.

It should be noted here that the description of FIGS. 17A and 17B has been made by viewing the pixel position Pix in the A direction. However, in this example where the shift pixel number in each direction coincides with the division number in the other direction, the same result is obtained even if conversely viewed in the B direction.

As is apparent from the above description, during the image recording that uses the MMA 12 (two-dimensionally arranged light sources), in accordance with the division numbers a and b of one target pixel (magnification for changing the resolution), by setting the shift pixel number Bn in the B direction as to be equal to a or setting the shift pixel number An in the A direction so as to be equal to b, by setting the number of times of modulation Mn as a×b, and further by shifting the frame F under a state where one of An and Bn is 1 and the other is an integer equal to or larger than 2 or An and Bn are integers that are prime to each other, it becomes possible to suitably perform image recording in which the recording resolution of the MMA 12 is efficiently enhanced and the resolution conversion shown in FIGS. 5A to 10 described above is performed.

In the first embodiment of the present invention, as described above, during the recording of one frame, the frame F (projection light) is shifted (moved) in a direction including both the components of the A direction and the B direction. This makes it possible to realize image recording at arbitrary resolution, which has conventionally been impossible during image recording that uses two-dimensionally arranged light sources.

There is imposed no specific limitation on the method of shifting the frame F on the recording medium Pt and it is possible to use various kinds of methods. For instance, it is possible to use a method that uses the light deflector 12, a method with which a speed difference is imparted between the main scanning speed (peripheral speed of the drum 22) and the tracking for having the frame F remain stationary, a method with which a difference is imparted between the auxiliary scanning speed and the tracking speed in the auxiliary scanning direction by the light deflector, a method with which the recording medium Pt (drum 22 in the illustrated example) is moved, a method with which the optical system is moved, a method with which these methods are combined with each other, or the like.

On the other hand, in the second embodiment of the present invention, as described above, during the recording of one frame by having the frame remain stationary on the recording medium Pt through the tracking, by shifting the frame F in the direction including both the main and auxiliary components, it becomes possible to perform image recording where the resolution of the MMA 12 is converted.

Figure 13B:
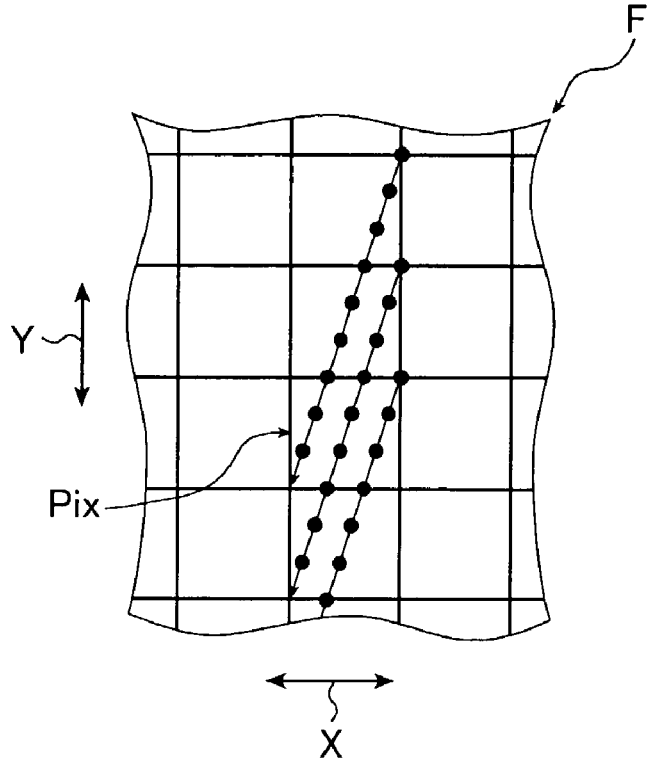

FIG. 13B conceptually shows the movement of each pixel (mirror) of the MMA 12 on the recording medium Pt during the image recording in the second embodiment of the present invention shown in FIGS. 6A to 9 described above.

As described above, in this embodiment, during the recording of one frame, the frame F is shifted at a ratio of auxiliary scanning direction:main scanning direction=one pixel:three pixels and modulation is performed nine times through equal time-division. As a result, each pixel of the MMA 12 is moved as indicated by the arrows and, for instance, the modulation is performed at each position specified by a dot.

When attention is given to the pixel position Pix of one pixel indicated by an arrow, at this pixel position Pix, during the image recording of one frame, three pixels (mirrors of the MMA 12) advance in the auxiliary scanning direction at regular intervals from one end to the other end with reference to the main scanning direction and respective pixels are modulated three times at regular intervals, that is, under a state where the phases thereof are aligned. That is, in this example, at the pixel position during the image recording of one frame, an image of 3×3=9 equal pixels are recorded for one pixel between the main scanning direction and the auxiliary scanning direction. Accordingly, there is performed image recording at resolution that is nine times as high as the resolution of the MMA 12.

Here, in the recording apparatus 10 in the second embodiment of the present invention, no specific limitation is imposed on the shift direction and the shift amount in such shifting of the frame F during the recording of one frame. That is, the shift direction and the shift amount need only be determined as appropriate in accordance with the resolution of an image to be recorded and the like. Also, it does not matter whether the shift direction and amount are fixed, are variable, or may be set as appropriate.

Further, in the illustrated example, the shifting of the frame F is performed in an opposite direction with reference to the main/auxiliary scanning directions. However, the present invention is not limited to this and the frame F may be shifted in a forward direction with reference to the main/auxiliary scanning directions. Alternatively, for instance, the frame F may be shifted in a forward direction with reference to the main scanning direction and in an opposite direction with reference to the auxiliary scanning direction.

Here, it is preferable that during the shifting of a frame F, the frame F is moved in each of the auxiliary scanning direction and the main scanning direction by one or more pixels in units of pixels (pixel pitch) of the MMA 12.

It is particularly preferable that the shift pixel number is set at 1 in one of the auxiliary scanning direction and the main scanning direction and is set as an integer equal to or larger than 2 in the other direction, or the numbers in both the directions are set as integers that are equal to or larger than 1 and are prime to each other and modulation is performed a number of times that is the square of the larger shift pixel number through equal time-division.

Alternatively, it is also preferable that, under a state where the aforementioned conditions are satisfied, when the magnification for changing the resolution in the auxiliary scanning direction corresponding to the target magnification for changing the resolution is referred to as "a" and the magnification for changing the resolution in the main scanning direction is referred to as "b", during the recording of one frame, the frame F is shifted by "b" pixels in the auxiliary scanning direction or by "a" pixels in the main scanning direction and modulation is performed a×b times through equal time-division. Note that even in this case, it is preferable that the shift pixel number is set at 1 in one of the auxiliary scanning direction and the main scanning direction and is set as an integer equal to or larger than 2 in the other direction, or the numbers in both the directions are set as integers that are equal to or larger than 1 and are prime to each other By satisfying the conditions described above, it becomes possible to efficiently enhance the recording resolution of the MMA 12 and to suitably perform image recording where there is performed the resolution conversion shown in FIGS. 5A to 10 described above. Note that there is imposed no specific limitation as to which of the A direction and the main scanning B direction under the conditions described above corresponds to which of the main scanning direction and the auxiliary scanning direction.

No specific limitation is imposed on the method of performing such shifting of the frame F (projection light), that is, a method of imparting a relative speed difference between (i) the main scanning and the auxiliary scanning and (ii) the tracking by the frame F during the recording of one frame. That is, it is possible to use various kinds of methods.

For instance, it is possible to use a method with which a speed difference is imparted between the main scanning speed (peripheral speed of the drum 22) and the tracking for having the frame F remain stationary, a method that uses the light deflector 12 as described above, a method with which a difference is imparted between the auxiliary scanning speed and the tracking speed in the auxiliary scanning direction by the light deflector, a method with which the recording medium Pt (drum 22 in the illustrated example) is moved, a method with which the optical system is moved, a method with which these methods are combined with each other, or the like.

Next, in the third embodiment of the present invention, during the recording of one frame, no specific limitation is imposed on the shift direction and the shift amount in performing such shifting of the frame F. Also, in the recording apparatus 10, the shift direction and shift amount of this frame F may be variable or may be set as appropriate.

Here, when one of pixel array directions of the MMA 12 (two-dimensionally arranged light sources) is referred to as the A direction, the other thereof is referred to as the B direction, the recording pixel pitch in the A direction is referred to as Ap, the recording pixel pitch in the B direction is referred to as Bp, the shift amount in the A direction is referred to as As, the shift amount in the B direction is referred to as Bs, and further As/Ap=m, and Bs/Bp=n, it is preferable that the shifting of the frame F is performed so that both of "m" and "n" become an integer equal to or larger than 1. That is, it is preferable that the shifting of the frame F is performed in units of pixels (pixel pitch) of the MMA 12 and the frame F is moved by one or more pixels in each of the A direction and the B direction.

It is particularly preferable that the shifting of the frame F is performed so that there is satisfied a condition that one of "m" and "n" is 1 and the other thereof is an integer equal to or larger than two. Alternatively, it is preferable that the shifting of the frame F is performed so that there is satisfied a condition that "m" and "n" are both integers that are equal to or larger than 1 and are prime to each other.

It should be noted here that in the recording apparatus 10 in the illustrated example, the A direction and the B direction coincide with the main scanning direction and the auxiliary scanning direction. However, no specific limitation is imposed on the correspondence between (i) the A direction and the B direction and (ii) the main scanning direction and the auxiliary scanning direction.

Further, it is preferable that under a state where the conditions described above are satisfied, the number of times of modulation of the MMA 12 (number of times of switching of a displayed image, that is, the number of time-division) during the recording of one frame is set as the square of larger one of "m" and "n" and the modulation is performed through equal time-division.

Figure 18A:
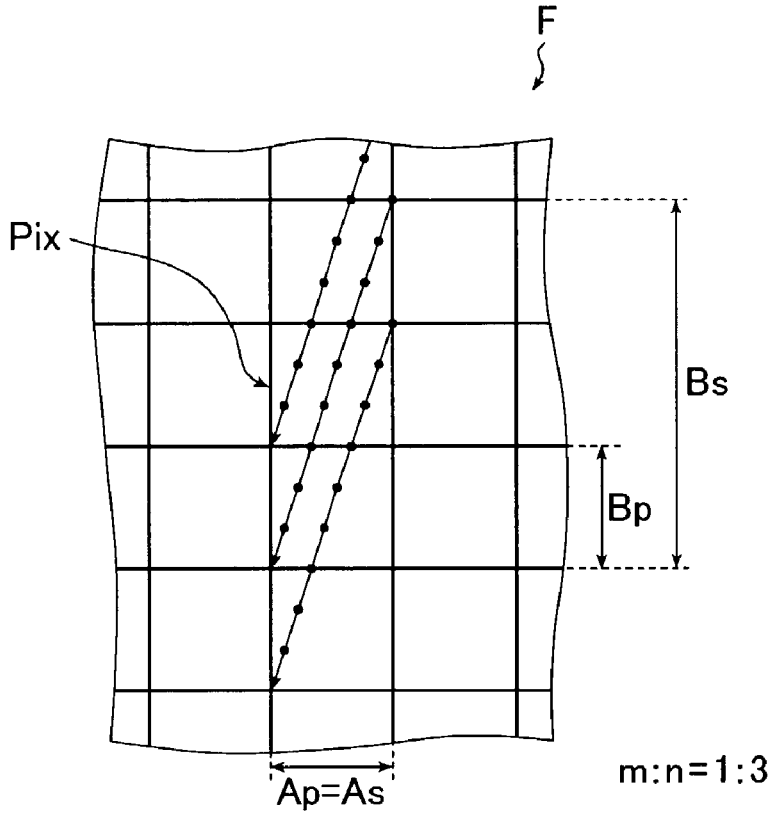
FIGS. 18A and 18B are each a conceptual diagram for illustrating an example of the image recording in the present invention.

FIG. 18A conceptually shows the movement of each pixel (mirror) of the MMA 12 on the recording medium Pt in the example of image recording in the third embodiment of the present invention shown in FIGS. 5A to 9 described above.

It should be noted here that in the following description, for ease of explanation, the horizontal direction in the drawings is set as the A direction, the vertical direction therein is set as the B direction, and the first modulation operation is performed when the shifting is started (when the recording of each frame F is started).

As described above, in this example, during the recording of one frame, the frame F is shifted at a ratio of A direction:B direction=one pixel:three pixels=m:n, and the modulation is performed nine times (square of three that is the value of "n" that is greater than "m") through equal time-division. As a result, each pixel of the MMA 12 is moved as indicated by the arrows and the modulation is performed at each position specified by a dot.

Here, when attention is given to the pixel position Pix of one pixel indicated by an arrow, at this pixel position Pix, during the image recording of one frame, three pixels (mirrors of the MMA 12) enter in the A direction from one end portion with reference to the B direction at regular intervals and advance to an end portion on the opposite side. During this operation, each pixel is modulated three times at regular intervals, that is, under a state where their phases are aligned. That is, in this example, at the pixel position at the beginning of recording of one frame, an image of 3×3=9 pixels that is even between A direction and B direction is recorded for one pixel. Accordingly, it is possible to approximately evenly perform image recording in both directions at resolution that is three times as high as the resolution of the MMA 12.

Figure 18B:
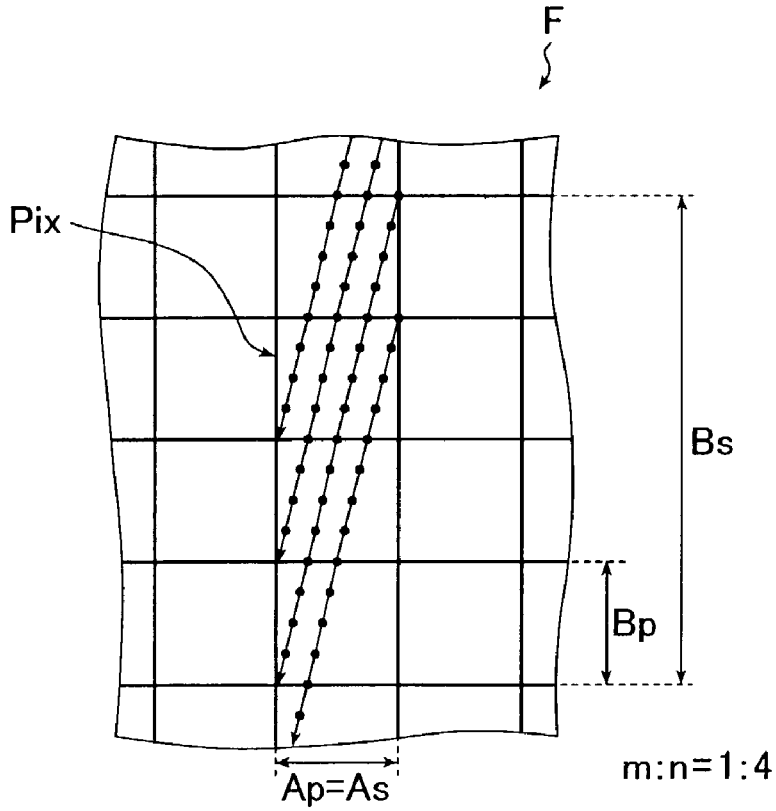

FIG. 18B conceptually shows the movement of each pixel of the MMA 12 in the case where the frame F is shifted at a ratio of A direction:B direction=one pixel:four pixels.

In this example, m:n=1:4, so that each pixel of the MMA 12 moves as indicated by the arrows and modulation is performed sixteen times during the recording of one frame through equal time-division.

In a like manner, when attention is given to the pixel position Pix specified by an arrow, four pixels advance from one end portion to the other end portion thereof in the B direction at the same interval and modulated four times while aligning the phases. That is, in this example, at the pixel position at the beginning of recording, an image of 4×4=16 pixels that is even between the A direction and the B direction is recorded for one pixel. Accordingly, it is possible to substantially evenly perform image recording in both directions at resolution that is four times as high as the resolution of the MMA 12.

Figure 19A:
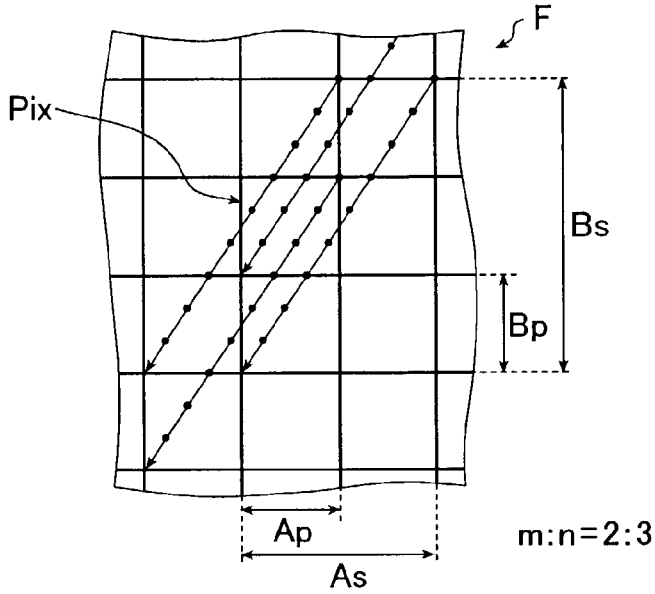
FIGS. 19A and 19B are each a conceptual diagram for illustrating another example of the image recording in the present invention.

FIG. 19A conceptually shows the movement of each pixel of the MMA 12 in the case where the frame F is shifted at a ratio of A direction:B direction=two pixels:three pixels.

In this example, m:n=2:3, so that each pixel of the MMA 12 moves as indicated by the arrows and modulation is performed nine times during the recording of one frame through equal time-division.

In a like manner, when attention is given to the pixel position Pix specified by an arrow, three pixels enter thereinto in the A direction at regular intervals from an end portion with reference to the B direction. Here, in this example where neither of "m" and "n" is 1, two pixels are modulated three times while advancing from one end portion of this pixel position Pix to the other end portion thereof in the B direction, although the remaining one pixel comes out of the pixel position Pix midway through the modulation. However, concurrently with this coming-out, another pixel enters there from an opposite end portion in the A direction having a smaller shift amount at the same interval in the A direction and at the same position in the B direction, and this pixel is modulated once at a timing at which other pixels are modulated. Accordingly, the number of times of modulation at this pixel position Pix becomes nine. Also, during the modulation of each pixel, the phases of respective pixels in the B direction are aligned.

That is, even in this example, at the pixel position at the beginning of recording, an image of 3×3=9 pixels that is even between the A direction and the B direction is recorded for one pixel. Accordingly, it is possible to approximately evenly perform image recording in both directions at resolution that is three times as high as the resolution of the MMA 12.

Figure 19B:
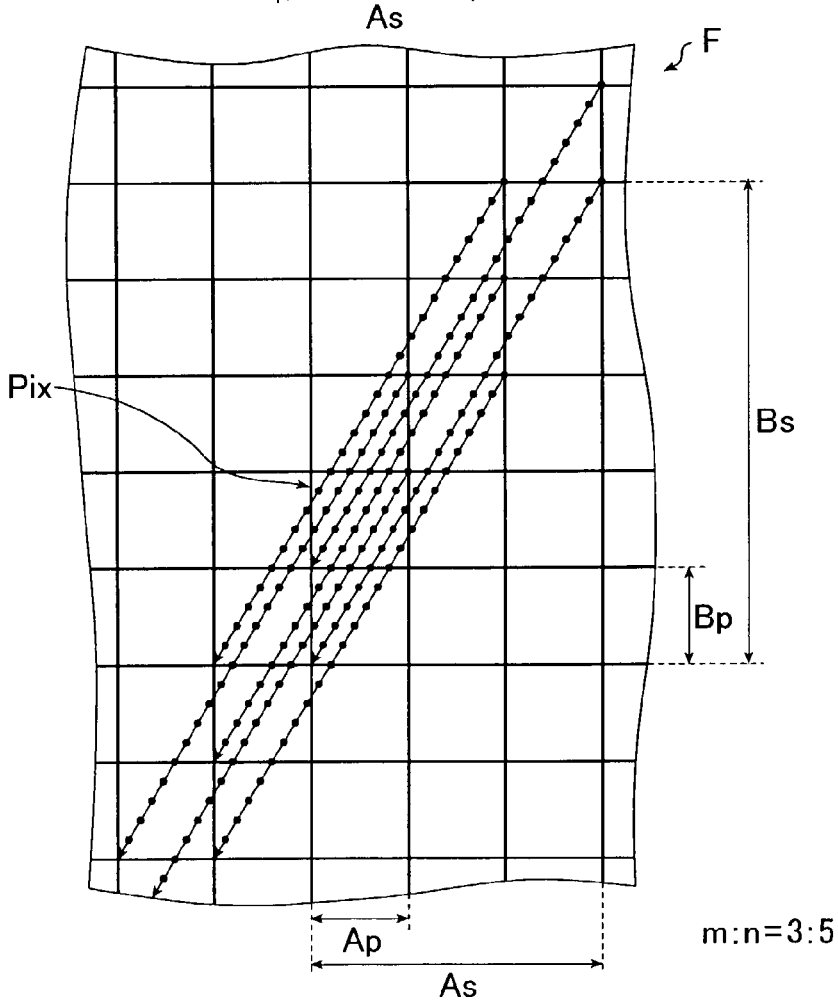

FIG. 19B conceptually shows the movement of each pixel of the MMA in the case where the frame F is shifted at a ratio of A direction:B direction=three pixels:five pixels.

In this example, m:n=3:5, so that each pixel of the MMA 12 moves as indicated by the arrows and modulation is performed twenty-five times during the recording of one frame through equal time-division.

In a like manner, when attention is given to the pixel position Pix specified by an arrow, five pixels enter thereinto in the A direction at regular intervals from an end portion with reference to the B direction, and three pixels advance to the other end portion of this pixel position Pix in the B direction, although the remaining two pixels comes out of the pixel position Pix midway through the modulation. However, in the same manner as the preceding example, in the same timing with this coming-out, another pixel enters the pixel position Pix at the same interval in the A direction and at the same position in the B direction, and this pixel is modulated under a state where the phases of the pixels at the pixel position Pix are aligned. Accordingly, the number of times of modulation at this pixel position Pix becomes twenty-five. Also, during the modulation of each pixel, the phases of respective pixels in the B direction are aligned.

That is, even in this example, at the pixel position at the beginning of recording, an image of 5×5=25 pixels that is even between the A direction and the B direction is recorded for one pixel. Accordingly, it is possible to substantially evenly perform image recording in both directions at resolution that is five times as high as the resolution of the MMA 12.

As is apparent from the above description, during the image recording by the present invention, at the pixel position of one pixel at the beginning of recording, pixels whose number is equal to the shift pixel number (pixel pitch number) in the B direction enter from an end portion with reference to the B direction (direction with a greater shift pixel number) at regular intervals in the A direction (direction with a smaller shift amount). Accordingly, if the advancing paths of pixels entering thereinto do not overlap each other, this pixel position is placed in a state where the position is divided in the shift pixel numbers in the A direction and the B direction (state where the resolution is increased).

Also, in the case where one pixel is divided in the shift pixel numbers in the A direction and the B direction, if modulation is performed a number of times that is the square of the shift pixel number in the B direction through equal time-division during the recording of one frame, the number of times of modulation of each pixel at the pixel position of one pixel becomes equal to the division number in the A direction and the phases of respective pixels during the modulation are aligned in the B direction. That is, it becomes possible to obtain a situation where the division number in the A direction is equal to the division number in the B direction.

By doing so, it becomes possible to perform division that is equal between both directions, to perform modulation in each direction, to equalize the resolution between both directions, and to improve the resolution of the MMA 12.

That is, during the image recording that uses the MMA 12 (two-dimensionally arranged light sources), the shifting of the frame F is performed in units of pixels so that there is satisfied the condition that one of "m" and "n" is one and the other thereof is an integer of at least two or both of "m" and "n" are integers that are at least one and are prime to each other. Also, modulation is performed a number of times that is the square of larger one of "m" and "n" through equal time-division. By doing so, it becomes possible to improve the resolution of the MMA 12 at favorable efficiency and to equalize the improvement of the resolution by the shifting of the frame F between the A direction and the B direction. That is, it becomes possible to uniformly improve the resolution of the MMA 12 in the two-dimensional directions and to record a high-quality image in which there has been performed the resolution conversion shown in FIGS. 5A to 10 described above.

By the way, in the example shown in FIGS. 19A and 19B, there is a case where one modulation operation for a pixel entering the pixel position Pix is not finished within this pixel position Pix and the modulation is continued even if the pixel reaches an adjacent pixel position.

Figure 20A:
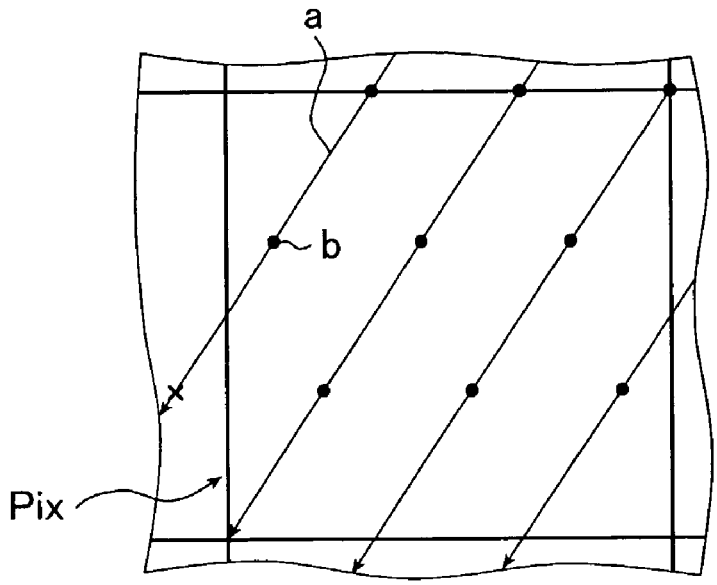
FIG. 20A is a partial magnified diagram of FIG. 19A.

For instance, as shown in FIG. 20A in which the pixel position Pix in FIG. 19A is magnified, in the case where there is obtained a duty of 100% at a pixel specified by the arrow "a" that passes through the pixel position Pix, the modulation started at the point "b" is finished at the position marked "x". That is, this pixel enters an adjacent pixel position.

In order to obviate the inconvenience like this, in the present invention, the number of times of modulation may be set as a number obtained by multiplying larger one of "m" and "n" by the least common multiple of both of "m" and "n". By doing so, it becomes possible to prevent a situation where the modulation started at each pixel position enters an adjacent pixel position.

Figure 20B:
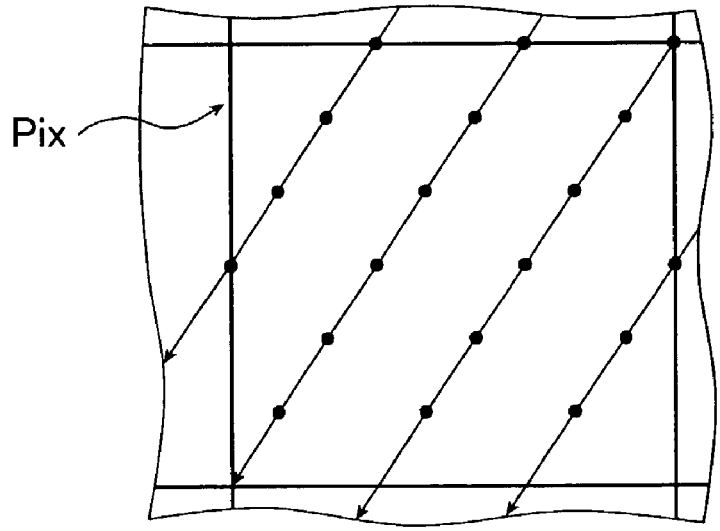
FIG. 20B is a conceptual diagram for illustrating another example of the image recording in the present invention.

That is, in this example, m:n=2:3, so that there occurs no problem if modulation is performed 3×6=18 times during the recording of one frame, as shown in FIG. 20B.

Each example described above has been explained based on the assumption that the pixels (pixel pitch) of the MMA 12 are isotropic, that is, Ap=Bp. However, even in the case of anisotropic pixels (Ap≠Bp), it is possible to perform suitable changing of resolution in a like manner using the present invention.

Further, in the case where the pixels are anisotropic, it is preferable that by utilizing this method, "t" that is an integer is obtained under a condition of "Bp/m=q and Ap/q=t" when m>n and is obtained under a condition of "Ap/n=q and Bp/q=t" when m<n and modulation is performed m*t times through equal time-division when m>n and is performed n*t times through equal time-division when m<n.

Figure 21A:
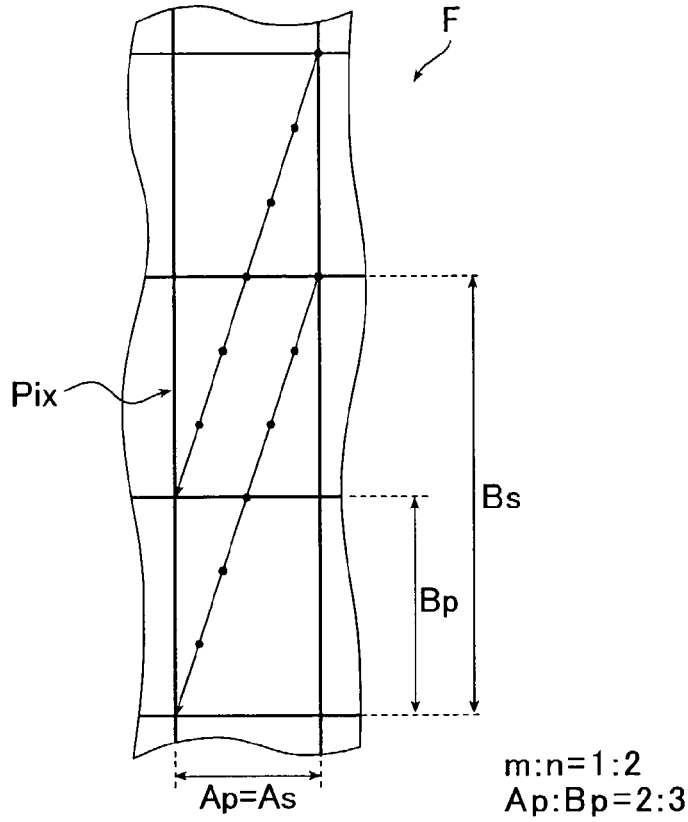
FIGS. 21A and 21B are each a conceptual diagram for illustrating another example of the image recording in the present invention.

An example thereof is shown in FIG. 21A. In this drawing, there is conceptually shown the movement of each pixel of the MMA 12 during the shifting of the frame F at a ratio of A direction:B direction=one pixel:two pixels using the MMA 12 whose pixels (pixel pitch) are Ap:Bp=2:3.

When attention is given to the pixel position Pix of one pixel, Ap:Bp=2:3 in this example, so that one pixel is divided in two in the A direction and is divided in three in the B direction (divided in six in total). By performing modulation in each direction, it becomes possible to realize resolution that is equal between the A direction and the B direction.

In the example shown in FIG. 21A, m:n=1:2 and m<n, so that Ap/n=2/2=1=q. Also, "t" becomes an integer solution from Bp/q=3/1=3=t. Accordingly, during the recording of one frame, modulation may be performed n*t=2×3=6 times through equal time-division. By doing so, as shown at the pixel position Pix, it becomes possible to perform the modulation through the division in two in the A direction and the division in three in the B direction (division in six in total).

Figure 21B:
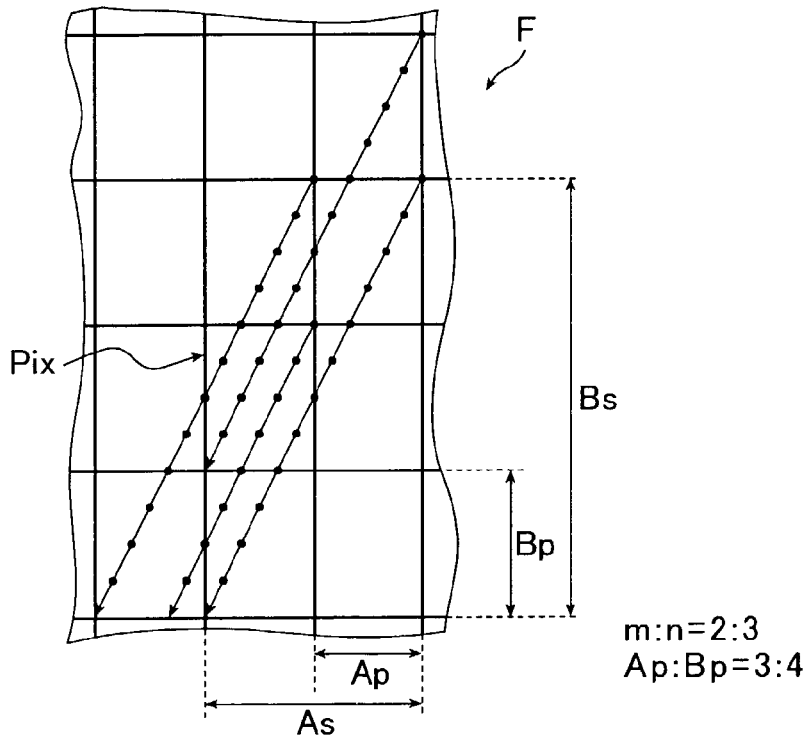

Another example is shown in FIG. 21B. In this drawing, there is conceptually shown the movement of each pixel of the MMA 12 during the shifting of the frame F at a ratio of A direction:B direction=two pixels:three pixels using the MMA 12 whose pixels (pixel pitch) are Ap:Bp=3:4.

When attention is given to the pixel position Pix of one pixel, Ap:Bp=3:4 in this example, so that one pixel is divided in three in the A direction and is divided in four in the B direction (divided in 12 in total) . By performing modulation in each direction, it becomes possible to realize resolution that is equal between the A direction and the B direction.

In the example shown in FIG. 21B, m:n=2:3 and m<n, so that Ap/n=3/3=1=q. Also, "t" becomes an integer solution from Bp/q=4/1=4=t. Accordingly, during the recording of one frame, modulation may be performed n*t=3×4=12 times through equal time-division. By doing so, as shown at the pixel position Pix, it becomes possible to perform the modulation through the division in three in the A direction and the division in four in the B direction (division in 12 in total).

As described above, in the example shown in FIG. 21A, Ap:Bp=2:3, so that one pixel is divided in two in the A direction and is divided in three in the B direction (divided in six in total) . Alternatively, the pixel may be divided in numbers that are integral multiples thereof. By performing modulation in each direction, it becomes possible to realize resolution that is equal between the A direction and the B direction.

Here, as described above, in the present invention, when viewed from the B direction (direction having a larger shift amount), pixels whose number is the same as the shift pixel number enter. That is, in the illustrated example, if the shift pixel number in the B direction is two, it is possible to divide one pixel in two in the A direction.

On the other hand, it is possible to divide one pixel in three in the B direction by performing modulation six times during the recording of one frame because the shift pixel number in the B direction is two. Here, one pixel is divided in two in the A direction, so that if an integer solution is not obtained when dividing Bp by the number "q" obtained by dividing Ap by two (=n) (that is, Bp/q), it becomes impossible to perform division that is equal between the A direction and the B direction.

Accordingly, in the case where pixels have anisotropy, if there is satisfied the condition described above, that is, if the number (t) obtained by dividing a pixel having a larger shift pixel number by the number "q" calculated by dividing a pixel (pixel pitch) having a smaller shift pixel number by a larger shift pixel number becomes an integer solution, the number of times of modulation is set at a number obtained by multiplying the larger shift pixel number by "t" and modulation is performed through equal time-division. By doing so, it becomes possible to perform the changing of resolution so that the resolution in the A direction is equal to the resolution in the B direction.

Even in the third embodiment of the present invention, like in the first embodiment, the frame F (projection light) is shifted (moved) in a direction containing components in both of the A direction and the B direction during the recording of one frame in this manner. By doing so, during the image recording that uses two-dimensionally arranged light sources, there is realized the image recording at an arbitrary resolution that has conventionally been impossible.

It should be noted here that even in the third embodiment of the present invention, like in the first embodiment, no specific limitation is imposed on the method of shifting the frame F on the recording medium Pt. That is, it is possible to use various kinds of methods. For instance, it is possible to use the methods described above.

Individual features of an image recording method and an image recording apparatus according to the fourth embodiment of the present invention will be described below.

By the way, in the conventional image recording that uses two-dimensionally arranged light sources, the expressible resolution is limited to an integral multiple of one pixel of the two-dimensionally arranged light sources (one pixel of the MMA 12 from which light is projected in the illustrated example). Consequently, in the case where there exists an error in the pitch of the MMA 12 (two-dimensionally arranged light sources) or an error from a design value in the focusing optical system, in the case where there exists an error in the diameter of the drum 22, in the case where there exists an error in the main scanning speed or the auxiliary scanning speed, in the case where there occurs an error in the size of the recording medium Pt or a machine part due to an environmental fluctuation concerning the temperature, humidity, or the like, or in other similar cases, the resolution of an image to be recorded reflects these errors and becomes different from a design value. Also, in order to correct these errors, it has been required to prepare a zoom lens or a focusing optical system for correction.

In contrast to this, as is apparent from the above description, according to the fourth embodiment of the present invention, during image recording that uses two-dimensionally arranged light sources utilizing the MMA 12 or the like, the frame F (projection light from the two-dimensionally arranged light sources) is shifted (moved) in a direction containing both the main and auxiliary components while the two-dimensionally arranged light sources are modulated in accordance with an image to be recorded. As a result, it becomes possible to perform image recording that is similar to a so-called scan exposure.

That is, according to the fourth embodiment of the present invention, irrespective of the resolution of the two-dimensionally arranged light sources, each pixel of the two-dimensionally arranged light sources is modulated in accordance with a target image and resolution. As a result, it becomes possible to perform image recording at arbitrary resolution without using a zoom lens or the like.

Therefore, there is predicted an error in the focusing optical system, a pitch error concerning the MMA 12, a size error concerning the recording medium Pt or a machine part due to a fluctuation of the temperature, humidity, or the like, for instance. By taking an error concerning resolution resulting from these errors into consideration, for example, there is predicted (calculated) the focusing position of each pixel of the MMA 12 on the recording medium Pt and modulation is performed in accordance with an image having target resolution in the manner described above. As a result, it becomes possible to obtain high-quality image where there occurs no error in resolution. Further, when such modulation performed by the shifting of a frame is performed in accordance with an image having target resolution, it becomes possible to record an image having arbitrary resolution, that is, to perform resolution conversion without difficulty.

Further, in accordance with the fourth embodiment of the present invention in which image recording is performed by shifting the frame by the MMA 12 (two-dimensionally arranged light sources) in this manner, it becomes possible to correct image quality degradation (hereinafter also referred to as the "correction of distortion aberration") due to the distortion aberration possessed by the optical system (mainly possessed by the focusing lens 18) as well as the error in resolution described above.

As is publicly known, a lens has distortion aberration (of pincushion type, barrel type, or the like), so that a frame focused on the recording medium Pt is also distorted accordingly. Consequently, if an image is formed by disposing such distorted frames in the manner shown in FIG. 3, there is generated a region in which no frame (image) is projected, or a region in which a plurality of frames overlap each other, in accordance with the distortion due to the distortion aberration. As a result, there is generated a stripe-shaped unevenness or the like in the image.

In contrast to this, in accordance with the fourth embodiment of the present invention in which exposure is performed by scanning frames by the MMA 12, there is predicted the state of distortion aberration possessed by the optical system and each pixel of the MMA 12 is modulated in accordance with a result of the predication. Consequently, it becomes possible to record an appropriate image where the distortion aberration has been corrected.

Figure 22A:
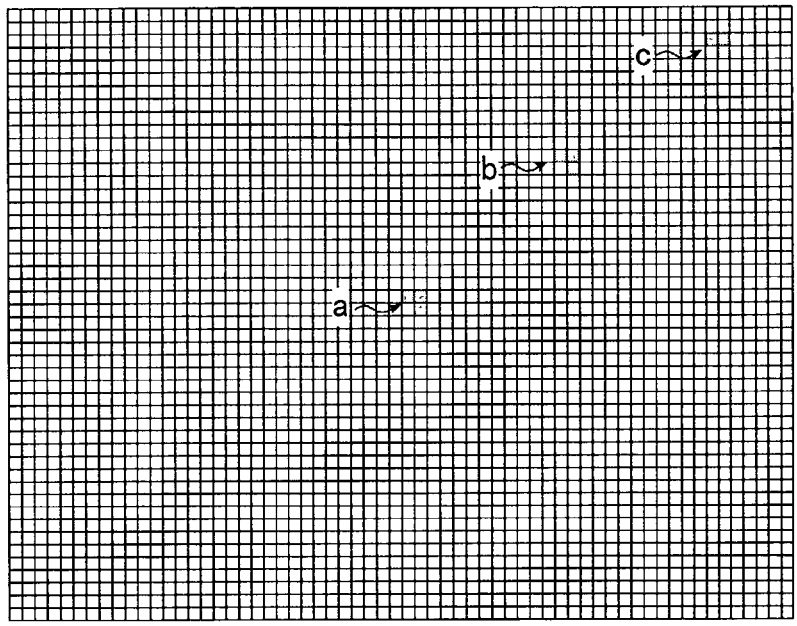
FIG. 22A is a conceptual diagram for illustrating an image to be recorded.

For instance, during the recording of one frame, as shown in FIG. 22A, a three-pixel image having a key shape that is the same as the image described above is recorded at each of three positions specified by reference symbols "a", "b", and "c".

Figure 22B:
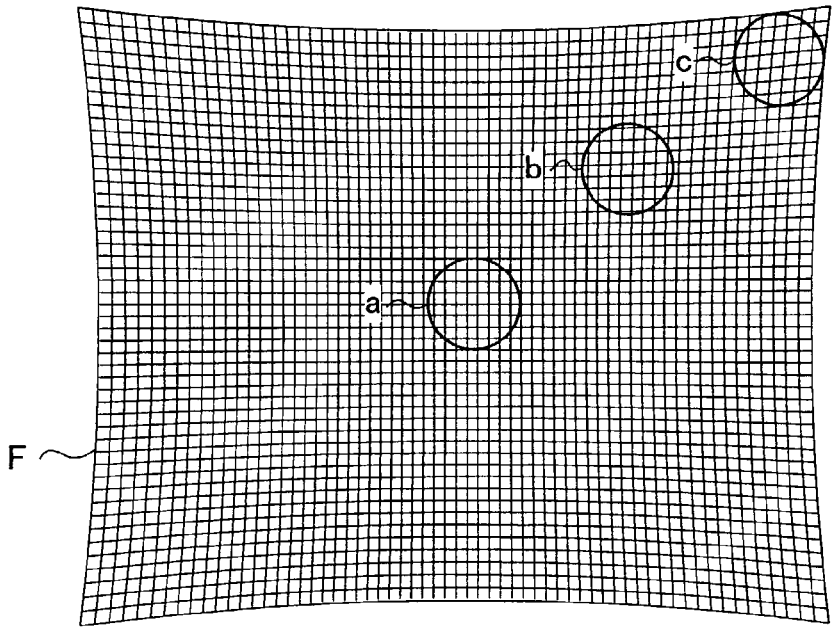
FIG. 22B is a conceptual diagram for illustrating distorted projection light by the micromirror array (MMA)

It is assumed that during this operation, the frame F formed by the MMA 12 is focused on the recording medium Pt while being distorted as a result of the distortion aberration (pincushion type in the illustrated example) by the focusing lens 18, as shown in FIG. 22B. On the other hand, an image at the position "a" in FIG. 22A is recorded in an area specified by a circle "a" of the frame F formed by the MMA 12 shown in FIG. 22B, an image at the position "b" is recorded in an area specified by a circle "b" thereof, and an image at a position "c" is recorded in an area specified by a circle "c" thereof. As shown in FIG. 22B, at the positions "b" and "c", the images are distorted due to the distortion aberration.

The distortion like this of the frame F due to the aberration is predicted and the modulation of the MMA 12 is performed in accordance with the predicted distortion.

As a specific example, there is predicted the distortion of the frame F due to the distortion aberration and the predicted distortion is taken into consideration. By doing so, it becomes possible to know the position of each pixel (its center) of the MMA 12 on the recording medium Pt at a timing of each modulation corresponding to the shifting of the frame (at a position at which the frame described above is shifted by the predetermined amount). Consequently, in accordance with this, like in the example described above, by activating each pixel of the MMA 12 whose center is contained in an image that should be recorded, it becomes possible to record an appropriate image in which there has been corrected the distortion aberration.

As an example, like in the aforementioned example shown in FIGS. 4 to 10, the frame F is shifted at a ratio of main scanning direction:auxiliary scanning direction=3:1 and one frame is recorded by performing modulation nine times through equal time-division.

Figures 23A, 23B, 23C:
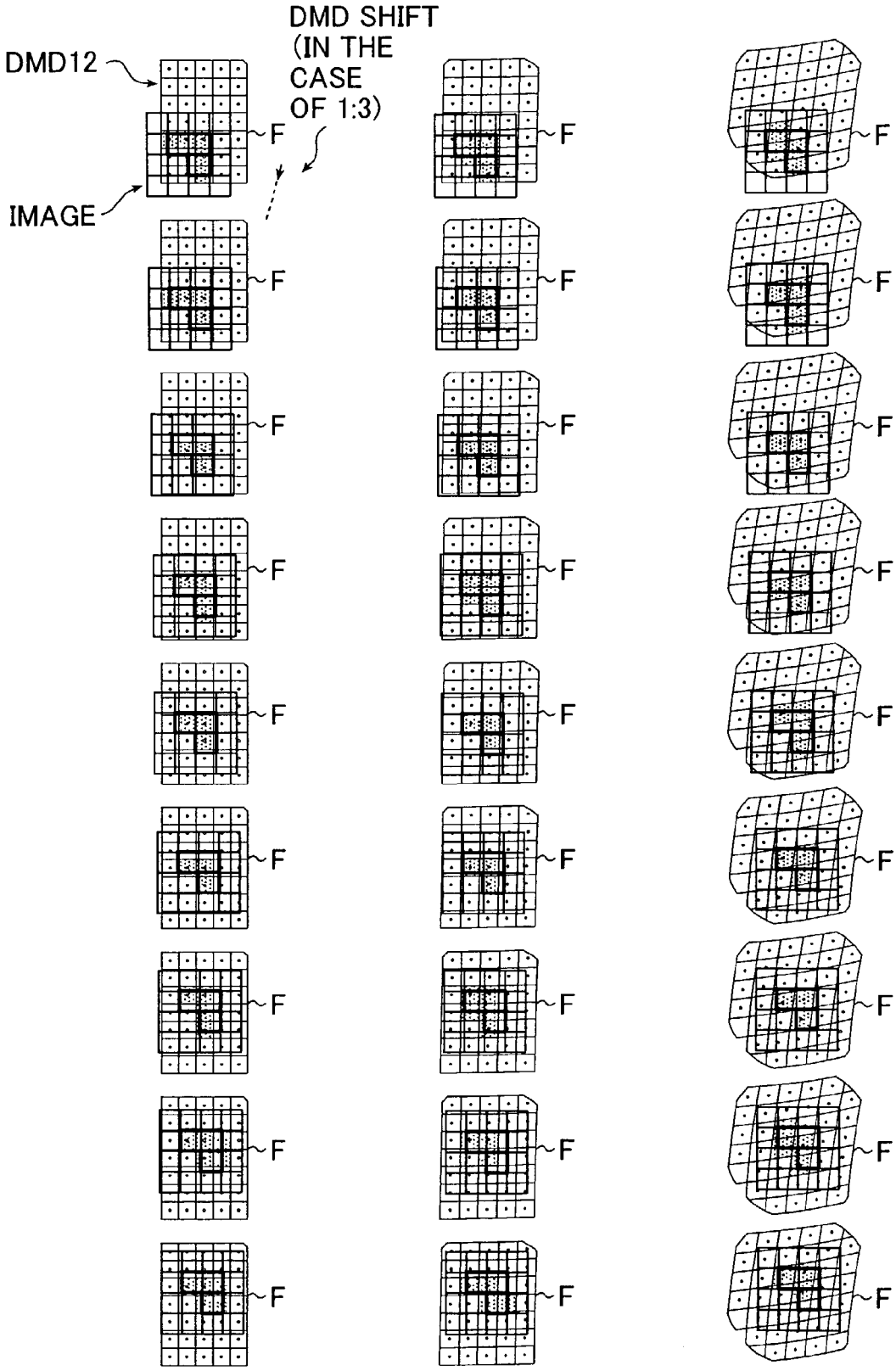
FIGS. 23A to 23C are each a conceptual diagram for illustrating the image recording by the present invention.

During this operation, if there is recorded an image shown in FIGS. 22A and 22B, the image recording at the position "a" in FIG. 22B, in which there exists no distortion of a frame due to aberration, becomes the one as shown in FIG. 23A. That is, the image recording becomes the same as the recording shown in FIGS. 6A to 8I described above.

It should be noted here that needless to say, the recording at each position in FIGS. 23A to 23C corresponds to FIGS. 6A to 8I described above in order from the upper side.

On the other hand, due to the distortion aberration, the position "b" of the frame F has slight distortion and the position "c" of the frame F has greater distortion.

However, as described above, in this example, this distortion is predicted and is taken into consideration. As a result, it becomes possible to predict the position of each pixel of the MMA 12 on the recording medium Pt during each modulation. In accordance with this predicted position, at each modulation position at which the frame is shifted by the predetermined amount, there is activated each pixel of the frame F whose center has entered in an image to be recorded. Accordingly, the modulation of each pixel of the MMA 12 at the position "b" is performed in the manner shown in FIG. 23B. On the other hand, the modulation of each pixel of the MMA 12 at the position "c" is performed in the manner shown in FIG. 23C.

Figure 24A:
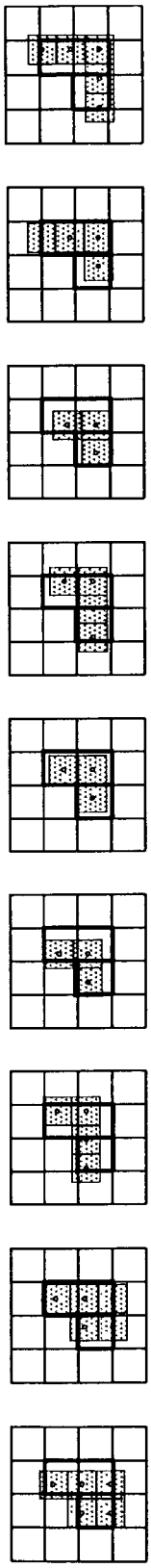
FIGS. 24A to 24C are each a conceptual diagram for illustrating the image recording by the present invention.
Figure 24B:
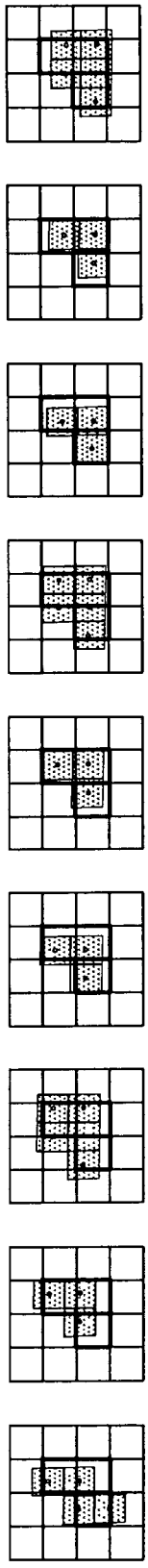
Figure 24C:
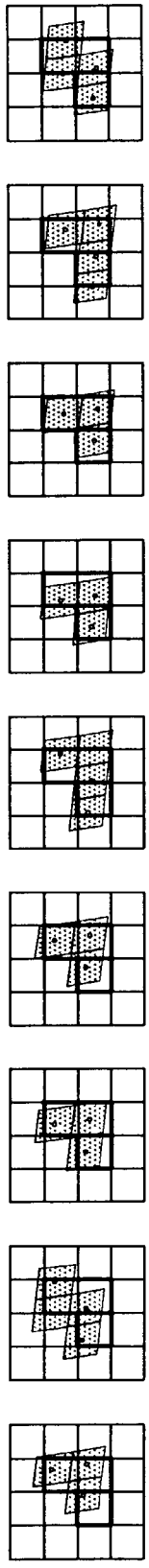

During the image recording shown in FIGS. 23A to 23C, if there is extracted only on-pixels of the MMA 12, there are obtained situations shown in FIGS. 24A, 24B, and 24C. Accordingly, the key-shaped image at each of the positions "a", "b", and "c" becomes as shown in FIGS. 25A, 25B, and 25C.

Figure 25A:
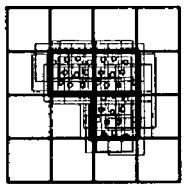
FIGS. 25A to 25C each conceptually show an image obtained by the image recording performed in FIGS. 24A to 24C.
Figure 25B:
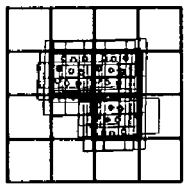
Figure 25C:
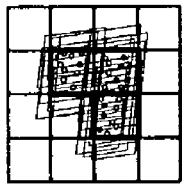

That is, according to the fourth embodiment of the present invention, by utilizing the shifting of the frame F, like in the aforementioned example, it becomes possible to record an appropriate image in which although there exists slight projection that does not cause any problem concerning image quality, the distortion aberration possessed by the optical system has been corrected as shown in FIGS. 25A to 25C.

A modulating method in which an error concerning an image recording and focusing optical system, a pitch error of the MMA 12, and the like are predicted and an error in resolution resulting from the predicted errors is taken into consideration during the modulation of each pixel of the MMA 12 (two-dimensionally arranged light sources) while shifting the frame F will be described below with reference to FIGS. 11 and 12. The modulating method in the fourth embodiment of the present invention is the same as the modulating method in the first to third embodiments of the present invention described above and therefore the description thereof will be omitted.

It should be noted here that in the fourth embodiment of the present invention, these functions Fx and Fy (determining LUT) are set by taking into consideration the predicted errors such as an error in the pitch of the MMA 12 and a size error concerning a machine part due to a temperature fluctuation, and so forth as well as the shift amount of the frame F. As a result, during image recording that uses two-dimensionally arranged light sources, it becomes possible to record an image having appropriate resolution in which resolution error has been corrected. Alternatively, there is predicted the distortion aberration of the focusing lens 18 or the like as described above and the functions Fx and Fy are set by taking the predicted distortion aberration into consideration. Accordingly, it becomes possible to record a high-quality image in which the distortion aberration has been corrected.

Further, in the fourth embodiment of the present invention, needless to say, it is preferable that image recording is performed so that both of such resolution error and distortion aberration are corrected. Therefore, it is possible to predict both of the resolution error and the distortion aberration and to determine the functions Fx and Fy by taking the predicted resolution error and distortion aberration into consideration.

It should be noted here that there is a case where the size or the like of the recording medium Pt changes with time due to a temperature fluctuation or the like. That is, there is a case where a resolution error or the like also changes with time.

Accordingly, these functions Fx and Fy may be changed (adjusted) with time. This changing of the functions may be performed in accordance with a result of measurement of an environmental room temperature or the like. Also, this changing may be performed in accordance with a preset sequence. Further, this changing may be performed by combining the measurement result and the preset sequence.

It should be noted here that with this modulating method, an image by means of the MMA 12 (two-dimensionally arranged light sources) is mapped on the recording medium Pt and an image pattern that should be recorded on the recording medium Pt is compared with the image position of each pixel of the MMA 12 on the recording medium Pt. By doing so, the activation/deactivation of each pixel of the MMA 12 is determined. However, the fourth embodiment of the present invention is not limited to this. It is possible to determine the activation/deactivation of each pixel of the MMA 12 by conversely mapping a pattern to be recorded on the recording medium Pt on the two-dimensionally arranged light sources.

FIG. 13B conceptually shows the movement of each pixel (mirror) of the MMA 12 on the recording medium Pt during the image recording in the fourth embodiment of the present invention shown in FIGS. 6A to 9 and the like described above. However, the pixel movement in the fourth embodiment is basically the same as the movement of each pixel of the MMA 12 during the image recording in the second embodiment of the present invention, so that the concrete description thereof will be omitted.

Even in the fourth embodiment of the present invention, as shown in FIG. 13B, when attention is given to the pixel position Pix of one pixel specified by an arrow, during the image recording of one frame, an image having 3×3=9 pixels is recorded for one pixel evenly between the main scanning direction and the auxiliary scanning direction. Accordingly, image recording at resolution that is nine times as high as the resolution of the MMA 12 is performed through the shifting of the frame F.

Here, even in the recording apparatus 10 in the fourth embodiment of the present invention, like in the second embodiment of the present invention, no specific limitation is imposed on the shift directions and shift amounts in the main scanning direction and the auxiliary scanning direction when the shifting of the frame F is performed during the recording of one frame. That is, the shift directions and shift amounts need only be determined as appropriate in accordance with the resolution and the like of an image to be recorded. Therefore, it is possible to use the methods described above.

In this embodiment, like in the second embodiment, it is preferable that the shifting of the frame F is performed in units of the pixels (pixel pitch) of the MMA 12 so that the frame F is moved by at least one pixel in each of the auxiliary scanning direction and the main scanning direction. It is possible to perform this shifting using the same methods as described above. However, during this operation, under a condition where the conditions described above are satisfied, when the magnification for changing the resolution in the auxiliary scanning direction corresponding to the target magnification for changing the resolution is referred to as "a" and the changing magnification in the main scanning direction corresponding thereto is referred to as "b", the frame F may be shifted by "b" pixels in the auxiliary scanning direction and by a number of pixels that is equal to or less than "b" in the main scanning direction during the recording of one frame. Alternatively, the frame F may be shifted by "a" pixels in the main scanning direction and by a number of pixels that is equal to or less than "a" in the auxiliary scanning direction.

In the fourth embodiment of the present invention, by satisfying the conditions described above, it becomes possible to improve the recording resolution of the MMA 12 with efficiency and to suitably perform the image recording where there has been performed the correction of resolution or distortion aberration shown in FIGS. 5A to 10 and the like described above. Note that needless to say, no specific limitation is imposed on the correspondence between (i) the A direction and B direction under the conditions described above and (ii) the main scanning direction and the auxiliary scanning direction.

Like in the second embodiment, no specific limitation is imposed on the method of performing the shifting of the frame F (projection light) like this. That is, it is possible to use various kinds of methods. For instance, it is possible to use the same methods as described above.

Next, individual features of an image recording method and an image recording apparatus in the fifth embodiment of the present invention will be described below.

By the way, as described above, during conventional image recording that uses two-dimensionally arranged light sources, the position and light quantity of projection light of each pixel of the MMA 12 is uniquely determined by an optical system.

Accordingly, the shading possessed by the optical system, that is, the focusing position error of an image, the size error of each pixel, the light quantity error of each pixel, and the like on the focusing surface (surface of the recording medium Pt) described above are reflected in a focused image as they are. In order to correct the shading like this, it is required to perform high-speed pulse modulation of each pixel. This means that it is substantially difficult to realize the correction of the shading.

In contrast to this, as is apparent from the above description, in accordance with the fifth embodiment of the present invention, during image recording that uses two-dimensionally arranged light sources that utilize the MMA 12 and the like, the frame F (projection light from the two-dimensionally arranged light sources) is shifted (moved) in a direction containing both the main and auxiliary components and the two-dimensionally arranged light sources are modulated in accordance with an image to be recorded. As a result, it becomes possible to perform image recording that is similar to so-called scan exposure using the two-dimensionally arranged light sources.

Consequently, according to the fifth embodiment of the present invention, a threshold value for activation is set so that the shading possessed by the optical system is corrected in accordance with the position of each pixel. By doing so, it becomes possible to directly adjust the area ratio of an image that makes it possible to record a high-quality image in which local fluctuations of an image area ratio are extremely reduced and the shading is suitably corrected.

An example of a method of modulating the MMA 12 (two-dimensionally arranged light sources) which involves the shading correction during such image recording that is performed while shifting the frame F will be described below with reference to FIGS. 26 and 27.

Figure 26:
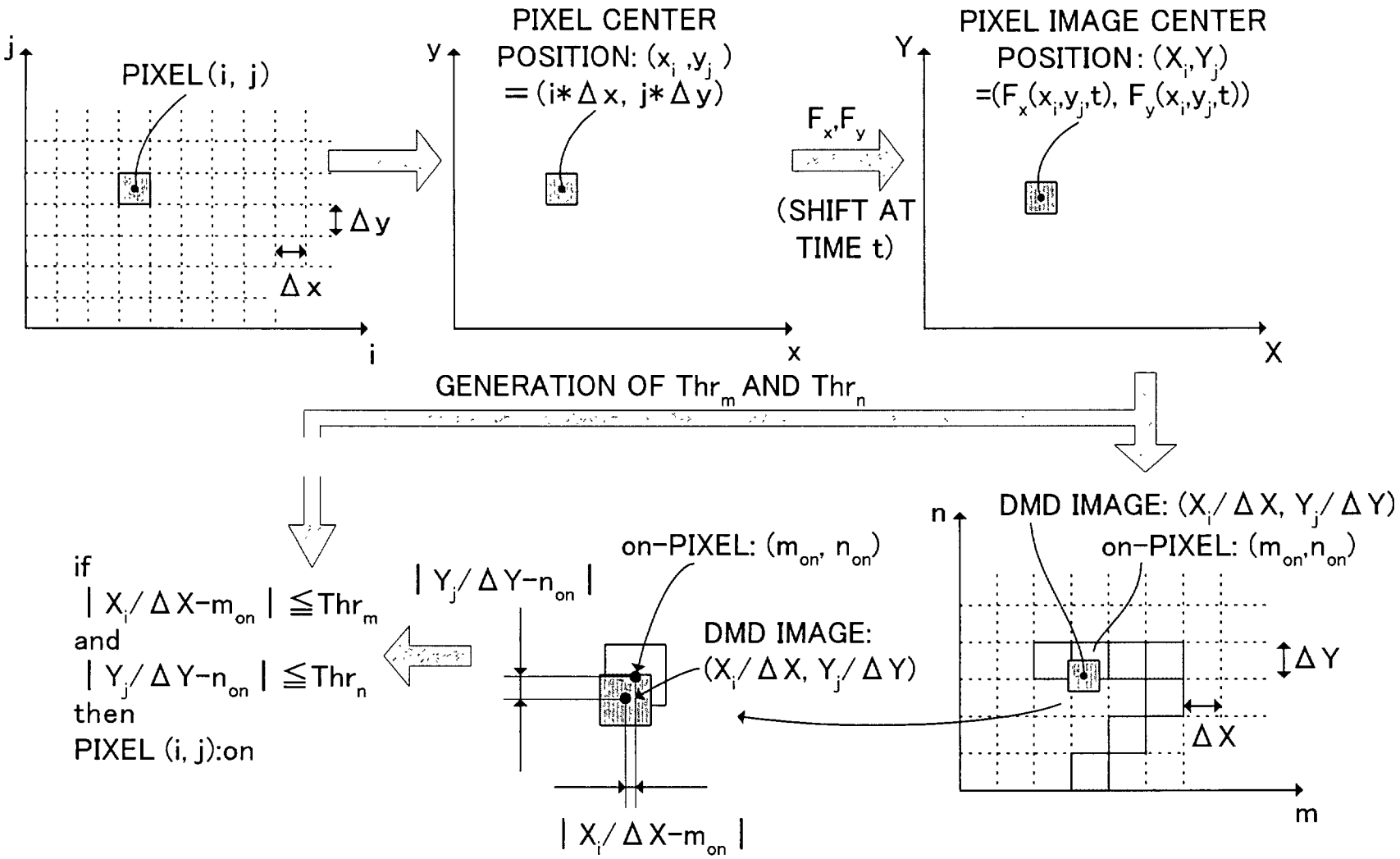
FIG. 26 is a conceptual diagram for illustrating an example of the image recording by the present invention.
Figure 27:
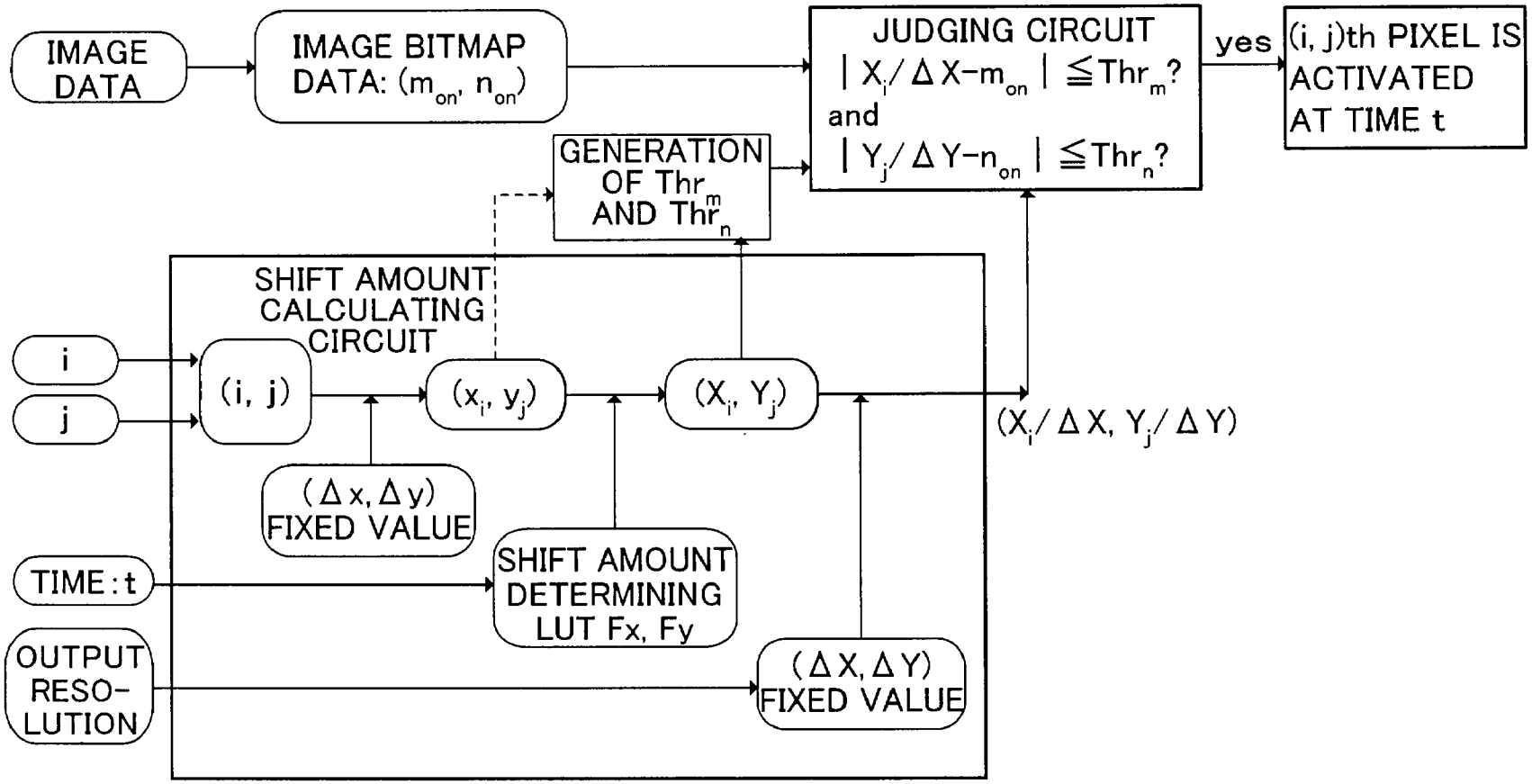
FIG. 27 is an example of a control block diagram for carrying out the image recording method shown in FIG. 26.

As shown in the upper-left portion in FIG. 26 and center-left portion in FIG. 27, a pixel that is the ith pixel in one of the pixel alignment/disposal directions of the MMA 12 and is the jth pixel (mirror) in the other thereof is referred to as the "pixel (i, j)". Note that in the illustrated example, "i" corresponds to the auxiliary scanning direction (X direction) and "j" corresponds to the main scanning direction (Y direction). Also, the pixel pitch of this MMA 12 in the main scanning direction is referred to as $\Delta y$ and the pixel pitch thereof in the auxiliary scanning direction is referred to as $\Delta x$.

Accordingly, it is possible to obtain the center position $(x_i, y_j)$ of this pixel (i, j) from $(i*\Delta x, j*\Delta y)$.

Here, a function expressing a shift amount in the auxiliary scanning direction is referred to as Fx and a function expressing a shift amount in the main scanning direction is referred to as Fy. In this case, the location of the center position $(x_i, y_j)$ of the aforementioned pixel (i, j) of the MMA 12 on the projection image at a time "t" during the recording of one frame can be expressed as "$(Fx(x_i, y_j, t), Fy(x_i, y_j, t))$". In the following description, this position will be referred to as the image center position $(x_i, y_j)$.

In the block diagram shown in FIG. 27, the image center position $(x_i, y_j)$ is obtained using a shift amount determining LUT (lookup table) corresponding to these functions Fx and Fy. It should be noted here that these functions Fx and Fy (determining LUT) may be set in consideration of the distortion aberration in the focusing lens 18 and the like as well as the shift amount. By doing so, it becomes possible to correct the shading and the aberration in the lens.

Also, after the image center position ($X_i$, $Y_j$) is calculated, there are generated a threshold value $Thr_m$ corresponding to the auxiliary scanning direction and a threshold value $Thr_n$ corresponding to the main scanning direction that are used to correct the shading in response to this pixel position (these threshold values will also be hereinafter collectively referred to as the "threshold values Thr").

The threshold values Thr may be generated by calculation for each image center position ($X_i$, $Y_j$) Alternatively, the threshold values Thr may be generated as an LUT in advance in response to each image center position ($X_i$, $Y_j$) during the recording of one frame.

It should be noted here that a method of determining the threshold values Thr will be described in detail later.

On the other hand, the pixel pitch in the main scanning direction and the pixel pitch in the auxiliary scanning direction at the output resolution of an image to be recorded are respectively referred to as ΔY and ΔX.

As described above, the center position ($x_i$, $y_j$) of the pixel (i, j) of the MMA 12 becomes an image center position ($X_i$, $Y_j$) on the projection image. Accordingly, by dividing the image center position by the pixel pitches, it becomes possible to know at which pixel on a bitmap of an image to be recorded there is positioned the image center position. In the case where (($x_i$/ΔX), ($Y_j$/ΔY)) corresponds to an on-pixel ($m_{on}$, $n_{on}$) on the image bitmap of an image to be recorded, it is possible to perform the image recording by modulating the MMA 12 so that the pixel (i, j) is activated. Also, in this exemplary case, on the image bitmap, "m" corresponds to the auxiliary scanning direction and "n" corresponds to the main scanning direction.

Here, the absolute value of a difference between (i) the position ($X_i$/ΔX, $Y_j$/ΔY) (hereinafter referred to as the "MMA image") obtained by dividing the aforementioned image center position ($X_i$, $Y_j$) by the pixel pitches and (ii) the on-pixel ($m_{on}$, $n_{on}$) on the image bitmap in a corresponding direction indicates a deviation of the center position of the MMA image from the center position of the on-pixel.

Accordingly, this absolute value is compared with threshold values $Thr_m$ and $Thr_n$ (both positive numbers) set as appropriate so as to respectively correspond to the main scanning and the auxiliary scanning with respect to each image center position ($X_i$, $Y_j$). In the case where the absolute values in both of the main scanning direction and the auxiliary scanning direction are equal to or lower than the threshold values Thr, modulation is controlled so that the pixel (i, j) of the MMA 12 is turned on. By doing so, it becomes possible to control the area ratio of an image to be recorded.

That is, in the case where the following conditions are both satisfied, it becomes possible to control the area ratio of an image to be recorded by controlling modulation so that the pixel (i, j) of the MMA 12 is turned on and it becomes possible to correct the shading through the direct correction of an area ratio.

$$|(X_i/\Delta X)-m_{on}|\leq Thr_m$$

$$|(X_j/\Delta Y)-n_{on}|\leq Thr_n$$

For instance, in the case of Thr=0.5, when the MMA image ($X_i$/ΔX, $Y_j$/ΔY) exists within the on-pixel ($m_{on}$, $n_{on}$) of the image bitmap, the pixel (i, j) of the MMA 12 is turned on. There is performed image recording in which the pixel is activated when the pixel center (dot)=image center position ($X_i$, $Y_j$) as shown in FIGS. 6A to 9 enters an image recording area, in other words, standard image recording where the shading correction is not performed.

On the other hand, in the case of Thr=0.6, even if the MMA image comes out of the on-pixel of the image bitmap by an amount corresponding to 0.1 pixel, the pixel is turned on. As a result, there is increased an area ratio.

Conversely, in the case of Thr=0.4, if the MMA image does not exist within an area that is smaller than the on-pixel of the image bitmap by an amount corresponding to 0.1 pixel, the pixel is not turned on. As a result, the area ratio is reduced.

No specific limitation is imposed on the method of generating the threshold values Thr. That is, threshold values Thr with which it is possible to correct the shading possessed by the optical system of the recording apparatus 10, need only be generated as appropriate in response to each pixel position.

For instance, there is examined a shading state under a standard state (threshold value Thr=0.5 with which there is not performed correction) in advance. For instance, there is examined the local fluctuations of an image area ratio (locality of a dot area ratio, in the case of a printing use). Then, this examined state is expressed using a function of each image center position ($X_i$, $Y_j$) described above and is set as S($X_i$, $Y_j$) [%].

In the case where S($X_i$, $Y_j$) [%] is large, the image area ratio is increased by the shading. Therefore, Thr is reduced at a position at which S($X_i$, $Y_j$) [%] is large and is conversely increased at a position at which S($X_i$, $Y_j$) [%] is small.

As an example, Thr may be calculated from the following equations.

$$Thr_m(X_i,\ Y_j)=a_m/S(X_i,\ Y_j)+b_m$$

$$Thr_n(X_i,\ Y_j)=a_n/S(X_i,\ Y_j)+b_n$$

It should be noted here that in the equations described above, $a_m$, $b_m$, $a_n$, and $b_n$ are each a constant that is determined as appropriate in accordance with the optical system.

In this example, one threshold value Thr is determined for each of the main scanning direction and the auxiliary scanning direction. However, the present invention is not limited to this. For instance, the same threshold value Thr may be used in both of the main scanning direction and the auxiliary scanning direction.

It should be noted here that during image recording that uses two-dimensionally arranged light sources, in general, the shading has a directional property. Therefore, it is preferable that, like in this example, one threshold value Thr is determined for each of the main scanning direction and the auxiliary scanning direction.

Also, in the example described above, there is performed judgment concerning the activation/deactivation of every pixel using the threshold values Thr. In the fifth embodiment of the present invention, aside from this judgment, there may be performed judgment concerning the activation/deactivation only of pixels in proximity to an image to be recorded using the threshold values Thr.

For instance, as described above, the judgment concerning the activation/deactivation may be performed in the manner described below. After an MMA image ($X_i$/ΔX, $Y_j$/ΔY) is obtained, an integer (int [$X_i$/ΔX], int [$Y_j$/ΔY]) is obtained through rounding. This integer is compared with an on-pixel ($m_{on}$, $n_{on}$) and the judgment concerning activation/ deactivation may be performed through the comparison using the threshold values only for pixels in proximity to an image to be recorded.

With this method, it becomes possible to perform high-speed processing by reducing the calculation amount.

Further, in the example described above, the threshold values are generated in accordance with the image center position ($X_i$, $Y_j$) of the shifted frame F at a time "t", that is, in accordance with the pixel position on a focusing surface. However, the present invention is not limited to this and the threshold values may be calculated in response to another pixel position.

For instance, as indicated by the dotted line in FIG. 27, the threshold values for shading correction at this pixel position may be generated in response to the center position ($x_i$, $y_j$) of the pixel (i, j) of the MMA 12 so long as the shading is not significantly affected by the shifting of the frame F and is approximately uniquely determined in response to each pixel position of the MMA 12.

As described above, in the fifth embodiment of the present invention, during the recording of one frame where the frame is made to remain stationary on the recording medium Pt through tracking, the frame F is shifted in a direction containing both the main and auxiliary components. By doing so, image recording is performed using the MMA 12 in a manner that is similar to scan exposure. Also, by directly adjusting the image area ratio, there is performed shading correction.

Also, as shown in FIG. 13B that conceptually shows the movement of each pixel (mirror) of the MMA 12 on the recording surface during the image recording shown in FIGS. 6A to 9 described above, when attention is given to the pixel position Pix of one pixel specified by an arrow, during the image recording of one frame, an image having 3×3=9 pixels is recorded for one pixel evenly in the main scanning direction and the auxiliary scanning direction. Accordingly, image recording at resolution that is nine times as high as the resolution of the MMA 12 is performed through the shifting of the frame F.

Here, even in the recording apparatus 10 in the fifth embodiment of the present invention, like in the second embodiment of the present invention, no specific limitation is imposed on the shift directions and shift amounts in the main scanning direction and the auxiliary scanning direction when the shifting of the frame F is performed during the recording of one frame. That is, the shift directions and shift amounts need only be determined as appropriate in accordance with the resolution and the like of an image to be recorded. Therefore, it is possible to use the methods described above.

In this embodiment, like in the second embodiment of the present invention, it is preferable that the shifting of the frame F is performed in units of the pixels (pixel pitch) of the MMA 12 so that the frame F is moved by at least one pixel in each of the auxiliary scanning direction and the main scanning direction. It is possible to perform this shifting using the same methods as above.

In the fifth embodiment of the present invention, by satisfying the conditions described above, it becomes possible to improve the recording resolution of the MMA 12 with efficiency and to suitably perform the shading correction by the image recording shown in FIGS. 5A to 10 and the like described above. Note that needless to say, no specific limitation is imposed on the correspondence between (i) the A direction and B direction under the conditions described above and (ii) the main scanning direction and the auxiliary scanning direction.

Like in the second embodiment of the present invention, no specific limitation is imposed on the method of performing the shifting of the frame F (projection light) like this. That is, it is possible to use various kinds of methods. For instance, it is possible to use the same methods as above.

As described in detail above, the recording apparatus 10 in the illustrated example according to each embodiment of the present invention performs the exposure of one frame while having the frame F remain stationary on the recording medium Pt through the tracking scan. The main scanning direction and the auxiliary scanning direction coincide with the pixel array directions of the MMA 12, that is, the A direction and B direction described above. In this recording apparatus 10, as a preferable example, the light deflector 16 that is a means for having the frame F track during the recording of one frame doubles as a means for shifting (moving) the frame F. Therefore, the deflection direction of the light deflector 16, that is, the deflection direction of projection light from the MMA 12 as deflected by the light deflector 16 is slightly tilted toward the auxiliary scanning direction with respect to the main scanning direction.

By doing so, there is generated a relative speed difference between (i) the main scanning and the auxiliary scanning and (ii) the tracking speed of the frame F with respect to the recording medium Pt. As a result, the frame F is shifted in a direction containing both of the main and auxiliary components (that is, components in the A direction and the B direction) during the recording of one frame.

Here, as an example, the deflection direction and the like as obtained by this light deflector 16 may be determined in accordance with a target shift amount and direction. Alternatively, the deflection direction and the like may be determined in accordance with the aforementioned angle ψ. Further, the deflection direction and the like may be determined in the manner described below.

Figure 28A:
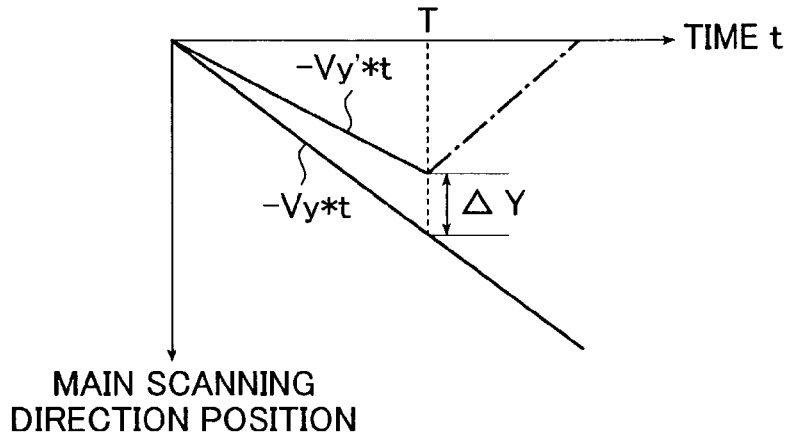
FIGS. 28A to 28C are each a conceptual diagram for illustrating the image recording by the image recording apparatus shown in FIG. 1.

When the peripheral speed of the drum 22, that is, the main scanning speed is referred to as Vy, a position Y(t) on the recording medium Pt in the main scanning direction (arrow Y direction) at a time "t" becomes "Y(t)=−Vy*t" during the recording of one frame, as shown in FIG. 28A.

On the other hand, the deflection speed on the recording medium Pt as obtained by the light deflector 16 (galvano-mirror in the illustrated example) is referred to as "Vy'", a position Y'(t) of a pixel (pixel of the MMA 12) on the recording medium Pt in the main scanning direction at a time "t" becomes "Y'(t)=−Vy'*t" during the recording of one frame, as shown in FIG. 28A. Note that in the illustrated example, the light deflector 16 is the galvano-mirror, so that this light deflector 16 is rocked in an opposite direction and is placed at a position specified by the alternate long and short dashed line at a point in time when a recording time period T has passed.

Here, when the recording time period for one frame is referred to as "T", the shift amount in the main scanning direction during the aforementioned recording of one frame can be expressed by the following difference ΔY between them.

$$\Delta Y = Y'(T) - Y(T)$$

$$\Delta Y = -Vy'*T - (-Vy*T)$$

$$Vy' = Vy - (\Delta Y/T)$$

On the other hand, during the recording of one frame, a position on the recording medium Pt in the auxiliary scanning direction (arrow X direction) at a time "t" does not move.

Figure 28B:
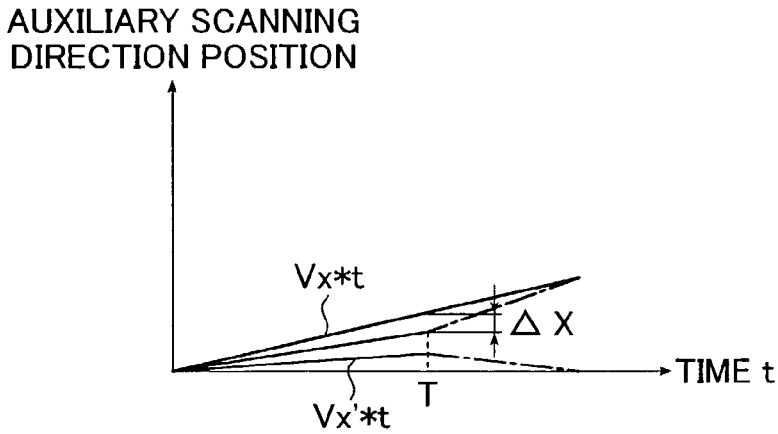

On the other hand, when the auxiliary scanning speed by means of the auxiliary scanning drive system 20 is referred to as "Vx", a position X(t) in the auxiliary scanning direction of a pixel at a time "t" resulting from the auxiliary scanning speed becomes "X(t)=Vx*t", as shown in FIG. 28B. Further, when the speed at which a pixel is moved in the auxiliary scanning direction by the light deflector 16 is referred to as "Vx'", a position X'(t) in the auxiliary scanning direction of a pixel at a time "t" resulting from the auxiliary scanning speed becomes "X'(t)=Vx'*t", as shown in FIG. 28B.

In a like manner, when the recording time period for one frame is referred to as "T", the shift amount in the auxiliary scanning direction during the aforementioned recording of one frame can be expressed by the following difference ΔX between them.

$$\Delta X = X'(T) - X(T)$$

$$\Delta X = Vx*T - Vx'*T$$

$$Vx' = Vx - (\Delta X/T)$$

When viewed from the optical system (MMA 12), a position on the recording medium Pt is determined by the auxiliary scanning speed Vx and the peripheral speed Vy of the drum 22.

Figure 28C:
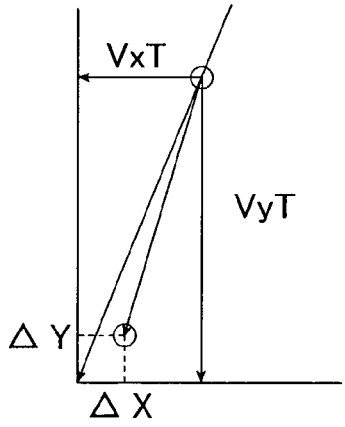
Figure 30A:
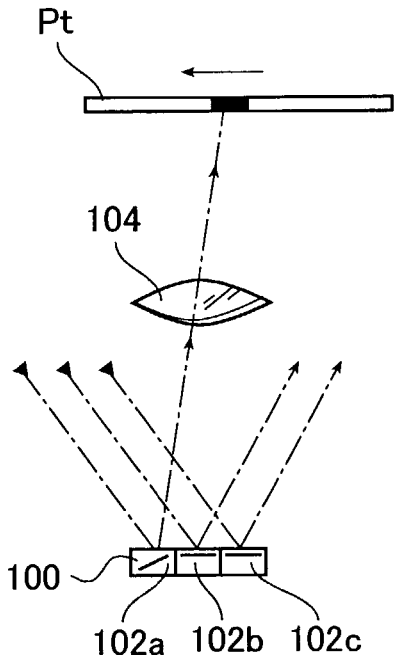
FIG.30A PRIOR ART
FIGS. 30A to 30C are each a conceptual diagram for illustrating conventional image recording that uses two-dimensionally arranged light sources.
Figure 30B:
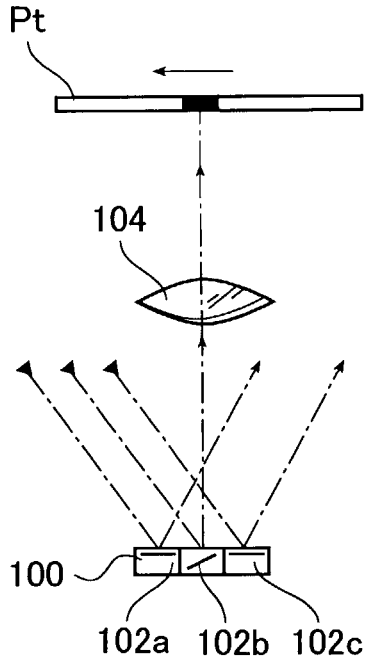
FIG.30B PRIOR ART
Figure 30C:
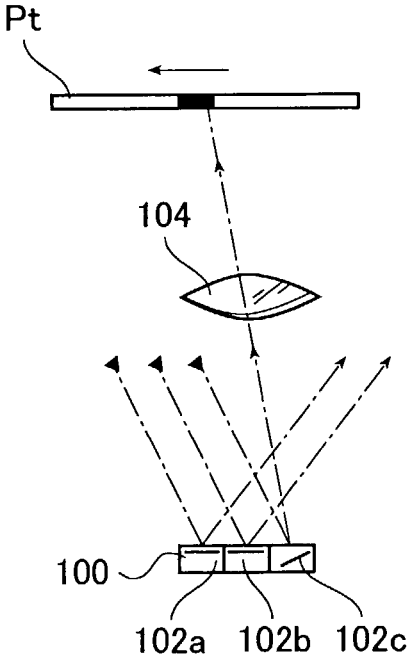
FIG.30C PRIOR ART

Accordingly, as shown in FIG. 28C, during the recording of one frame whose recording time period is "T", the setting of the light deflector 16 is performed so that deflection is performed from a point determined by Vx*T and Vy*T based on the main scanning speed and the auxiliary scanning speed toward a position displaced by ΔX and ΔY corresponding to target shift amounts.

Here, when an angle between the main scanning direction and the deflection direction as obtained by the light deflector 16 is referred to as "θ" and the deflection speed in the light deflector 16 is referred to as "Vg", the following relations are obtained.

$$\text{“}Vx' = Vg*\sin\theta\text{”}$$

$$\text{“}Vy' = Vg*\cos\theta\text{”}$$

Accordingly, the following equations are obtained.

$$\begin{aligned}\tan\theta &= (Vx'/Vy') \\ &= [Vx - (\Delta X/T)]/[Vy - (\Delta Y/T)] \\ &= (Vx*T - \Delta X)/([Vy*T - \Delta Y]\end{aligned}$$

That is, by setting the angle of the light deflector 16, the main scanning speed (rotation speed of the drum 22), the auxiliary scanning speed, and the like so that these equations are satisfied, it becomes possible to perform the shifting of the frame F that contains both of the target main scanning direction and auxiliary scanning direction (A direction and B direction) during the recording of one frame.

Here, in the preferred embodiments of the present invention, as described above, it does not matter whether the direction in which the frame F is shifted is the forward direction or opposite direction with respect to the main/auxiliary scanning directions. Accordingly, ΔX and ΔY are capable of assuming both of a positive value and a negative value. That is, in accordance with the direction in which the frame F is shifted, the angle of the light deflector 16 and the like need only be set so that the following equation is satisfied.

$$\tan\theta = (Vx*T \pm \Delta X)/([Vy*T \pm \Delta Y])$$

The method with which the frame F to be deflected by the light deflector 16 is shifted through the tracking scan like this during image recording that performs the recording (exposure) of one frame while having the frame F remain stationary on the recording medium Pt, is not limited to the method with which the light deflector 16 is tilted. That is, it is possible to use various kinds of methods.

For instance, the deflection direction of the projection light may be changed (rotated) and the shifting of the frame F may be performed by using an image rotator element such as a dove prism, causing projection light deflected by the light deflector 16 to enter the image rotator element, and adjusting the rotation angle of the image rotator element.

FIG. 29 collectively shows the relations between (i) the rotation angles (0°, 90°, 180°, and 270°) of the dove prism, an image rotator prism, and a pechan prism and (ii) the changing of an optical path of incident light (that is, the state of the shifting of the frame F). Note that even by combining three mirrors, it becomes possible to perform the shifting (rotation) of the projection light like in the case of the image rotator prism.

Also, the frame F may be shifted by mounting the light deflector 16 on a gonio-stage (swing stage) having a rotation axis that optically coincides with the optical axis of the focusing lens 18, by rotating the light deflector 16 through the angle adjustment of the gonio-stage, and by adjusting the deflection direction of the projection light.

Further, in place of this gonio-stage, a regulating member such as a pin may be provided at a position corresponding to the rotation center of the gonio-stage. In this case, the frame F is shifted by regulating the rotation of the light deflector 16, pushing and pulling the light deflector 16 at a position separated from the regulating member, and adjusting the rotation of the light deflector 16.

The image recording method and the image recording apparatus according to the present invention have been described in detail above based on various kinds of embodiments. However, the present invention is not limited to the embodiments described above and, needless to say, it is possible to make various kinds of changes or modifications without departing from the gist of the present invention.

For instance, the examples described above relate to an image recording apparatus that performs the tracking scan where an image for one frame is recorded by having projection light (frame) remain stationary on the recording medium through the deflection of the projection light from the two-dimensionally arranged light sources. However, the present invention is not limited to this. For instance, it is also possible to suitably apply the present invention to image recording shown in FIG. 29 described above where multiple-exposure is performed by having the projection light from the two-dimensionally arranged light sources remain stationary on a recording material through the movement (shifting) of an image at the two-dimensionally arranged light sources.

In this case, as an example, the shifting of the same image from a pixel column on the uppermost stream side to a pixel column on the lowermost stream side in the main scanning direction of the two-dimensionally arranged light sources can be regarded as one frame in the aforementioned example and the frame can be moved in a direction containing both of the main and auxiliary components during the image recording for one frame in a like manner.

Also, the present invention is not limited to a method with which one image is recorded by two-dimensionally disposing the image of one frame through the main scanning and auxiliary scanning like in the aforementioned example. For instance, one image may be recorded through the image recording of one frame.

Further, in the illustrated example, the projection light from the two-dimensionally arranged light sources is shifted in the direction containing components in both (main and auxiliary) pixel array directions of the two-dimensionally arranged light sources. However, the present invention is not limited to this. For instance, the projection light may be shifted only in one of the (main/auxiliary) pixel array directions. In this case, resolution may be arbitrarily changed only in this direction, or the correction of shading may be performed only in this direction.

For instance, in each example described above, the shift pixel number in the B direction is greater than the shift pixel number in the A direction, although the present invention is not limited to this. As is apparent by observing each drawing from the horizontal direction, even if the shift amount in the A direction is larger, it is possible to obtain completely the same effect. Note that in the case where there are performed the main scanning and the auxiliary scanning in the illustrated example, no specific limitation is imposed on the correspondence between (i) the A direction and the B direction and (ii) the main scanning direction and the auxiliary scanning direction, as described above.

Also, in each example described above, the shifting is performed in the lower-left direction in the drawings. However, the present invention is not limited to this. As is apparent by observing each drawing through the rotation of the drawing or by observing each drawing from the underside, it is possible to obtain completely the same effect even if the shifting direction is the rightward direction or the upward direction.

Also, in the examples described above, there has been mainly described the adjustment of an image area ratio, such as a dot area ratio in the case of a printing use. However, the present invention is not limited to this.

For instance, in a recording apparatus of photo-fabrication type etc., there is a case where the microscopic size of a portion that will be hardened through exposure varies due to the local fluctuations of the spot shape of a pixel to be focused. Even in this case, it becomes possible to produce a suitable fabricated article, in which the variations described above have been corrected by shifting the frame F using the two-dimensionally arranged light sources and by appropriately setting the threshold value concerning the activation/deactivation of each pixel in accordance with a position.

As has been described in detail above, according to the first, second, and third embodiments of the present invention, during image recording that uses two-dimensionally arranged light sources including optical recording elements disposed in a two-dimensional manner, such as the combination of a light source and a spatial light modulator like a micromirror array (MMA) or a light source in which point light sources like LEDs are disposed in a two-dimensional manner, it becomes possible to perform image recording at a plurality of arbitrary resolutions and also to record a high-quality image from which adverse effects of the distortion aberration possessed by an optical system or the like have been eliminated.

Also, as has been described in detail above, according to the fourth embodiment of the present invention, during the image recording that uses the aforementioned two-dimensionally arranged light sources including optical recording elements disposed in a two-dimensional manner, it becomes possible to obtain a high-quality image where there exists no error in resolution caused by an error in the optical system from a design value or the like and there exists no image distortion caused by the distortion aberration of the optical system and the like.

Also, as has been described in detail above, according to the fifth embodiment of the present invention, during the image recording that uses the aforementioned two-dimensionally arranged light sources including optical recording elements disposed in a two-dimensional manner, it becomes possible to record an image in which shading has been suitably corrected and to record a high-quality image in which there exists no local fluctuation of an image area ratio or the like. In the case of a printing use or the like, for instance, it becomes possible to produce a printing plate with a high image quality in which the locality of a dot area ratio is extremely reduced.

What is claimed is:

1. An image recording method for recording an image formed by a group of light source elements disposed in a two-dimensional manner on a recording medium, comprising:

moving at plural times an image recording position on the recording medium by the group of light source elements in a direction that contains a component in at least one of two-dimensional disposing directions of the group of light source elements during the recording of an image of one frame having a size of one image area to be recorded at one time by the group of light source elements on the recording medium, in accordance with a set magnification for changing resolution per recording pixel of the group of light source elements;

modulating at plural times, in response to respective movements at the plural times, each recording pixel of the group of light source elements in accordance with the image of one frame to be recorded; and exposing the recording medium at the plural times to each modulated recording pixel of the group of light source elements to record the image of the one frame to be recorded on the recording medium.

2. The image recording method according to claim 1, wherein the image recording position is moved by a length of the recording pixel along one of recording pixel array directions or by a fraction of the length of the recording pixel.

3. The image recording method according to claim 2, wherein the image recording position is moved by the length of the recording pixel and the length is a full pixel length.

4. The image recording method according to claim 2, wherein the image recording position is a frame.

5. The image recording method according to claim 1, wherein the image recording position is moved by a fraction of a length of the recording pixel along one of recording pixel array directions.

6. The image recording method according to claim 5, wherein the fraction of the length is determined by the set magnification for changing resolution.

7. The image recording method according to claim 1, wherein the one of the two-dimensional disposing directions of the group of light source elements is substantially perpendicular to another of the two-dimensional disposing directions and there are at least two light source elements along each of the two-dimensional disposing directions.

8. An image recording apparatus comprising:

two-dimensionally arranged light sources including a group of light source elements corresponding to recording pixels arranged in a two-dimensional manner;

a moving means for moving at plural times an image recording position on a recording medium by the group of light source elements in a direction that contains a component in at least one of recording pixel array directions of the group of light source elements during the recording of an image of one frame having a size of one image area to be recorded at one time by the group of light source elements on the recording medium, in accordance with a set magnification for changing resolution per recording pixel of the group of light source elements of the two-dimensionally arranged light sources; and a modulating means for modulating at the plural times each recording pixel of the group of light source elements in accordance with an the image of the one frame to be recorded in response to respective movements of the image recording position by the moving means, wherein said image of the one frame to be recorded is recorded on the recording medium by exposing the recording medium at the plural times to each recording pixel of the group of light source elements modulated by said modulating means.

9. The image recording apparatus according to claim 8, wherein the moving means moves the image recording position in a direction that contains components in both of the recording pixel array directions of the group of light source elements of the two-dimensionally arranged light sources.

10. The image recording apparatus according to claim 8, wherein:

the moving means moves the image recording position in units of the recording pixels of the group of light source elements of the two-dimensionally arranged light sources; and the image recording position is moved by b pixels if the image recording position is moved in an A direction and is moved by a pixels if the image recording position is moved in a B direction where one of the recording pixel array directions of the group of light source elements is the A direction, the other of the recording pixel array directions is the B direction, a resolution changing magnification in the A direction is a, and a resolution changing magnification in the B direction is b.

11. The image recording apparatus according to claim 10, wherein the modulating means performs modulation a×b times through equal time-division during the moving of the image recording position by the moving means.

12. The image recording apparatus according to claim 10, wherein the modulating means performs the movement of the image recording position such that it is moved by b pixels if the image recording position is moved in the A direction and is moved by a pixels if the image recording position is moved in the B direction.

13. The image recording apparatus according to claim 10, wherein a moving pixel number in the A direction and a moving pixel number in the B direction are alternatively set to one and an integer equal to or larger than two or are set to integers that are equal to or larger than one and are prime to each other.

14. The image recording apparatus according to claim 8, further comprising:

a main scanning means for relatively moving the two-dimensionally arranged light sources and the recording medium in a main scanning direction that coincides with one of the recording pixel array directions of the group of light source elements of the two-dimensionally arranged light sources;

an auxiliary scanning means for relatively moving the two-dimensionally arranged light sources and the recording medium in an auxiliary scanning direction perpendicular to the main scanning direction; and a tracking means for allowing the image recording position by the two-dimensionally arranged light sources to track the relative movement of the two-dimensionally arranged light sources and the recording medium by the main scanning means, wherein an image is recorded by disposing images by the two-dimensionally arranged light sources in the main scanning direction and the auxiliary scanning direction.

15. The image recording apparatus according to claim 14, wherein the main scanning direction and the auxiliary scanning direction coincide with the A direction and the B direction, respectively.

16. The image recording apparatus according to claim 8, wherein the moving means moves the image recording position by a length of the recording pixel along one of recording pixel array directions or by a fraction of the length of the recording pixel.

17. The image recording apparatus according to claim 8, wherein the moving means moves the image recording position by a fraction of a length of the recording pixel along one of recording pixel array directions.

18. The image recording apparatus according to claim 17, wherein the fraction of the length is determined by the set magnification for changing resolution.

19. The image recording apparatus according to claim 8, wherein the one of the recording pixel array directions of the group light source elements is substantially perpendicular to another of the recording pixel array directions and the recording pixel arrays comprises at least two light source elements along each of the two recording pixel array directions.

20. An image recording apparatus comprising:

two-dimensionally arranged light sources including a group of light source elements corresponding to recording pixels arranged in a two-dimensional manner;

a main scanning means for relatively moving the two-dimensionally arranged light sources and a recording medium in a main scanning direction that coincides with one of recording pixel array directions in the group of light source elements of the two-dimensionally arranged light sources;

an auxiliary scanning means for relatively moving the two-dimensionally arranged light sources and the recording medium in an auxiliary scanning direction perpendicular to the main scanning direction;

a tracking means for allowing an image recording position by the group of light source elements of the two-dimensionally arranged light sources to track the relative movement of the two-dimensionally arranged light sources and the recording medium;

a moving means for moving the image recording position by the two-dimensionally arranged light sources in a direction that contains a component in at least one of the main scanning direction and the auxiliary scanning direction by giving a relative speed difference between the tracking by the tracking means and the relative movement of the two-dimensionally arranged light sources and the recording medium; and a modulating means for modulating each recording pixel of the group of light source elements of the two-dimensionally arranged light sources in accordance with an image to be recorded in response to the movement of the image recording position by the moving means.

21. The image recording apparatus according to claim 20, wherein the moving means moves the image recording position in a direction that contains components in both of the recording pixel array directions of the group of light source elements of the two-dimensionally arranged light sources.

22. The image recording apparatus according to claim 20, wherein the tracking means and the moving means are a light deflector that deflects projection light of the two-dimensionally arranged light sources at an angle with respect to the main scanning direction.

23. The image recording apparatus according to claim 20, wherein the modulating means doubles as the tracking means by moving image display by the two-dimensionally arranged light sources in the main scanning direction.

24. The image recording apparatus according to claim 20, wherein, provided that a relative moving speed by the main scanning means is Vy, a relative moving speed by the auxiliary scanning means is Vx, a time taken to move the image recording position by the moving means is T, an angle between the moving direction of the image recording position by the moving means and the main scanning direction is θ, a moving distance of the image recording position by the moving means in the main scanning direction is ΔY, and a moving distance of the image recording position by the moving means in the auxiliary scanning direction is ΔX, the following equation is satisfied, $$\tan\theta=(V\times T\pm\Delta X)/(VyT\pm\Delta Y).$$

25. An image recording method for recording an image formed by a group of light source elements disposed in a two-dimensional manner on a recording medium, comprising:

moving at plural times an image recording position by the group of light source elements on the recording medium in a direction that contains a component in at least one of two-dimensional disposed directions of the group of light source elements during the recording of an image of one frame having a size of one image area to be recorded at one time by the group of light source elements on the recording medium;

modulating at plural times, in response to respective movements at the plural times, each recording pixel of the group of light source elements in accordance with the image of one frame to be recorded; and exposing the recording medium at the plural times to each modulated recording pixel of the group of light source elements to record the image of the one frame to be recorded on the recording medium.

26. The recording method according to claim 25, wherein the one of two-dimensional disposed directions of the group of light source elements is substantially perpendicular to another of the two-dimensional disposed directions and there are at least two light source elements along each of the two-dimensional disposed directions.

27. An image recording apparatus comprising:

two-dimensionally arranged light sources including a group of light source elements corresponding to recording pixels arranged in a two-dimensional manner;

a moving means for moving at plural times an image recording position by the group of light source elements of the two-dimensionally arranged light sources on a recording medium in a direction that contains a component in at least one of recording pixel array directions of the group of light source elements of the two-dimensionally arranged light sources during recording of an image of one frame having a size of one image area to be recorded at one time by the group of light source elements on the recording medium; and a modulating means for, in response to respective movements of the image recording position at the plural times by the moving means, modulating at the plural times each recording pixel of the group of light source elements of the two-dimensionally arranged light sources in accordance with the image of the one frame to be recorded, wherein said image of the one frame to be recorded is recorded on the recording medium by exposing the recording medium at the plural times to each recording pixel of the group of light source elements modulated by said modulating means.

28. The image recording apparatus according to claim 27, wherein the moving means moves the image recording position in a direction that contains components in both of the recording pixel array directions of the group of light source elements of the two-dimensionally arranged light sources.

29. The image recording apparatus according to claim 27, wherein, provided that one of the recording pixel array directions of the group of light source elements of the two-dimensionally arranged light sources is an A direction, the other of the recording pixel array directions is a B direction, a recording pixel pitch in the A direction is Ap, a recording pixel pitch in the B direction is Bp, a moving amount of the image recording position by the moving means in the A direction is As, a moving amount of the image recording position by the moving means in the B direction is Bs, As/Ap=m, and Bs/Bp=n, m and n are each an integer equal to or larger than one.

30. The image recording apparatus according to claim 29, wherein m and n are alternatively set to one and an integer equal to or larger than two, or are set to integers that are equal to or larger than one and are prime to each other.

31. The image recording apparatus according to claim 29, wherein the modulating means performs the modulation a number of times, which is square of greater one of m and n, through equal time-division during the movement of the image recording position by the moving means.

32. The image recording apparatus according to claim 29, wherein when Ap and Bp differ from each other and t that is an integer is obtained under a condition of Bp/m=q and Ap/q=t when m>n and is obtained under a condition of Ap/n=q and Bp/q=t when m<n, during the movement of the image recording position by the moving means, the modulating means performs the modulation m*t times through the equal time-division when m>n and performs the modulation n*t times through the equal time-division when m<n.

33. The image recording apparatus according to claim 27, further comprising:

a means for performing main scanning where the two-dimensionally arranged light sources and the recording medium are relatively moved in a direction;

a means for performing auxiliary scanning where the two-dimensionally arranged light sources and the recording medium are relatively moved in an auxiliary scanning direction perpendicular to the main scanning direction; and a tracking means for allowing the image recording position by the two-dimensionally arranged light sources approximately to track the main scanning and the auxiliary scanning, wherein:

an image is recorded by disposing images by the two-dimensionally arranged light sources in the main scanning direction and the auxiliary scanning direction; and the image recording position is moved by a relative speed difference between the approximate tracking by the tracking means and at least one of the main scanning and the auxiliary scanning.

34. The image recording apparatus according to 33, wherein the main scanning direction and the auxiliary scanning direction coincide with the A direction and the B direction.

35. The image recording apparatus according to claim 27, wherein the one of recording pixel array directions of the group of light source elements of the two-dimensionally arranged light sources is substantially perpendicular to another of the recording pixel array directions and there are at least two light source elements along each of the recording pixel array directions.

36. An image recording method for recording an image formed by a group of light source elements disposed in a two-dimensional manner on a recording medium, comprising:

moving at plural times an image recording position by the group of light source elements on the recording medium in a direction that contains a component in at least one of two-dimensional disposed directions of the group of light source elements during the recording of an image of one frame having a size of one image area to be recorded at one time by the group of light source elements on the recording medium;

modulating at plural times, in response to respective movements at the plural times, each recording pixel of the group of light source elements in accordance with the image of one frame to be recorded by taking, into consideration, a difference between an actual position of an image of the group of light source elements of the two-dimensionally arranged light sources on the recording medium and an ideal position of the two-dimensionally arranged light sources on the recording medium, and exposing the recording medium at the plural times to each modulated recording pixel of the group of light source elements to record the image of the one frame to be recorded on the recording medium.

37. The image recording method according to claim 36, wherein the one of two-dimensional disposed directions of the group of light source elements is substantially perpendicular to another of the two-dimensional disposed directions and there are at least two light source elements along each of the two-dimensional disposed directions.

38. An image recording apparatus comprising:

two-dimensionally arranged light sources including a group of light source elements corresponding to recording pixels arranged in a two-dimensional manner;

a moving means for moving at plural times an image recording position by the group of light source elements of the two-dimensionally arranged light sources on a recording medium in a direction that contains a component in at least one of recording pixel array directions of the group of light source elements of the two-dimensionally arranged light sources during recording of an image of one frame having a size of one image area to be recorded at one time by the group of light source elements on the recording medium; and a modulating means for, in response to respective movements of the image recording position at the plural times by the moving means, modulating at the plural times each recording pixel of the group of light source elements of the two-dimensionally arranged light sources in accordance with the image of the one frame to be recorded by taking, into consideration, a difference between an actual position of an image of the group of light source elements of the two-dimensionally arranged light sources on the recording medium and an ideal position of the group of light source elements of the two-dimensionally arranged light sources on the recording medium, wherein said image of the one frame to be recorded is recorded on the recording medium by exposing the recording medium at the plural times to each recording pixel of the group of light source elements modulated by said modulating means.

39. The image recording apparatus according to claim 38, wherein the modulating means performs the modulation using a function that shows a difference between a preset actual position of the image of the group of light source elements of the two-dimensionally arranged light sources on the recording medium and the ideal position of the group of light source elements of the two-dimensionally arranged light sources on the recording medium.

40. The image recording apparatus according to claim 39, wherein the function changes with time.

41. The image recording apparatus according to claim 38, wherein the modulating means performs the modulation by one of (i) mapping the image by the group of light source elements of the two-dimensionally arranged light sources on the recording medium and (ii) mapping a pattern, which should be recorded on the recording medium, on the group of light source elements of the two-dimensionally arranged light sources.

42. The image recording apparatus according to claim 38, wherein the one of recording pixel array directions of the group of light source elements of the two-dimensionally arranged light sources is substantially perpendicular to another of the recording pixel array directions and there are at least two light source elements along each of the recording pixel array directions.

43. An image recording method for recording an image formed by a group of light source elements disposed in a two-dimensional manner on a recording medium, comprising:

moving at plural times an image recording position by the group of light source elements on the recording medium in a direction that contains a component in at least one of two-dimensional disposing directions of the group of light source elements during the recording of an image of one frame having a size of one image area to be recorded at one time by the group of light source elements on the recording medium; and modulating at plural times, in response to respective movements at the plural times, each recording pixel of the group of light source elements in accordance with the image of one frame to be recorded based on a threshold value set based on a pixel position; and exposing the recording medium a the plural times to each modulated recording pixel of the group of light source elements to record the image of the one frame to be recorded on the recording medium.

44. An image recording apparatus comprising:

two-dimensionally arranged light sources including a group of light source elements corresponding to recording pixels arranged in a two-dimensional manner;

a moving means for, during the recording of an image of one frame having a size of one image area to be recorded at one time by the group of light source elements on the recording medium, moving at plural times an image recording position on a recording medium by the group of light source elements of the two-dimensionally arranged light sources in a direction that contains a component in at least one of recording pixel array directions of the group of light source elements of the two-dimensionally arranged light sources; and a modulating means for, in response to respective movements of the image recording position at the plural times by the moving means, modulating at the plural times each recording pixel of the group of light source elements of the two-dimensionally arranged light sources in accordance with the image of the one frame to be recorded based on a threshold value set based on a pixel position, wherein said image of the one frame to be recorded is recorded on the recording medium by exposing the recording medium at the plural times to each recording pixel of the group of light source elements modulated by said modulating means.

45. The image recording apparatus according to claim 44, wherein the moving means moves the image recording position in a direction that contains components in both of the recording pixel array directions of the group of light source elements of the two-dimensionally arranged light sources.

46. The image recording apparatus according to claim 44, further comprising:

a main scanning means for relatively moving the two-dimensionally arranged light sources and the recording medium in a main scanning direction that coincides with one of the recording pixel array directions in the group of light source elements of the two-dimensionally arranged light sources;

an auxiliary scanning means for relatively moving the two-dimensionally arranged light sources and the recording medium in an auxiliary scanning direction perpendicular to the main scanning direction; and a tracking means for allowing the image recording position by the two-dimensionally arranged light sources to track the relative movement of the two-dimensionally arranged light sources and the recording medium by the main scanning means, wherein an image is recorded by disposing images by the two-dimensionally arranged light sources in the main scanning direction and the auxiliary scanning direction.

47. The image recording apparatus according to claim 44, wherein the one of the recording pixel array directions of the group of light source elements of the two-dimensionally arranged light sources is substantially perpendicular to another of the recording pixel array directions and there are at least two light source elements along each of the recording pixel array directions.

48. An image recording apparatus comprising:

two-dimensionally arranged light sources including a group of light source elements corresponding to recording pixels arranged in a two-dimensional manner;

a tracking means for allowing an image recording position by the group of light source elements of the two-dimensionally arranged light sources to track a relative movement of the two-dimensionally arranged light sources and a recording medium;

a moving means for moving the image recording position by the two-dimensionally arranged light sources in a direction that contains a component in at least one of a main scanning direction and an auxiliary scanning direction by giving a relative speed difference between the tracking by the tracking means and the relative movement of the two-dimensionally arranged light sources and the recording medium; and a modulating means for modulating each recording pixel of the group of light source elements of the two-dimensionally arranged light sources in accordance with an image to be recorded in response to the movement of the image recording position by the moving means.

* * * * *